US011492687B2

(12) United States Patent
Toda et al.

(10) Patent No.: US 11,492,687 B2
(45) Date of Patent: Nov. 8, 2022

(54) STEEL SHEET

(71) Applicant: NIPPON STEEL CORPORATION, Tokyo (JP)

(72) Inventors: Yuri Toda, Tokyo (JP); Eisaku Sakurada, Tokyo (JP); Kunio Hayashi, Tokyo (JP); Akihiro Uenishi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 140 days.

(21) Appl. No.: 16/975,985

(22) PCT Filed: Mar. 30, 2018

(86) PCT No.: PCT/JP2018/013554

§ 371 (c)(1),
(2) Date: Aug. 26, 2020

(87) PCT Pub. No.: WO2019/186989

PCT Pub. Date: Oct. 3, 2019

(65) Prior Publication Data

US 2021/0040588 A1 Feb. 11, 2021

(51) Int. Cl.
*B32B 15/00* (2006.01)
*C22C 38/32* (2006.01)
(Continued)

(52) U.S. Cl.
CPC ..... *C22C 38/32* (2013.01); *C21D 9/46* (2013.01); *C22C 38/001* (2013.01);
(Continued)

(58) Field of Classification Search
None
See application file for complete search history.

(56) References Cited

U.S. PATENT DOCUMENTS

2014/0000765 A1 1/2014 Nozaki et al.
2015/0034219 A1 2/2015 Kawabe et al.
(Continued)

FOREIGN PATENT DOCUMENTS

CN 105492643 A 4/2016
JP 2005-171319 A 6/2005
(Continued)

*Primary Examiner* — Seth Dumbris
(74) *Attorney, Agent, or Firm* — Birch, Stewart, Kolasch & Birch, LLP

(57) ABSTRACT

A steel sheet has a predetermined chemical composition and a metal structure represented by, in area fraction, polygonal ferrite: 40% or less, martensite: 20% or less, bainitic ferrite: 50% to 95%, and retained austenite: 5% to 50%. In area fraction, 80% or more of the bainitic ferrite is composed of bainitic ferrite grains that have an aspect ratio of 0.1 to 1.0 and have a dislocation density of $8\times10^2$ (cm/cm$^3$) or less in a region surrounded by a grain boundary with a misorientation angle of 15° or more. In area fraction, 80% or more of the retained austenite is composed of retained austenite grains that have an aspect ratio of 0.1 to 1.0, have a major axis length of 1.0 μm to 28.0 μm, and have a minor axis length of 0.1 μm to 2.8 μm.

12 Claims, 1 Drawing Sheet

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/60*** | (2006.01) |
| ***C23C 2/06*** | (2006.01) |
| ***C23C 2/12*** | (2006.01) |
| ***C23C 2/40*** | (2006.01) |

(52) U.S. Cl.

CPC ..... *C22C 38/002* (2013.01); *C22C 38/02* (2013.01); *C22C 38/04* (2013.01); *C22C 38/22* (2013.01); *C22C 38/24* (2013.01); *C22C 38/26* (2013.01); *C22C 38/28* (2013.01); *C22C 38/60* (2013.01); *C23C 2/06* (2013.01); *C23C 2/12* (2013.01); *C23C 2/40* (2013.01); *C21D 2211/001* (2013.01); *C21D 2211/005* (2013.01); *C21D 2211/008* (2013.01)

(56) References Cited

U.S. PATENT DOCUMENTS

| | | | | |
|---|---|---|---|---|
| 2016/0177414 | A1 | 6/2016 | Takashima et al. | |
| 2016/0237520 | A1 | 8/2016 | Murata et al. | |
| 2018/0023155 | A1 | 1/2018 | Takeda et al. | |
| 2018/0037980 | A1* | 2/2018 | Wakita | C22C 38/38 |
| 2018/0237881 | A1* | 8/2018 | Okamoto | C22C 38/14 |

FOREIGN PATENT DOCUMENTS

| | | | |
|---|---|---|---|
| JP | 2013-185196 | A | 9/2013 |
| JP | 5589893 | B2 | 9/2014 |
| KR | 10-2017-0106414 | A | 9/2017 |
| WO | WO 2012/133563 | A1 | 10/2012 |
| WO | WO 2015/046364 | A1 | 4/2015 |

* cited by examiner

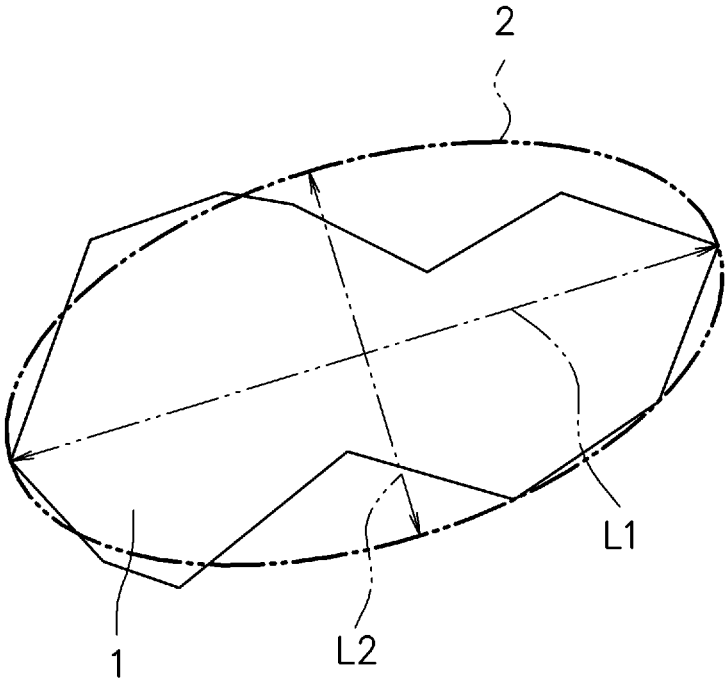
2
L1
1
L2

STEEL SHEET

TECHNICAL FIELD

The present invention relates to a steel sheet suitable for automotive parts.

BACKGROUND ART

In order to reduce the amount of carbon dioxide gas emissions from automobiles, the reduction in weight of automobile bodies using high-strength steel sheets has been in progress. For example, in order to secure the safety of a passenger, the high-strength steel sheet has come to be often used for framework system parts of a vehicle body. Examples of mechanical properties that have a significant impact on collision safety include a tensile strength, ductility, a ductile-brittle transition temperature, and a 0.2% proof stress. For example, a steel sheet used for a front side member is required to have excellent ductility.

On the other hand, the framework system part has a complex shape, and the high-strength steel sheet for framework system parts is required to have excellent hole expandability and bendability. For example, a steel sheet used for a side sill is required to have excellent hole expandability.

However, it is difficult to achieve both the improvement in collision safety and the improvement in formability. Conventionally, there have been proposed arts relating to the improvement in collision safety or the improvement in formability (Patent Literatures 1 and 2), but even these arts have difficulty in achieving both the improvement in collision safety and the improvement in formability.

CITATION LIST

Patent Literature

Patent Literature 1: Japanese Patent No. 5589893
Patent Literature 2: Japanese Laid-open Patent Publication No. 2013-185196
Patent Literature 3: Japanese Laid-open Patent Publication No. 2005-171319
Patent Literature 4: International Publication Pamphlet No. WO 2012/133563

SUMMARY OF INVENTION

Technical Problem

An object of the present invention is to provide a steel sheet capable of obtaining excellent collision safety and formability.

Solution to Problem

The present inventors conducted earnest examinations in order to solve the above-described problem. As a result, excellent elongation of a steel sheet with a tensile strength of 980 MPa or more was found to be exhibited by setting the area fractions and the forms of retained austenite and bainitic ferrite to predetermined area fractions and forms. Further, it became clear that when the area fraction of polygonal ferrite is low, the hardness difference is small in the steel sheet, and not only excellent elongation but also excellent hole expandability and bendability are obtained, and embrittlement resistance at sufficiently low temperatures and a 0.2% proof stress are also obtained.

As a result of further repeated earnest examinations based on such findings, the present inventor came to an idea of various aspects of the invention described below.

(1)

A steel sheet includes:

a chemical composition represented by, in mass %,

C: 0.10% to 0.5%,

Si: 0.5% to 4.0%,

Mn: 1.0% to 4.0%,

P: 0.015% or less,

S: 0.050% or less,

N: 0.01% or less,

Al: 2.0% or less,

Si and Al: 0.5% to 6.0% in total,

Ti: 0.00% to 0.20%,

Nb: 0.00% to 0.20%,

B: 0.0000% to 0.0030%,

Mo: 0.00% to 0.50%,

Cr: 0.0% to 2.0%,

V: 0.00% to 0.50%,

Mg: 0.000% to 0.040%,

REM: 0.000% to 0.040%,

Ca: 0.000% to 0.040%, and the balance: Fe and impurities; and a metal structure represented by, in area fraction, polygonal ferrite: 40% or less, martensite: 20% or less, bainitic ferrite: 50% to 95%, and retained austenite: 5% to 50%, in which in area fraction, 80% or more of the bainitic ferrite is composed of bainitic ferrite grains that have an aspect ratio of 0.1 to 1.0 and have a dislocation density of $8\times10^2$ ($cm/cm^3$) or less in a region surrounded by a grain boundary with a misorientation angle of 15° or more, and in area fraction, 80% or more of the retained austenite is composed of retained austenite grains that have an aspect ratio of 0.1 to 1.0, have a major axis length of 1.0 μm to 28.0 μm, and have a minor axis length of 0.1 μm to 2.8 μm.

(2)

The steel sheet according to (1), in which the metal structure is represented by, in area fraction, polygonal ferrite: 5% to 20%, martensite: 20% or less, bainitic ferrite: 75% to 90%, and retained austenite: 5% to 20%.

(3)

The steel sheet according to (1), in which the metal structure is represented by, in area fraction, polygonal ferrite: greater than 20% and 40% or less, martensite: 20% or less, bainitic ferrite: 50% to 75%, and retained austenite: 5% to 30%.

(4)

The steel sheet according to any one of (1) to (3), in which in the chemical composition, in mass %, Ti: 0.01% to 0.20%, Nb: 0.005% to 0.20%, B: 0.0001% to 0.0030%, Mo: 0.01% to 0.50%, Cr: 0.01% to 2.0%, V: 0.01% to 0.50%, Mg: 0.0005% to 0.040%, REM: 0.0005% to 0.040%, or Ca: 0.0005% to 0.040%, or an arbitrary combination of the above is established.

(5)

The steel sheet according to any one of (1) to (4), further includes:

a plating layer formed on a surface thereof.

Advantageous Effects of Invention

According to the present invention, it is possible to obtain excellent collision safety and formability because the area fractions, the forms, and the like of retained austenite and bainitic ferrite are proper.

BRIEF DESCRIPTION OF DRAWINGS

FIG. 1 is a view illustrating an example of an equivalent ellipse of a retained austenite grain.

DESCRIPTION OF EMBODIMENTS

There will be explained an embodiment of the present invention below.

First, there will be explained a metal structure of a steel sheet according to the embodiment of the present invention. The steel sheet according to this embodiment has a metal structure represented by, in area fraction, polygonal ferrite: 40% or less, martensite: 20% or less, bainitic ferrite: 50% to 95%, and retained austenite: 5% to 50%. In area fraction, 80% or more of the bainitic ferrite is composed of bainitic ferrite grains that have an aspect ratio of 0.1 to 1.0 and have a dislocation density of $8\times10^2$ (cm/cm$^3$) or less in a region surrounded by a grain boundary with a misorientation angle of 15° or more. In area fraction, 80% or more of the retained austenite is composed of retained austenite grains that have an aspect ratio of 0.1 to 1.0, have a major axis length of 1.0 μm to 28.0 μm, and have a minor axis length of 0.1 μm to 2.8 μm.

(Area Fraction of Polygonal Ferrite: 40% or Less)

Polygonal ferrite is a soft structure. Therefore, the difference in hardness between polygonal ferrite and martensite being a hard structure is large, and at the time of forming, cracking is likely to occur at an interface between them. The cracking also extends along this interface in some cases. When the area fraction of the polygonal ferrite is greater than 40%, such cracking and extension tend to occur, making it difficult to obtain sufficient hole expandability, bendability, embrittlement resistance at low temperatures, and 0.2% proof stress. Accordingly, the area fraction of the polygonal ferrite is set to 40% or less.

The lower the area fraction of the polygonal ferrite is, the less C is concentrated in the retained austenite, and the hole expandability improves, but the ductility decreases. Therefore, when the hole expandability is more important than the ductility, the area fraction of the polygonal ferrite is preferably set to 20% or less, and when the ductility is more important than the hole expandability, the area fraction of the polygonal ferrite is preferably set to greater than 20% and 40% or less. When the hole expandability is more important than the ductility as well, the area fraction of the polygonal ferrite is preferably set to 5% or more in order to ensure ductility.

(Area Fraction of Bainitic Ferrite: 50% to 95%)

Bainitic ferrite is denser and contains more dislocations than polygonal ferrite, which contributes to the increase in tensile strength. The hardness of bainitic ferrite is higher than that of polygonal ferrite and is lower than that of martensite, and thus, the difference in hardness between bainitic ferrite and martensite is smaller than that between polygonal ferrite and martensite. Accordingly, the bainitic ferrite contributes also to the improvement in hole expandability and bendability. When the area fraction of the bainitic ferrite is less than 50%, it is impossible to obtain a sufficient tensile strength. Therefore, the area fraction of the bainitic ferrite is set to 50% or more. When the hole expandability is more important than the ductility, the area fraction of the bainitic ferrite is preferably set to 75% or more. On the other hand, when the area fraction of the bainitic ferrite is greater than 95%, the retained austenite becomes short, failing to obtain sufficient formability. Accordingly, the area fraction of the bainitic ferrite is set to 95% or less.

(Area Fraction of Martensite: 20% or Less)

Martensite includes fresh martensite (untempered martensite) and tempered martensite. As described above, the difference in hardness between polygonal ferrite and martensite is large, and at the time of forming, cracking is likely to occur at an interface between them. The cracking also extends along this interface in some cases. When the area fraction of the martensite is greater than 20%, such cracking and extension tend to occur, making it difficult to obtain sufficient hole expandability, bendability, embrittlement resistance at low temperatures, and 0.2% proof stress. Accordingly, the area fraction of the martensite is set to 20% or less.

(Area Fraction of Retained Austenite: 5% to 50%)

Retained austenite contributes to the improvement in formability. When the area fraction of the retained austenite is less than 5%, it is impossible to obtain sufficient formability. On the other hand, when the area fraction of the retained austenite is greater than 50%, bainitic ferrite becomes short, failing to obtain a sufficient tensile strength. Accordingly, the area fraction of the retained austenite is set to 50% or less.

Identification of polygonal ferrite, bainitic ferrite, retained austenite, and martensite and determination of their area fractions can be performed, for example, by a scanning electron microscope (SEM) observation or transmission electron microscope (TEM) observation. When a SEM or TEM is used, for example, a sample is corroded using a nital solution and a LePera solution, and a cross section parallel to the rolling direction and the thickness direction (cross section vertical to the width direction) and/or a cross section vertical to the rolling direction are/is observed at 1000-fold to 100000-fold magnification.

Polygonal ferrite, bainitic ferrite, retained austenite, and martensite can also be distinguished by a crystal orientation analysis by crystal orientation diffraction (FE-SEM-EBSD) using an electron back scattering diffraction (EBSD) function attached to a field emission scanning electron microscope (FE-SEM), or by a hardness measurement in a small region such as a micro Vickers hardness measurement.

For example, in determining the area fractions of the polygonal ferrite and the bainitic ferrite, a cross section parallel to the rolling direction and the thickness direction of the steel sheet (a cross section vertical to the width direction) is polished and etched with a nital solution. Then, the area fraction is measured by observing a region where the depth from the surface of the steel sheet is ⅛ to ⅜ of the thickness of the steel sheet using a FE-SEM. Such an observation is made at a magnification of 5000 times for 10 visual fields, and from the average value of the 10 visual fields, the area fraction of each of the polygonal ferrite and the bainitic ferrite is obtained.

The area fraction of the retained austenite can be determined, for example, by an X-ray measurement. In this method, for example, a portion of the steel sheet from the surface up to a ¼ thickness of the steel sheet is removed by mechanical polishing and chemical polishing, and as characteristic X-rays, MoK α rays are used. Then, from integrated intensity ratios of diffraction peaks of (200) and (211) of a body-centered cubic lattice (bcc) phase and (200), (220), and (311) of a face-centered cubic lattice (fcc) phase, the area fraction of the retained austenite is calculated by using the following equation. Such an observation is made for 10 visual fields, and from the average value of the 10 visual fields, the area fraction of the retained austenite is obtained.

$$S\gamma=(I_{200f}+I_{220f}+I_{311f})/(I_{200b}+I_{211b})\times 100$$

(Sγ indicates the area fraction of the retained austenite, $I_{200f}$, $I_{220f}$, and $I_{311f}$ indicate intensities of the diffraction peaks of (200), (220), and (311) of the fcc phase respectively, and $I_{200b}$ and $I_{211b}$ indicate intensities of the diffraction peaks of (200) and (211) of the bcc phase respectively.)

The area fraction of the martensite can be determined by a field emission-scanning electron microscope (FE-SEM) observation and an X-ray measurement, for example. In this method, for example, a region where the depth from the surface of the steel sheet is ⅛ to ⅜ of the thickness of the steel sheet is set as an object to be observed and a LePera solution is used for corrosion. Since the structure that is not corroded by the LePera solution is martensite and retained austenite, it is possible to determine the area fraction of the martensite by subtracting the area fraction Sγ of the retained austenite determined by the X-ray measurement from an area fraction of a region that is not corroded by the LePera solution. The area fraction of the martensite can also be determined by using an electron channeling contrast image to be obtained by the SEM observation, for example. In the electron channeling contrast image, a region that has a high dislocation density and has a substructure such as a block or packet in a grain is the martensite. Such an observation is made for 10 visual fields, and from the average value of the 10 visual fields, the area fraction of the martensite is obtained.

(Area Fraction of Bainitic Ferrite Grains in a Predetermined Form: 80% or More of the Entire Bainitic Ferrite)

Bainitic ferrite grains with a high dislocation density do not contribute to the improvement in elongation as much as polygonal ferrite, and thus, as the area fraction of the bainitic ferrite grains with a high dislocation density is higher, the elongation tends to be lower. Then, it is difficult to obtain sufficient elongation when the area fraction of bainitic ferrite grains that have an aspect ratio of 0.1 to 1.0 and have a dislocation density of $8\times10^2$ (cm/cm$^3$) or less in a region surrounded by a grain boundary with a misorientation angle of 15° or more is less than 80%. Accordingly, the area fraction of the bainitic ferrite grains in such a form is set to 80% or more of the entire bainitic ferrite, and is preferably set to 85% or more.

The dislocation density of the bainitic ferrite can be determined by a structure observation using a transmission electron microscope (TEM). For example, by dividing the number of dislocation lines present in a crystal grain surrounded by a grain boundary with a misorientation angle of 15° by the area of this crystal grain, the dislocation density of the bainitic ferrite can be determined.

(Area Fraction of Retained Austenite Grains in a Predetermined Form: 80% or More of the Entire Retained Austenite)

Retained austenite is transformed into martensite during forming by strain-induced transformation. When the retained austenite is transformed into martensite, in the case where this martensite is adjacent to polygonal ferrite or untransformed retained austenite, there is caused a large difference in hardness between them. The large hardness difference leads to the occurrence of cracking as described above. Such cracking is prone to occur particularly in a place where stresses concentrate, and the stresses tend to concentrate in the vicinity of the martensite transformed from the retained austenite with an aspect ratio of less than 0.1. Then, when the area fraction of the retained austenite grains that have an aspect ratio of 0.1 to 1.0, have a major axis length of 1.0 μm to 28.0 μm, and have a minor axis length of 0.1 μm to 2.8 μm is less than 80%, the cracking due to stress concentration occurs easily, making it difficult to obtain sufficient elongation. Accordingly, the area fraction of the retained austenite grains in such a form is set to 80% or more of the entire retained austenite, and preferably set to 85% or more. Here, the aspect ratio of the retained austenite grain is the value obtained by dividing the length of a minor axis of an equivalent ellipse of the retained austenite grain by the length of its major axis. FIG. 1 illustrates one example of the equivalent ellipse. Even when a retained austenite grain 1 has a complex shape, an aspect ratio (L2/L1) of this retained austenite grain can be obtained from, of an equivalent ellipse 2, a length L1 of a major axis and a length L2 of a minor axis.

Next, there will be explained a chemical composition of the steel sheet according to the embodiment of the present invention and a slab to be used for manufacturing the steel sheet. As described above, the steel sheet according to the embodiment of the present invention is manufactured by undergoing hot rolling, pickling, cold rolling, first annealing, second annealing, and so on. Thus, the chemical composition of the steel sheet and the slab is one considering not only properties of the steel sheet but also these treatments. In the following explanation, "%" being the unit of a content of each element contained in the steel sheet and the slab means "mass %" unless otherwise stated. The steel sheet according to this embodiment and the slab used for manufacturing the steel sheet has a chemical composition represented by, in mass %, C: 0.1% to 0.5%, Si: 0.5% to 4.0%, Mn: 1.0% to 4.0%, P: 0.015% or less, S: 0.050% or less, N: 0.01% or less, Al: 2.0% or less, Si and Al: 0.5% to 6.0% in total, Ti: 0.00% to 0.20%, Nb: 0.00% to 0.20%, B: 0.0000% to 0.0030%, Mo: 0.00% to 0.50%, Cr: 0.0% to 2.0%, V: 0.00% to 0.50%, Mg: 0.000% to 0.040%, REM (rare earth metal): 0.000% to 0.040%, Ca: 0.000% to 0.040%, and the balance: Fe and impurities.

(C: 0.10% to 0.5%)

Carbon (C) contributes to the improvement in strength of the steel sheet and to the improvement in elongation through the improvement in stability of retained austenite. When the C content is less than 0.10%, it is difficult to obtain a sufficient strength, for example, a tensile strength of 980 MPa or more, and it is impossible to obtain sufficient elongation because the stability of retained austenite is insufficient. Thus, the C content is set to 0.10% or more and preferably set to 0.15% or more. On the other hand, when the C content is greater than 0.5%, the transformation from austenite into bainitic ferrite is delayed, and therefore, the bainitic ferrite grains in a predetermined form become short, failing to obtain sufficient elongation. Thus, the C content is set to 0.5% or less and preferably set to 0.25% or less.

(Si: 0.5% to 4.0%)

Silicon (Si) contributes to the improvement in strength of steel and to the improvement in elongation through the improvement in stability of retained austenite. When the Si content is less than 0.5%, it is impossible to sufficiently obtain these effects. Thus, the Si content is set to 0.5% or more and preferably set to 1.0% or more. On the other hand, when the Si content is greater than 4.0%, the strength of the steel increases too much, leading to a decrease in elongation. Thus, the Si content is set to 4.0% or less and preferably set to 2.0% or less.

(Mn: 1.0% to 4.0%)

Manganese (Mn) contributes to the improvement in strength of steel and suppresses a polygonal ferrite transformation that occurs in the middle of cooling of first annealing or second annealing. In the case where a hot-dip galvanizing treatment is performed, the polygonal ferrite transformation that occurs in the middle of cooling of this treatment is also suppressed. When the Mn content is less than 1.0%, it is impossible to sufficiently obtain these effects and polygonal ferrite is generated excessively, leading to a deterioration of hole expandability. Thus, the Mn content is set to 1.0% or more and preferably set to 2.0% or more. On the other hand, when the Mn content is greater than 4.0%, the strength of the slab and a hot-rolled steel sheet increases too much. Thus, the Mn content is set to 4.0% or less and preferably set to 3.0% or less.

(P: 0.015% or less)

Phosphorus (P) is not an essential element and is contained as an impurity in steel, for example. P segregates in the center portion of the steel sheet in the thickness direction, to reduce toughness and make a welded portion brittle. Therefore, a lower P content is better. When the P content is greater than 0.015%, in particular, the reduction in toughness and the embrittlement of weldability are prominent. Thus, the P content is set to 0.015% or less and preferably set to 0.010% or less. It is costly to reduce the P content, and if the P content is tried to be reduced to less than 0.0001%, the cost rises significantly. Therefore, the P content may be set to 0.0001% or more.

(S: 0.050% or less)

Sulfur (S) is not an essential element and is contained as an impurity in steel, for example. S reduces manufacturability of casting and hot rolling, and forms coarse MnS to reduce hole expandability. Therefore, a lower S content is better. When the S content is greater than 0.050%, in particular, the reduction in weldability, the reduction in manufacturability, and the reduction in hole expandability are prominent. Thus, the S content is set to 0.050% or less and preferably set to 0.0050% or less. It is costly to reduce the S content, and if the S content is tried to be reduced to less than 0.0001%, the cost rises significantly. Therefore, the S content may be set to 0.0001% or more.

(N: 0.01% or less)

Nitrogen (N) is not an essential element and is contained as an impurity in steel, for example. N forms coarse nitrides to degrade bendability and hole expandability and cause blowholes to occur at the time of welding. Therefore, a lower N content is better. When the N content is greater than 0.01%, in particular, the reduction in bendability and the reduction in hole expandability and the occurrence of blowholes are prominent. Thus, the N content is set to 0.01% or less. It is costly to reduce the N content, and if the N content is tried to be reduced to less than 0.0005%, the cost rises significantly. Therefore, the N content may be set to 0.0005% or more.

(Al: 2.0% or less)

Aluminum (Al) functions as a deoxidizing material and suppresses precipitation of iron-based carbide in austenite, but is not an essential element. When the Al content is greater than 2.0%, the transformation into polygonal ferrite from austenite is promoted to excessively generate polygonal ferrite, leading to a deterioration of hole expandability. Thus, the Al content is set to 2.0% or less and preferably set to 1.0% or less. It is costly to reduce the Al content, and if the Al content is tried to be reduced to less than 0.001%, the cost rises significantly. Therefore, the Al content may be set to 0.001% or more.

(Si+Al: 0.5% to 6.0% in Total)

Si and Al both contribute to the improvement in elongation through the improvement in stability of retained austenite. When the total content of Si and Al is less than 0.5%, it is impossible to sufficiently obtain this effect. Thus, the total content of Si and Al is set to 0.5% or more and preferably set to 1.2% or more. Only either Si or Al may be contained, or both Si and Al may be contained.

Ti, Nb, B, Mo, Cr, V, Mg, REM, and Ca are not an essential element, but are an arbitrary element that may be appropriately contained, up to a predetermined amount as a limit, in the steel sheet and the slab.

(Ti: 0.00% to 0.20%)

Titanium (Ti) contributes to the improvement in strength of steel through dislocation strengthening caused by precipitation strengthening and fine grain strengthening. Thus, Ti may be contained. In order to obtain this effect sufficiently, the Ti content is preferably set to 0.01% or more and more preferably set to 0.025% or more. On the other hand, when the Ti content is greater than 0.20%, carbonitride of Ti precipitates excessively, leading to a decrease in formability of the steel sheet. Thus, the Ti content is set to 0.20% or less and preferably set to 0.08% or less.

(Nb: 0.00% to 0.20%)

Niobium (Nb) contributes to the improvement in strength of steel through dislocation strengthening caused by precipitation strengthening and fine grain strengthening. Thus, Nb may be contained. In order to obtain this effect sufficiently, the Nb content is preferably set to 0.005% or more and more preferably set to 0.010% or more. On the other hand, when the Nb content is greater than 0.20%, carbonitride of Nb precipitates excessively, leading to a decrease in formability of the steel sheet. Thus, the Nb content is set to 0.20% or less and preferably set to 0.08% or less.

(B: 0.0000% to 0.0030%)

Boron (B) strengthens grain boundaries and suppresses a polygonal ferrite transformation that occurs in the middle of cooling of first annealing or second annealing. In the case where a hot-dip galvanizing treatment is performed, the polygonal ferrite transformation that occurs in the middle of cooling of this treatment is also suppressed. Thus, B may be contained. In order to obtain this effect sufficiently, the B content is preferably set to 0.0001% or more and more preferably set to 0.0010% or more. On the other hand, when the B content is greater than 0.0030%, the addition effect is saturated and the manufacturability of hot rolling decreases. Thus, the B content is set to 0.0030% or less and preferably set to 0.0025% or less.

(Mo: 0.00% to 0.50%)

Molybdenum (Mo) contributes to the strengthening of steel and suppresses a polygonal ferrite transformation that occurs in the middle of cooling of first annealing or second annealing. In the case where a hot-dip galvanizing treatment is performed, the polygonal ferrite transformation that occurs in the middle of cooling of this treatment is also suppressed. Thus, Mo may be contained. In order to obtain this effect sufficiently, the Mo content is preferably set to 0.01% or more and more preferably set to 0.02% or more. On the other hand, when the Mo content is greater than 0.50%, the manufacturability of hot rolling decreases. Thus, the Mo content is set to 0.50% or less and preferably set to 0.20% or less.

(Cr: 0.0% to 2.0%)

Chromium (Cr) contributes to the strengthening of steel and suppresses a polygonal ferrite transformation that occurs in the middle of cooling of first annealing or second annealing. In the case where a hot-dip galvanizing treatment is performed, the polygonal ferrite transformation that occurs in the middle of cooling of this treatment is also suppressed. Thus, Cr may be contained. In order to obtain this effect sufficiently, the Cr content is preferably set to 0.01% or more and more preferably set to 0.02% or more. On the other hand, when the Cr content is greater than 2.0%, the manufacturability of hot rolling decreases. Thus, the Cr content is set to 2.0% or less and preferably set to 0.10% or less.

(V: 0.00% to 0.50%)

Vanadium (V) contributes to the improvement in strength of steel through dislocation strengthening caused by precipitation strengthening and fine grain strengthening. Thus, V may be contained. In order to obtain this effect sufficiently, the V content is preferably set to 0.01% or more and more preferably set to 0.02% or more. On the other hand, when the V content is greater than 0.50%, carbonitride of V precipitates excessively, leading to a decrease in formability of the steel sheet. Thus, the V content is set to 0.50% or less and preferably set to 0.10% or less.

(Mg: 0.000% to 0.040%, REM: 0.000% to 0.040%, Ca: 0.000% to 0.040%)

Magnesium (Mg), rare earth metal (REM), and calcium (Ca) exist in steel as oxide or sulfide and contribute to the improvement in hole expandability. Thus, Mg, REM, or Ca, or an arbitrary combination of these may be contained. In order to obtain this effect sufficiently, the Mg content, the REM content, and the Ca content are each preferably set to 0.0005% or more, and more preferably set to 0.0010% or more. On the other hand, when the Mg content, the REM content, or the Ca content is greater than 0.040%, coarse oxides are formed, leading to a decrease in hole expandability. Thus, the Mg content, the REM content, and the Ca content are each set to 0.040% or less and preferably set to 0.010% or less.

REM (rare earth metal) refers to 17 elements in total of Sc, Y, and lanthanoids, and the "REM content" means the total content of these 17 elements. REM is contained in misch metal, for example, and misch metal contains lanthanoids in addition to La and Ce in some cases. Metal alone, such as metal La and metal Ce, may be used to add REM.

Examples of the impurities include ones contained in raw materials such as ore and scrap and ones contained in manufacturing steps. Concrete examples of the impurities include P, S, O, Sb, Sn, W, Co, As, Pb, Bi, and H. The O content is preferably set to 0.010% or less, the Sb content, the Sn content, the W content, the Co content, and the As content are preferably set to 0.1% or less, the Pb content and the Bi content are preferably set to 0.005% or less, and the H content is preferably set to 0.0005% or less.

According to this embodiment, it is possible to obtain excellent collision safety and formability. It is possible to obtain mechanical properties in which the hole expandability is 30% or more, the ratio of a minimum bend radius (R (mm)) to a sheet thickness (t (mm)) (R/t) is 0.5 or less, the total elongation is 21% or more, the 0.2% proof stress is 680 MPa or more, the tensile strength is 980 MPa or more, and the ductile-brittle transition temperature is −60° C. or less, for example. In the case where the area fraction of the polygonal ferrite is 5% to 20% and the area fraction of the bainitic ferrite is 75% or more, in particular, the hole expandability of 50% or more can be obtained, and in the case where the area fraction of the polygonal ferrite is greater than 20% and 40% or less, the total elongation of 26% or more can be obtained.

Next, there will be explained a manufacturing method of the steel sheet according to the embodiment of the present invention. In the manufacturing method of the steel sheet according to the embodiment of the present invention, hot rolling, pickling, cold rolling, first annealing, and second annealing of a slab having the above-described chemical composition are performed in this order.

(Hot Rolling)

In the hot rolling, rough rolling, finish rolling, and coiling of the slab are performed. As the slab, for example, a slab obtained by continuous casting or a slab fabricated by a thin slab caster can be used. The slab may be provided into a hot rolling facility while maintaining the slab to a temperature of 1000° C. or more after casting, or may also be provided into a hot rolling facility after the slab is cooled down to a temperature of less than 1000° C. and then is heated.

A rolling temperature in the final pass of the rough rolling is set to 1000° C. to 1150° C., and a reduction ratio in the final pass is set to 40% or more. When the rolling temperature in the final pass is less than 1000° C., an austenite grain diameter after finish rolling becomes small excessively. In this case, the transformation from austenite into polygonal ferrite is promoted excessively and the uniformity of the metal structure decreases, failing to obtain sufficient formability. Thus, the rolling temperature in the final pass is set to 1000° C. or more. On the other hand, when the rolling temperature in the final pass is greater than 1150° C., the austenite grain diameter after finish rolling becomes large excessively. In this case as well, the uniformity of the metal structure decreases, failing to obtain sufficient formability. Thus, the rolling temperature in the final pass is set to 1150° C. or less. When the reduction ratio in the final pass is less than 40%, the austenite grain diameter after finish rolling becomes large excessively and the uniformity of the metal structure decreases, failing to obtain sufficient formability. Thus, the reduction ratio in the final pass is set to 40% or more.

The rolling temperature of the finish rolling is set to the $Ar_3$ point or more. When the rolling temperature is less than the $Ar_3$ point, austenite and ferrite are contained in the metal structure of a hot-rolled steel sheet, failing to obtain sufficient formability because there are differences in the mechanical properties between the austenite and the ferrite. Thus, the rolling temperature is set to the $Ar_3$ point or more. When the rolling temperature is set to the $Ar_3$ point or more, it is possible to relatively reduce a rolling load during the finish rolling. In the finish rolling, the product formed by joining a plurality of rough-rolled sheets obtained by the rough rolling may be rolled continuously. Once the rough-rolled sheet is coiled, the finish rolling may be performed while uncoiling the rough-rolled sheet.

A coiling temperature is set to 750° C. or less. When the coiling temperature is greater than 750° C., coarse ferrite or pearlite is generated in the structure of the hot-rolled steel sheet and the uniformity of the metal structure decreases, failing to obtain sufficient formability. Oxides are formed on the surface thickly, leading to a decrease in picklability in some cases. Thus, the coiling temperature is set to 750° C. or less. The lower limit of the coiling temperature is not limited in particular, but coiling at a temperature lower than room temperature is difficult. By hot rolling of the slab, a hot-rolled steel sheet coil is obtained.

(Pickling)

After the hot rolling, pickling is performed while uncoiling the hot-rolled steel sheet coil. The pickling is performed once or twice or more. By the pickling, the oxide on the surface of the hot-rolled steel sheet is removed and chemical conversion treatability and platability improve.

(Cold Rolling)

After the pickling, cold rolling is performed. A reduction ratio of the cold rolling is set to 40% to 80%. When the reduction ratio of the cold rolling is less than 40%, it is difficult to keep the shape of a cold-rolled steel sheet flat or it is impossible to obtain sufficient ductility in some cases. Thus, the reduction ratio is set to 40% or more and preferably set to 50% or more. On the other hand, when the reduction ratio is greater than 80%, a rolling load becomes large excessively, recrystallization of ferrite is promoted excessively, coarse polygonal ferrite is formed, and the area fraction of the polygonal ferrite exceeds 40%. Thus, the reduction ratio is set to 80% or less and preferably set to 70% or less. The number of times of rolling pass and the reduction ratio for each pass are not limited in particular. The cold-rolled steel sheet is obtained by cold rolling of the hot-rolled steel sheet.

(First Annealing)

After the cold rolling, first annealing is performed. In the first annealing, of the cold-rolled steel sheet, first heating, first cooling, second cooling, and first retention are performed. The first annealing can be performed in a continuous annealing line, for example.

An annealing temperature of the first annealing is set to 750° C. to 900° C. When the annealing temperature is less than 750° C., the area fraction of the polygonal ferrite becomes large excessively and the area fraction of the bainitic ferrite becomes small excessively. Thus, the annealing temperature is set to 750° C. or more and preferably set to 780° C. or more. On the other hand, when the annealing temperature is greater than 900° C., austenite grains become coarse and the transformation from austenite into bainitic ferrite or tempered martensite is delayed. Then, due to the transformation delay, the area fraction of the bainitic ferrite becomes small excessively. Thus, the annealing temperature is set to 900° C. or less and preferably set to 870° C. or less. An annealing time is not limited in particular, and is set to 1 second or more and 1000 seconds or less, for example.

A cooling stop temperature of the first cooling is set to 600° C. to 720° C., and a cooling rate up to the cooling stop temperature is set to 1° C./second or more and less than 10° C./second. When the cooling stop temperature of the first cooling is less than 600° C., the area fraction of the polygonal ferrite becomes large excessively. Thus, the cooling stop temperature is set to 600° C. or more and preferably set to 620° C. or more. On the other hand, when the cooling stop temperature is greater than 720° C., the area fraction of the retained austenite becomes short. Thus, the cooling stop temperature is set to 720° C. or less and preferably set to 700° C. or less. When the cooling rate of the first cooling is less than 1.0° C./second, the area fraction of the polygonal ferrite becomes large excessively. Thus, the cooling rate is set to 1.0° C./second or more and preferably set to 3° C./second or more. On the other hand, when the cooling rate is 10° C./second or more, the area fraction of the retained austenite becomes short. Thus, the cooling rate is set to less than 10° C./second and preferably set to 8° C./second or less.

A cooling stop temperature of the second cooling is set to 150° C. to 500° C., and a cooling rate up to the cooling stop temperature is set to 10° C./second to 60° C./second. When the cooling stop temperature of the second cooling is less than 150° C., the lath width of the bainitic ferrite or the tempered martensite becomes fine and the retained austenite remaining between laths becomes a fine film. As a result, the area fraction of the retained austenite grains in a predetermined form becomes small excessively. Thus, the cooling stop temperature is set to 150° C. or more and preferably set to 200° C. or more. On the other hand, when the cooling stop temperature is greater than 500° C., the generation of polygonal ferrite is promoted and the area fraction of the polygonal ferrite becomes large excessively. Thus, the cooling stop temperature is set to 500° C. or less, preferably set to 450° C. or less, and more preferably set to about room temperature. Further, the cooling stop temperature is preferably set to the Ms point or less according to the composition. When the cooling rate of the second cooling is less than 10° C./s, the generation of polygonal ferrite is promoted and the area fraction of the polygonal ferrite becomes large excessively. Thus, the cooling rate is set to 10° C./second or more and preferably set to 20° C./second or more. On the other hand, when the cooling rate is greater than 60° C./second, the area fraction of the retained austenite becomes less than the lower limit. Thus, the cooling rate is set to 60° C./second or less and preferably set to 50° C./second or less.

The method of the first cooling and the second cooling is not limited, and for example, roll cooling, air cooling or water cooling, or an arbitrary combination of these can be used.

After the second cooling, the cold-rolled steel sheet is retained at a temperature of 150° C. to 500° C. only for a time period of t1 seconds to 1000 seconds determined by the following equation (1). This retention (first retention) is performed directly after the second cooling without lowering the temperature to less than 150° C., for example. In the equation (1), T0 denotes the retention temperature and T1 denotes the cooling stop temperature (° C.) of the second cooling.

$$t1=20\times[C]+40\times[Mn]-0.1\times T0+T1-0.1 \quad (1)$$

During the first retention, diffusion of C into the retained austenite is promoted. As a result, the stability of the retained austenite improves, thereby making it possible to secure the retained austenite by 5% or more of the area fraction. When the retention time is less than t1 seconds, C does not concentrate sufficiently in the retained austenite and the retained austenite is transformed into martensite during the subsequent temperature lowering, resulting in that the area fraction of the retained austenite becomes small excessively. Thus, the retention time is set to t1 seconds or more. When the retention time is greater than 1000 seconds, decomposition of the retained austenite is promoted and the area fraction of the retained austenite becomes small excessively. Thus, the retention time is set to 1000 seconds or less. An intermediate steel sheet is obtained by first annealing of the cold-rolled steel sheet.

The first retention may be performed by lowering the temperature to less than 150° C. and then reheating the steel sheet up to a temperature of 150° C. to 500° C., for example. When a reheating temperature is less than 150° C., the lath width of the bainitic ferrite or the tempered martensite becomes fine and the retained austenite remaining between laths becomes a fine film. As a result, the area fraction of the retained austenite grains in a predetermined form becomes small excessively. Thus, the reheating temperature is set to 150° C. or more and preferably set to 200° C. or more. On the other hand, when the reheating temperature is greater than 500° C., the generation of polygonal ferrite is promoted and the area fraction of the polygonal ferrite becomes large excessively. Thus, the reheating temperature is set to 500° C. or less and preferably set to 450° C. or less.

The intermediate steel sheet has a metal structure represented by, for example, in area fraction, polygonal ferrite: 40% or less, bainitic ferrite or tempered martensite, or both: 40% to 95% in total, and retained austenite: 5% to 60%. Further, for example, in area fraction, 80% or more of the retained austenite is composed of retained austenite grains with an aspect ratio of 0.03 to 1.00.

(Second Annealing)

After the first annealing, second annealing is performed. In the second annealing, of the intermediate steel sheet, second heating, third cooling, and second retention are performed. The second annealing can be performed in a continuous annealing line, for example. The second annealing is performed under the following conditions, and thereby, it is possible to reduce the dislocation density of the bainitic ferrite and to increase the area fraction of the bainitic ferrite grains in a predetermined form with a dislocation density of $8\times10^2$ (cm/cm$^3$) or less.

An annealing temperature of the second annealing is set to 760° C. to 800° C. When the annealing temperature is less than 760° C., the area fraction of the polygonal ferrite becomes large excessively and the area fraction of the bainitic ferrite grains, the area fraction of the retained austenite, or the area fractions of the both become small excessively. Thus, the annealing temperature is set to 760° C. or more and preferably set to 770° C. or more. On the other hand, when the annealing temperature is greater than 800° C., with the austenite transformation, the area fraction of the austenite becomes large and the area fraction of the bainitic ferrite becomes small excessively. Thus, the annealing temperature is set to 800° C. or less and preferably set to 790° C. or less.

A cooling stop temperature of the third cooling is set to 600° C. to 750° C., and a cooling rate up to the cooling stop temperature is set to 1° C./second to 10° C./second. When the cooling stop temperature is less than 600° C., the area fraction of the polygonal ferrite becomes large excessively. Thus, the cooling stop temperature is set to 600° C. or more and preferably set to 630° C. or more. On the other hand, when the cooling stop temperature is greater than 750° C., the area fraction of the martensite becomes large excessively. Thus, the cooling stop temperature is set to 750° C. or less and preferably set to 730° C. or less. When the cooling rate of the third cooling is less than 1.0° C./second, the area fraction of the polygonal ferrite becomes large excessively. Thus, the cooling rate is set to 1.0° C./second or more and preferably set to 3° C./second or more. On the other hand, when the cooling rate is greater than 10° C./second, the area fraction of the bainitic ferrite becomes small excessively. Thus, the cooling rate is set to 10° C./second or less and preferably set to 8° C./second or less.

When the hole expandability is more important than the ductility, the cooling stop temperature is preferably set to 710° C. or more and more preferably set to 720° C. or more. This is because it is easy to bring the area fraction of the polygonal ferrite to 20% or less. When the ductility is more important than the hole expandability, the cooling stop temperature is preferably set to less than 710° C. and more preferably set to 690° C. or less. This is because it is easy to bring the area fraction of the polygonal ferrite to greater than 20% and 40% or less.

After the third cooling, the steel sheet is cooled down to a temperature of 150° C. to 550° C. and is retained at the temperature for one second or more. During this retention (the second retention), the diffusion of C into the retained austenite is promoted. When the retention time is less than one second, C does not concentrate in the retained austenite sufficiently, the stability of the retained austenite decreases, and the area fraction of the retained austenite becomes small excessively. Thus, the retention time is set to one second or more and preferably set to two seconds or more. When the retention temperature is less than 150° C., C does not concentrate in the retained austenite sufficiently, the stability of the retained austenite decreases, and the area fraction of the retained austenite becomes small excessively. Thus, the retention temperature is set to 150° C. or more and preferably set to 200° C. or more. On the other hand, when the retention temperature is greater than 550° C., the transformation from austenite into bainitic ferrite is delayed, and thus, the diffusion of C into retained austenite is not promoted, the stability of the retained austenite decreases, and the area fraction of the retained austenite becomes small excessively. Thus, the retention temperature is set to 550° C. or less and preferably set to 500° C. or less.

In this manner, the steel sheet according to the embodiment of the present invention can be manufactured.

In the embodiment of the present invention described above, a part of the austenite is transformed into ferrite by controlling the primary cooling rate of the first annealing to 1° C./s or more and less than 10° C./s. With the generation of ferrite, Mn is diffused into untransformed austenite to concentrate therein. By the concentration of Mn in the austenite, during the second retention of the second annealing, a yield stress of the austenite increases and a crystal orientation advantageous for mitigating a transformation stress to occur with the transformation into bainitic ferrite is preferentially generated. Therefore, the strain introduced into the bainitic ferrite is reduced, thereby making it possible to control the dislocation density to $8\times10^2$ (cm/cm$^3$) or less. Controlling the dislocation density of the bainitic ferrite to $8\times10^2$ (cm/cm$^3$) or less makes it possible to increase working efficacy at the time of plastic deformation, and thus, it is possible to obtain excellent ductility. The mechanism, in which by reducing the dislocation density of the bainitic ferrite, the ductility improves, is as follows. When martensite is generated from retained austenite by strain-induced transformation, dislocation is introduced into adjacent bainitic ferrite to work-harden a TRIP steel. When the dislocation density of the bainitic ferrite is low, a work hardening rate can be maintained high even in a region with large strain, and thus uniform elongation improves.

On the steel sheet, a plating treatment such as an electroplating treatment or a deposition plating treatment may be performed, and further an alloying treatment may be performed after the plating treatment. On the steel sheet, surface treatments such as organic coating film forming, film laminating, organic salts/inorganic salts treatment, and non-chromium treatment may be performed.

When a hot-dip galvanizing treatment is performed on the steel sheet as the plating treatment, for example, the steel sheet is heated or cooled to a temperature that is equal to or more than a temperature 40° C. lower than the temperature of a galvanizing bath and is equal to or less than a temperature 50° C. higher than the temperature of the galvanizing bath and is passed through the galvanizing bath. By the hot-dip galvanizing treatment, a steel sheet having a hot-dip galvanizing layer provided on the surface, namely a hot-dip galvanized steel sheet is obtained. The hot-dip galvanizing layer has a chemical composition represented by, for example, Fe: 7 mass % or more and 15 mass % or less and the balance: Zn, Al, and impurities.

When an alloying treatment is performed after the hot-dip galvanizing treatment, for example, the hot-dip galvanized steel sheet is heated to a temperature that is 460° C. or more and 600° C. or less. When the temperature is less than 460° C., alloying sometimes becomes short in some cases. When the temperature is greater than 600° C., alloying becomes excessive and corrosion resistance deteriorates in some cases. By the alloying treatment, a steel sheet having an alloyed hot-dip galvanizing layer provided on the surface, namely, an alloyed hot-dip galvanized steel sheet is obtained.

It should be noted that the above-described embodiment merely illustrates a concrete example of implementing the present invention, and the technical scope of the present invention is not to be construed in a restrictive manner by the embodiment. That is, the present invention may be implemented in various forms without departing from the technical spirit or main features thereof.

Example

Next, there will be explained examples of the present invention.

Conditions of the examples are condition examples employed for confirming the applicability and effects of the present invention, and the present invention is not limited to these condition examples. The present invention can employ various conditions as long as the object of the present invention is achieved without departing from the spirit of the invention.

(First Test)

In a first test, slabs having chemical compositions illustrated in Table 1 to Table 3 were manufactured. Each space in Table 1 to Table 3 indicates that the content of a corresponding element is less than a detection limit, and the balance is Fe and impurities. Each underline in Table 1 to Table 3 indicates that a corresponding numerical value is out of the range of the present invention.

TABLE 1

| STEEL | CHEMICAL COMPOSITION (MASS %) | | | | | | | | | | | | | | | | | |
|---|---|---|---|---|---|---|---|---|---|---|---|---|---|---|---|---|---|---|
| No. | C | Si | Mn | P | S | N | Al | Si + Al | Ti | Nb | B | Mo | Cr | V | Mg | REM | Ca | Ar3 |
| 1 | 0.195 | 1.8 | 2.6 | 0.009 | 0.003 | 0.003 | 0.035 | 1.8 | | | | | | | | | | 820 |
| 2 | 0.064 | 1.8 | 2.6 | 0.009 | 0.003 | 0.003 | 0.035 | 1.8 | | | | | | | | | | 820 |
| 3 | 0.145 | 1.8 | 2.6 | 0.009 | 0.003 | 0.003 | 0.035 | 1.8 | | | | | | | | | | 820 |
| 4 | 0.191 | 1.8 | 2.6 | 0.009 | 0.003 | 0.003 | 0.035 | 1.8 | | | | | | | | | | 820 |
| 5 | 0.270 | 1.8 | 2.6 | 0.009 | 0.003 | 0.003 | 0.035 | 1.8 | | | | | | | | | | 820 |
| 6 | 0.651 | 1.8 | 2.6 | 0.009 | 0.003 | 0.003 | 0.035 | 1.8 | | | | | | | | | | 820 |
| 7 | 0.195 | 0.4 | 2.6 | 0.009 | 0.003 | 0.003 | 0.035 | 0.4 | | | | | | | | | | 810 |
| 8 | 0.195 | 0.9 | 2.6 | 0.009 | 0.003 | 0.003 | 0.035 | 0.9 | | | | | | | | | | 820 |
| 9 | 0.199 | 1.8 | 2.6 | 0.009 | 0.003 | 0.003 | 0.035 | 1.8 | | | | | | | | | | 820 |
| 10 | 0.195 | 2.3 | 2.6 | 0.009 | 0.003 | 0.003 | 0.035 | 2.3 | | | | | | | | | | 820 |
| 11 | 0.195 | 4.9 | 2.6 | 0.009 | 0.003 | 0.003 | 0.035 | 4.9 | | | | | | | | | | 830 |
| 12 | 0.195 | 1.8 | 0.3 | 0.009 | 0.003 | 0.003 | 0.035 | 1.8 | | | | | | | | | | 920 |
| 13 | 0.195 | 1.8 | 1.5 | 0.009 | 0.003 | 0.003 | 0.035 | 1.8 | | | | | | | | | | 880 |
| 14 | 0.195 | 1.7 | 2.6 | 0.009 | 0.003 | 0.003 | 0.035 | 1.8 | | | | | | | | | | 820 |
| 15 | 0.195 | 1.8 | 3.3 | 0.009 | 0.003 | 0.003 | 0.035 | 1.8 | | | | | | | | | | 810 |
| 16 | 0.195 | 1.8 | 4.8 | 0.009 | 0.003 | 0.003 | 0.035 | 1.8 | | | | | | | | | | 800 |
| 17 | 0.195 | 1.9 | 2.6 | 0.009 | 0.003 | 0.003 | 0.035 | 1.8 | | | | | | | | | | 820 |
| 18 | 0.195 | 1.8 | 2.6 | 0.034 | 0.003 | 0.003 | 0.035 | 1.8 | | | | | | | | | | 820 |
| 19 | 0.191 | 1.7 | 2.6 | 0.009 | 0.003 | 0.003 | 0.035 | 1.8 | | | | | | | | | | 820 |
| 20 | 0.195 | 1.8 | 2.6 | 0.009 | 0.010 | 0.003 | 0.035 | 1.8 | | | | | | | | | | 820 |
| 21 | 0.195 | 1.8 | 2.6 | 0.009 | 0.120 | 0.003 | 0.035 | 1.8 | | | | | | | | | | 820 |
| 22 | 0.199 | 1.9 | 2.6 | 0.009 | 0.003 | 0.003 | 0.035 | 1.8 | | | | | | | | | | 820 |
| 23 | 0.195 | 1.8 | 2.6 | 0.009 | 0.003 | 0.020 | 0.035 | 1.8 | | | | | | | | | | 820 |
| 24 | 0.191 | 1.9 | 2.6 | 0.009 | 0.003 | 0.003 | 0.035 | 1.8 | | | | | | | | | | 820 |
| 25 | 0.195 | 1.8 | 2.6 | 0.009 | 0.003 | 0.003 | 1.400 | 3.2 | | | | | | | | | | 820 |
| 26 | 0.195 | 1.8 | 2.6 | 0.009 | 0.003 | 0.003 | 2.500 | 4.3 | | | | | | | | | | 820 |
| 27 | 0.199 | 1.7 | 2.6 | 0.009 | 0.003 | 0.003 | 0.035 | 1.8 | | | | | | | | | | 820 |
| 28 | 0.195 | 1.8 | 2.5 | 0.009 | 0.003 | 0.003 | 0.035 | 1.8 | | | | | | | | | | 820 |
| 29 | 0.195 | 1.8 | 2.7 | 0.009 | 0.003 | 0.003 | 0.035 | 1.8 | | | | | | | | | | 820 |
| 30 | 0.195 | 1.8 | 2.6 | 0.009 | 0.003 | 0.003 | 0.035 | 1.8 | 0.015 | | | | | | | | | 820 |

TABLE 2

| STEEL | CHEMICAL COMPOSITION (MASS %) | | | | | | | | | | | | | | | | | |
|---|---|---|---|---|---|---|---|---|---|---|---|---|---|---|---|---|---|---|
| No. | C | Si | Mn | P | S | N | Al | Si + Al | Ti | Nb | B | Mo | Cr | V | Mg | REM | Ca | Ar3 |
| 31 | 0.195 | 1.8 | 2.6 | 0.009 | 0.003 | 0.003 | 0.035 | 1.8 | 0.025 | | | | | | | | | 820 |
| 32 | 0.195 | 1.8 | 2.6 | 0.009 | 0.003 | 0.003 | 0.035 | 1.8 | 0.090 | | | | | | | | | 820 |
| 33 | 0.195 | 1.8 | 2.6 | 0.009 | 0.003 | 0.003 | 0.035 | 1.8 | 0.250 | | | | | | | | | 820 |
| 34 | 0.195 | 1.8 | 2.6 | 0.009 | 0.003 | 0.003 | 0.035 | 1.8 | | 0.008 | | | | | | | | 820 |
| 35 | 0.195 | 1.8 | 2.6 | 0.009 | 0.003 | 0.003 | 0.035 | 1.8 | | 0.018 | | | | | | | | 820 |
| 36 | 0.195 | 1.8 | 2.6 | 0.009 | 0.003 | 0.003 | 0.035 | 1.8 | | 0.095 | | | | | | | | 820 |
| 37 | 0.195 | 1.8 | 2.6 | 0.009 | 0.003 | 0.003 | 0.035 | 1.8 | | 0.230 | | | | | | | | 820 |
| 38 | 0.195 | 1.8 | 2.6 | 0.009 | 0.003 | 0.003 | 0.035 | 1.8 | | | 0.0008 | | | | | | | 820 |
| 39 | 0.195 | 1.8 | 2.6 | 0.009 | 0.003 | 0.003 | 0 035 | 1.8 | | | 0.0017 | | | | | | | 820 |
| 40 | 0.195 | 1.8 | 2.6 | 0.009 | 0.003 | 0.003 | 0.035 | 1.8 | | | 0.0028 | | | | | | | 820 |
| 41 | 0.195 | 1.8 | 2.6 | 0.009 | 0.003 | 0.003 | 0.035 | 1.8 | | | 0.0100 | | | | | | | 820 |

TABLE 2-continued

| STEEL | CHEMICAL COMPOSITION (MASS %) | | | | | | | | | | | | | | | | | |
|---|---|---|---|---|---|---|---|---|---|---|---|---|---|---|---|---|---|---|
| No. | C | Si | Mn | P | S | N | Al | Si + Al | Ti | Nb | B | Mo | Cr | V | Mg | REM | Ca | Ar3 |
| 42 | 0.195 | 1.8 | 2.6 | 0.009 | 0.003 | 0.003 | 0.035 | 1.8 | | | | 0.012 | | | | | | 820 |
| 43 | 0.195 | 1.8 | 2.6 | 0.009 | 0.003 | 0.003 | 0.035 | 1.8 | | | | 0.035 | | | | | | 820 |
| 44 | 0.195 | 1.8 | 2.6 | 0.009 | 0.003 | 0.003 | 0.035 | 1.8 | | | | 0.100 | | | | | | 820 |
| 45 | 0.195 | 1.8 | 2.6 | 0.009 | 0.003 | 0.003 | 0.035 | 1.8 | | | | 0.650 | | | | | | 820 |
| 46 | 0.195 | 1.8 | 2.6 | 0.009 | 0.003 | 0.003 | 0.035 | 1.8 | | | | | 0.014 | | | | | 820 |
| 47 | 0.195 | 1.8 | 2.6 | 0.009 | 0.003 | 0.003 | 0.035 | 1.8 | | | | | 0.025 | | | | | 820 |
| 48 | 0.195 | 1.8 | 2.6 | 0.009 | 0.003 | 0.003 | 0.035 | 1.8 | | | | | 0.065 | | | | | 820 |
| 49 | 0.195 | 1.8 | 2.6 | 0.009 | 0.003 | 0.003 | 0.035 | 1.8 | | | | | 2.800 | | | | | 820 |
| 50 | 0.195 | 1.8 | 2.6 | 0.009 | 0.003 | 0.003 | 0.035 | 1.8 | | | | | | 0.015 | | | | 820 |
| 51 | 0.195 | 1.8 | 2.6 | 0.009 | 0.003 | 0.003 | 0.035 | 1.8 | | | | | | 0.025 | | | | 820 |
| 52 | 0.195 | 1.8 | 2.6 | 0.009 | 0.003 | 0.003 | 0.035 | 1.8 | | | | | | 0.150 | | | | 820 |
| 53 | 0.195 | 1.8 | 2.6 | 0.009 | 0.003 | 0.003 | 0.035 | 1.8 | | | | | | 0.770 | | | | 820 |
| 54 | 0.195 | 1.8 | 2.6 | 0.009 | 0.003 | 0.003 | 0.035 | 1.8 | | | | | | | 0.0008 | | | 820 |
| 55 | 0.195 | 1.8 | 2.6 | 0.009 | 0.003 | 0.003 | 0.035 | 1.8 | | | | | | | 0.0015 | | | 820 |
| 56 | 0.195 | 1.8 | 2.6 | 0.009 | 0.003 | 0.003 | 0.035 | 1.8 | | | | | | | 0.0210 | | | 820 |
| 57 | 0.195 | 1.8 | 2.6 | 0.009 | 0.003 | 0.003 | 0.035 | 1.8 | | | | | | | 0.0500 | | | 820 |
| 58 | 0.195 | 1.8 | 2.6 | 0.009 | 0.003 | 0.003 | 0.035 | 1.8 | | | | | | | | 0.0007 | | 820 |
| 59 | 0.195 | 1.8 | 2.6 | 0.009 | 0.003 | 0.003 | 0.035 | 1.8 | | | | | | | | 0.0017 | | 820 |
| 60 | 0.195 | 1.8 | 2.6 | 0.009 | 0.003 | 0.003 | 0.035 | 1.8 | | | | | | | | 0.0210 | | 820 |

TABLE 3

| STEEL | CHEMICAL COMPOSITION (MASS %) | | | | | | | | | | | | | | | | | |
|---|---|---|---|---|---|---|---|---|---|---|---|---|---|---|---|---|---|---|
| No. | C | Si | Mn | P | S | N | Al | Si + Al | Ti | Nb | B | Mo | Cr | V | Mg | REM | Ca | Ar3 |
| 61 | 0.195 | 1.8 | 2.6 | 0.009 | 0.003 | 0.003 | 0.035 | 1.8 | | | | | | | | 0.0450 | | 820 |
| 62 | 0.195 | 1.8 | 2.6 | 0.009 | 0.003 | 0.003 | 0.035 | 1.8 | | | | | | | | | 0.0006 | 820 |
| 63 | 0.195 | 1.8 | 2.6 | 0.009 | 0.003 | 0.003 | 0.035 | 1.8 | | | | | | | | | 0.0018 | 820 |
| 64 | 0.195 | 1.8 | 2.6 | 0.009 | 0.003 | 0.003 | 0.035 | 1.8 | | | | | | | | | 0.0220 | 820 |
| 65 | 0.195 | 1.8 | 2.6 | 0.009 | 0.003 | 0.003 | 0.035 | 1.8 | | | | | | | | | 0.0470 | 820 |
| 66 | 0.191 | 1.8 | 2.7 | 0.009 | 0.003 | 0.003 | 0.035 | 1.8 | | | | | | | | | | 820 |
| 67 | 0.121 | 1.8 | 2.6 | 0.009 | 0.003 | 0.003 | 0.035 | 1.8 | | | | | | | | | | 820 |
| 68 | 0.153 | 1.8 | 2.6 | 0.009 | 0.003 | 0.003 | 0.035 | 1.8 | | | | | | | | | | 820 |
| 69 | 0.172 | 1.8 | 2.6 | 0.009 | 0.003 | 0.003 | 0.035 | 1.8 | | | | | | | | | | 820 |
| 70 | 0.219 | 1.8 | 2.6 | 0.009 | 0.003 | 0.003 | 0.035 | 1.8 | | | | | | | | | | 820 |
| 71 | 0.254 | 1.8 | 2.6 | 0.009 | 0.003 | 0.003 | 0.035 | 1.8 | | | | | | | | | | 820 |
| 72 | 0.313 | 1.8 | 2.6 | 0.009 | 0.003 | 0.003 | 0.035 | 1.8 | | | | | | | | | | 820 |
| 73 | 0.404 | 1.8 | 2.6 | 0.009 | 0.003 | 0.003 | 0.035 | 1.8 | | | | | | | | | | 820 |
| 74 | 0.195 | 0.7 | 2.6 | 0.009 | 0.003 | 0.003 | 0.035 | 0.7 | | | | | | | | | | 820 |
| 75 | 0.195 | 1.2 | 2.6 | 0.009 | 0.003 | 0.003 | 0.035 | 1.2 | | | | | | | | | | 820 |
| 76 | 0.195 | 1.5 | 2.6 | 0.009 | 0.003 | 0.003 | 0.035 | 1.5 | | | | | | | | | | 820 |
| 77 | 0.195 | 2.1 | 2.6 | 0.009 | 0.003 | 0.003 | 0.035 | 2.1 | | | | | | | | | | 820 |
| 78 | 0.195 | 2.8 | 2.6 | 0.009 | 0.003 | 0.003 | 0.035 | 2.8 | | | | | | | | | | 820 |
| 79 | 0.195 | 3.4 | 2.6 | 0.009 | 0.003 | 0.003 | 0.035 | 3.4 | | | | | | | | | | 820 |
| 80 | 0.195 | 1.8 | 1.2 | 0.009 | 0.003 | 0.003 | 0.035 | 1.8 | | | | | | | | | | 820 |
| 81 | 0.195 | 1.8 | 1.5 | 0.009 | 0.003 | 0.003 | 0.035 | 1.8 | | | | | | | | | | 820 |
| 82 | 0.195 | 1.8 | 1.8 | 0.009 | 0.003 | 0.003 | 0.035 | 1.8 | | | | | | | | | | 820 |
| 83 | 0.195 | 1.8 | 2.9 | 0.009 | 0.003 | 0.003 | 0.035 | 1.8 | | | | | | | | | | 820 |
| 84 | 0.195 | 1.8 | 3.2 | 0.009 | 0.003 | 0.003 | 0.035 | 1.8 | | | | | | | | | | 820 |
| 85 | 0.195 | 1.8 | 3.7 | 0.009 | 0.003 | 0.003 | 0.035 | 1.8 | | | | | | | | | | 820 |
| 86 | 0.193 | 1.8 | 2.7 | 0.009 | 0.003 | 0.003 | 0.035 | 1.8 | | | | | | | | | | 820 |
| 87 | 0.192 | 1.8 | 2.7 | 0.009 | 0.003 | 0.003 | 0.035 | 1.8 | | | | | | | | | | 820 |

Then, once cooled, or without cooling, the slabs were directly heated to 1100° C. to 1300° C. and hot rolled under the conditions illustrated in Table 4 to Table 7 to obtain hot-rolled steel sheets. Thereafter, pickling was performed and cold rolling was performed under the conditions illustrated in Table 4 to Table 7 to obtain cold-rolled steel sheets. Each underline in Table 4 to Table 7 indicates that a corresponding numerical value is out of the range suitable for manufacturing the steel sheet according to the present invention.

TABLE 4

| | | HOT ROLLING | | | | | |
|---|---|---|---|---|---|---|---|
| | | ROUGH ROLLING | | | FINISH ROLLING | | |
| MANUFACTURE No. | STEEL No. | NUMBER OF TIMES | TEMPERATURE OF FINAL PASS (° C.) | REDUCTION RATIO OF FINAL PASS (%) | FINISHING TEMPERATURE (° C.) | Ar3 (° C.) | COILING TEMPERATURE (° C.) |
| 1 | 1 | 5 | 1080 | 52 | 920 | 820 | 650 |
| 2 | 1 | 0 | NONE | NONE | 920 | 820 | 650 |
| 3 | 1 | 5 | 780 | 52 | 920 | 820 | 650 |
| 4 | 1 | 5 | 1080 | 52 | 920 | 820 | 650 |
| 5 | 1 | 5 | 1260 | 52 | 920 | 820 | 650 |
| 6 | 1 | 5 | 1080 | 14 | 920 | 820 | 650 |
| 7 | 1 | 5 | 1080 | 52 | 920 | 820 | 650 |
| 8 | 1 | 5 | 1080 | 52 | 670 | 820 | 650 |
| 9 | 1 | 5 | 1080 | 52 | 920 | 820 | 650 |
| 10 | 1 | 5 | 1080 | 52 | 920 | 820 | 550 |
| 11 | 1 | 5 | 1080 | 52 | 920 | 820 | 650 |
| 12 | 1 | 5 | 1080 | 52 | 920 | 820 | 790 |
| 13 | 1 | 5 | 1080 | 52 | 920 | 820 | 650 |
| 14 | 1 | 5 | 1080 | 52 | 920 | 820 | 650 |
| 15 | 1 | 5 | 1080 | 52 | 920 | 820 | 650 |
| 16 | 1 | 5 | 1080 | 52 | 920 | 820 | 650 |
| 17 | 1 | 5 | 1080 | 52 | 920 | 820 | 650 |
| 18 | 1 | 5 | 1080 | 52 | 920 | 820 | 650 |
| 19 | 1 | 5 | 1080 | 52 | 920 | 820 | 650 |
| 20 | 1 | 5 | 1080 | 52 | 920 | 820 | 650 |
| 21 | 1 | 5 | 1080 | 52 | 920 | 820 | 650 |
| 22 | 1 | 5 | 1080 | 52 | 920 | 820 | 650 |
| 23 | 1 | 5 | 1080 | 52 | 920 | 820 | 650 |
| 24 | 1 | 5 | 1080 | 52 | 920 | 820 | 650 |
| 25 | 1 | 5 | 1080 | 52 | 920 | 820 | 650 |
| 26 | 1 | 5 | 1080 | 52 | 920 | 820 | 650 |
| 27 | 1 | 5 | 1080 | 52 | 920 | 820 | 650 |
| 28 | 1 | 5 | 1080 | 52 | 920 | 820 | 650 |
| 29 | 1 | 5 | 1080 | 52 | 920 | 820 | 650 |
| 30 | 1 | 5 | 1080 | 52 | 920 | 820 | 650 |
| 31 | 1 | 5 | 1080 | 52 | 920 | 820 | 650 |
| 32 | 1 | 5 | 1080 | 52 | 920 | 820 | 650 |
| 33 | 1 | 5 | 1080 | 52 | 920 | 820 | 650 |
| 34 | 1 | 5 | 1080 | 52 | 920 | 820 | 650 |
| 35 | 1 | 5 | 1080 | 52 | 920 | 820 | 650 |
| 36 | 1 | 5 | 1080 | 52 | 920 | 820 | 650 |
| 37 | 1 | 5 | 1080 | 52 | 920 | 820 | 650 |
| 38 | 1 | 5 | 1080 | 52 | 920 | 820 | 650 |
| 39 | 1 | 5 | 1080 | 52 | 920 | 820 | 650 |
| 40 | 1 | 5 | 1080 | 52 | 920 | 820 | 650 |

| | HOT ROLLING | COLD ROLLING | | |
|---|---|---|---|---|
| MANUFACTURE No. | THICKNESS OF HOT-ROLLED SHEET (mm) | REDUCTION RATIO (%) | THICKNESS OF COLD-ROLLED SHEET (mm) | NOTE |
| 1 | 2.9 | 59 | 1.2 | FOR INVENTION EXAMPLE |
| 2 | 3.4 | 59 | 1.4 | FOR COMPARATIVE EXAMPLE |
| 3 | 2.9 | 59 | 1.2 | FOR COMPARATIVE EXAMPLE |
| 4 | 2.4 | 59 | 1.0 | FOR INVENTION EXAMPLE |
| 5 | 3.4 | 59 | 1.4 | FOR COMPARATIVE EXAMPLE |
| 6 | 2.9 | 59 | 1.2 | FOR COMPARATIVE EXAMPLE |
| 7 | 2.4 | 59 | 1.0 | FOR INVENTION EXAMPLE |
| 8 | 2.4 | 59 | 1.0 | FOR COMPARATIVE EXAMPLE |
| 9 | 3.4 | 59 | 1.4 | FOR INVENTION EXAMPLE |
| 10 | 2.9 | 59 | 1.2 | FOR INVENTION EXAMPLE |
| 11 | 2.9 | 59 | 1.2 | FOR INVENTION EXAMPLE |
| 12 | 2.4 | 59 | 1.0 | FOR COMPARATIVE EXAMPLE |
| 13 | 1.9 | 25 | 1.4 | FOR COMPARATIVE EXAMPLE |
| 14 | 2.1 | 44 | 1.2 | FOR INVENTION EXAMPLE |
| 15 | 3.4 | 59 | 1.4 | FOR INVENTION EXAMPLE |
| 16 | 4.3 | 72 | 1.2 | FOR INVENTION EXAMPLE |
| 17 | 16.7 | 94 | 1.0 | FOR COMPARATIVE EXAMPLE |
| 18 | 3.4 | 59 | 1.4 | FOR COMPARATIVE EXAMPLE |
| 19 | 2.9 | 59 | 1.2 | FOR INVENTION EXAMPLE |
| 20 | 2.4 | 59 | 1.0 | FOR INVENTION EXAMPLE |
| 21 | 2.4 | 59 | 1.0 | FOR INVENTION EXAMPLE |
| 22 | 3.4 | 59 | 1.4 | FOR INVENTION EXAMPLE |
| 23 | 2.9 | 59 | 1.2 | FOR COMPARATIVE EXAMPLE |
| 24 | 2.9 | 59 | 1.2 | FOR COMPARATIVE EXAMPLE |
| 25 | 2.4 | 59 | 1.0 | FOR INVENTION EXAMPLE |

TABLE 4-continued

| | | | | |
|---|---|---|---|---|
| 26 | 3.4 | 59 | 1.4 | FOR COMPARATIVE EXAMPLE |
| 27 | 2.9 | 59 | 1.2 | FOR COMPARATIVE EXAMPLE |
| 28 | 3.4 | 59 | 1.4 | FOR INVENTION EXAMPLE |
| 29 | 2.9 | 59 | 1.2 | FOR COMPARATIVE EXAMPLE |
| 30 | 2.4 | 59 | 1.0 | FOR COMPARATIVE EXAMPLE |
| 31 | 3.4 | 59 | 1.4 | FOR INVENTION EXAMPLE |
| 32 | 2.9 | 59 | 1.2 | FOR INVENTION EXAMPLE |
| 33 | 2.4 | 59 | 1.0 | FOR COMPARATIVE EXAMPLE |
| 34 | 2.4 | 59 | 1.0 | FOR COMPARATIVE EXAMPLE |
| 35 | 3.4 | 59 | 1.4 | FOR INVENTION EXAMPLE |
| 36 | 2.9 | 59 | 1.2 | FOR COMPARATIVE EXAMPLE |
| 37 | 2.9 | 59 | 1.2 | FOR COMPARATIVE EXAMPLE |
| 38 | 2.4 | 59 | 1.0 | FOR INVENTION EXAMPLE |
| 39 | 3.4 | 59 | 1.4 | FOR INVENTION EXAMPLE |
| 40 | 2.9 | 59 | 1.2 | FOR COMPARATIVE EXAMPLE |

TABLE 5

| | | HOT ROLLING | | | | | |
|---|---|---|---|---|---|---|---|
| | | ROUGH ROLLING | | | FINISH ROLLING | | |
| MANUFACTURE No. | STEEL No. | NUMBER OF TIMES | TEMPERATURE OF FINAL PASS (° C.) | REDUCTION RATIO OF FINAL PASS (%) | FINISHING TEMPERATURE (° C.) | Ar3 (° C.) | COILING TEMPERATURE (° C.) |
| 41 | 1 | 5 | 1080 | 52 | 920 | 820 | 650 |
| 42 | 1 | 5 | 1080 | 52 | 920 | 820 | 650 |
| 43 | 1 | 5 | 1080 | 52 | 920 | 820 | 650 |
| 44 | 1 | 5 | 1080 | 52 | 920 | 820 | 650 |
| 45 | 1 | 5 | 1080 | 52 | 920 | 820 | 650 |
| 46 | 1 | 5 | 1080 | 52 | 920 | 820 | 650 |
| 47 | 1 | 5 | 1080 | 52 | 920 | 820 | 650 |
| 48 | 1 | 5 | 1080 | 52 | 920 | 820 | 650 |
| 49 | 1 | 5 | 1080 | 52 | 920 | 820 | 650 |
| 50 | 1 | 5 | 1080 | 52 | 920 | 820 | 650 |
| 51 | 1 | 5 | 1080 | 52 | 920 | 820 | 650 |
| 52 | 1 | 5 | 1080 | 52 | 920 | 820 | 650 |
| 53 | 1 | 5 | 1080 | 52 | 920 | 820 | 650 |
| 54 | 1 | 5 | 1080 | 52 | 920 | 820 | 650 |
| 55 | 1 | 5 | 1080 | 52 | 920 | 820 | 650 |
| 56 | 1 | 5 | 1080 | 52 | 920 | 820 | 650 |
| 57 | 1 | 5 | 1080 | 52 | 920 | 820 | 650 |
| 58 | 1 | 5 | 1080 | 52 | 920 | 820 | 650 |
| 59 | 1 | 5 | 1080 | 52 | 920 | 820 | 650 |
| 60 | 1 | 5 | 1080 | 52 | 920 | 820 | 650 |
| 61 | 1 | 5 | 1080 | 52 | 920 | 820 | 650 |
| 62 | 1 | 5 | 1080 | 52 | 920 | 820 | 650 |
| 63 | 1 | 5 | 1080 | 52 | 920 | 820 | 650 |
| 64 | 1 | 5 | 1080 | 52 | 920 | 820 | 650 |
| 65 | 1 | 5 | 1080 | 52 | 920 | 820 | 650 |
| 66 | 2 | 5 | 1080 | 52 | 920 | 820 | 650 |
| 67 | 3 | 5 | 1080 | 52 | 920 | 820 | 650 |
| 68 | 4 | 5 | 1080 | 52 | 920 | 820 | 650 |
| 69 | 5 | 5 | 1080 | 52 | 920 | 820 | 650 |
| 70 | 6 | 5 | 1080 | 52 | 920 | 820 | 650 |
| 71 | 7 | 5 | 1080 | 52 | 920 | 810 | 650 |
| 72 | 8 | 5 | 1080 | 52 | 920 | 820 | 650 |
| 73 | 9 | 5 | 1080 | 52 | 920 | 820 | 650 |
| 74 | 10 | 5 | 1080 | 52 | 920 | 820 | 650 |
| 75 | 11 | 5 | 1080 | 52 | 920 | 830 | 650 |
| 76 | 12 | 5 | 1080 | 52 | 920 | 920 | 650 |
| 77 | 13 | 5 | 1080 | 52 | 920 | 880 | 650 |
| 78 | 14 | 5 | 1080 | 52 | 920 | 820 | 650 |
| 79 | 15 | 5 | 1080 | 52 | 920 | 810 | 650 |
| 80 | 16 | 5 | 1080 | 52 | 920 | 800 | 650 |

| | HOT ROLLING | COLD ROLLING | | |
|---|---|---|---|---|
| MANUFACTURE No. | THICKNESS OF HOT-ROLLED SHEET (mm) | REDUCTION RATIO (%) | THICKNESS OF COLD-ROLLED SHEET (mm) | NOTE |
| 41 | 3.4 | 59 | 1.4 | FOR COMPARATIVE EXAMPLE |
| 42 | 2.9 | 59 | 1.2 | FOR INVENTION EXAMPLE |
| 43 | 2.4 | 59 | 1.0 | FOR COMPARATIVE EXAMPLE |
| 44 | 3.4 | 59 | 1.4 | FOR COMPARATIVE EXAMPLE |

TABLE 5-continued

| | | | | |
|---|---|---|---|---|
| 45 | 2.9 | 59 | 1.2 | FOR INVENTION EXAMPLE |
| 46 | 3.4 | 59 | 1.4 | FOR INVENTION EXAMPLE |
| 47 | 2.4 | 59 | 1.0 | FOR INVENTION EXAMPLE |
| 48 | 3.4 | 59 | 1.4 | FOR COMPARATIVE EXAMPLE |
| 49 | 2.9 | 59 | 1.2 | FOR COMPARATIVE EXAMPLE |
| 50 | 2.9 | 59 | 1.2 | FOR INVENTION EXAMPLE |
| 51 | 2.4 | 59 | 1.0 | FOR COMPARATIVE EXAMPLE |
| 52 | 3.4 | 59 | 1.4 | FOR COMPARATIVE EXAMPLE |
| 53 | 2.9 | 59 | 1.2 | FOR INVENTION EXAMPLE |
| 54 | 3.4 | 59 | 1.4 | FOR COMPARATIVE EXAMPLE |
| 55 | 2.9 | 59 | 1.2 | FOR COMPARATIVE EXAMPLE |
| 56 | 2.4 | 59 | 1.0 | FOR INVENTION EXAMPLE |
| 57 | 3.4 | 59 | 1.4 | FOR INVENTION EXAMPLE |
| 58 | 2.9 | 59 | 1.2 | FOR INVENTION EXAMPLE |
| 59 | 2.4 | 59 | 1.0 | FOR COMPARATIVE EXAMPLE |
| 60 | 2.4 | 59 | 1.0 | FOR COMPARATIVE EXAMPLE |
| 61 | 3.4 | 59 | 1.4 | FOR INVENTION EXAMPLE |
| 62 | 2.9 | 59 | 1.2 | FOR INVENTION EXAMPLE |
| 63 | 2.9 | 59 | 1.2 | FOR INVENTION EXAMPLE |
| 64 | 2.4 | 59 | 1.0 | FOR INVENTION EXAMPLE |
| 65 | 3.4 | 59 | 1.4 | FOR INVENTION EXAMPLE |
| 66 | 3.4 | 59 | 1.4 | FOR COMPARATIVE EXAMPLE |
| 67 | 2.9 | 59 | 1.2 | FOR INVENTION EXAMPLE |
| 68 | 2.4 | 59 | 1.0 | FOR INVENTION EXAMPLE |
| 69 | 3.4 | 59 | 1.4 | FOR INVENTION EXAMPLE |
| 70 | 2.9 | 59 | 1.2 | FOR COMPARATIVE EXAMPLE |
| 71 | 2.4 | 59 | 1.0 | FOR COMPARATIVE EXAMPLE |
| 72 | 2.4 | 59 | 1.0 | FOR INVENTION EXAMPLE |
| 73 | 3.4 | 59 | 1.4 | FOR INVENTION EXAMPLE |
| 74 | 2.9 | 59 | 1.2 | FOR INVENTION EXAMPLE |
| 75 | 2.9 | 59 | 1.2 | FOR COMPARATIVE EXAMPLE |
| 76 | 2.4 | 59 | 1.0 | FOR COMPARATIVE EXAMPLE |
| 77 | 3.4 | 59 | 1.4 | FOR INVENTION EXAMPLE |
| 78 | 2.9 | 59 | 1.2 | FOR INVENTION EXAMPLE |
| 79 | 3.4 | 59 | 1.4 | FOR INVENTION EXAMPLE |
| 80 | 2.9 | 59 | 1.2 | FOR COMPARATIVE EXAMPLE |

TABLE 6

| | | HOT ROLLING | | | | | |
|---|---|---|---|---|---|---|---|
| | | ROUGH ROLLING | | | FINISH ROLLING | | |
| MANUFACTURE No. | STEEL No. | NUMBER OF TIMES | TEMPERATURE OF FINAL PASS (° C.) | REDUCTION RATIO OF FINAL PASS (%) | FINISHING TEMPERATURE (° C.) | Ar3 (° C.) | COILING TEMPERATURE (° C.) |
| 81 | 17 | 5 | 1080 | 52 | 920 | 820 | 650 |
| 82 | 18 | 5 | 1080 | 52 | 920 | 820 | 650 |
| 83 | 19 | 5 | 1080 | 52 | 920 | 820 | 650 |
| 84 | 20 | 5 | 1080 | 52 | 920 | 820 | 650 |
| 85 | 21 | 5 | 1080 | 52 | 920 | 820 | 650 |
| 86 | 22 | 5 | 1080 | 52 | 920 | 820 | 650 |
| 87 | 23 | 5 | 1080 | 52 | 920 | 820 | 650 |
| 88 | 24 | 5 | 1080 | 52 | 920 | 810 | 650 |
| 89 | 25 | 5 | 1080 | 52 | 920 | 820 | 650 |
| 90 | 26 | 5 | 1080 | 52 | 920 | 820 | 650 |
| 91 | 27 | 5 | 1080 | 52 | 920 | 810 | 650 |
| 92 | 28 | 5 | 1080 | 52 | 920 | 820 | 650 |
| 93 | 29 | 5 | 1080 | 52 | 920 | 830 | 650 |
| 94 | 30 | 5 | 1080 | 52 | 920 | 820 | 650 |
| 95 | 31 | 5 | 1080 | 52 | 920 | 820 | 650 |
| 96 | 32 | 5 | 1080 | 52 | 920 | 820 | 650 |
| 97 | 33 | 5 | 1080 | 52 | 920 | 820 | 650 |
| 98 | 34 | 5 | 1080 | 52 | 920 | 820 | 650 |
| 99 | 35 | 5 | 1080 | 52 | 920 | 820 | 650 |
| 100 | 36 | 5 | 1080 | 52 | 920 | 820 | 650 |
| 101 | 37 | 5 | 1080 | 52 | 920 | 820 | 650 |
| 102 | 38 | 5 | 1080 | 52 | 920 | 820 | 650 |
| 103 | 39 | 5 | 1080 | 52 | 920 | 820 | 650 |
| 104 | 40 | 5 | 1080 | 52 | 920 | 820 | 650 |
| 105 | 41 | 5 | 1080 | 52 | 920 | 820 | 650 |
| 106 | 42 | 5 | 1080 | 52 | 920 | 820 | 650 |
| 107 | 43 | 5 | 1080 | 52 | 920 | 820 | 650 |
| 108 | 44 | 5 | 1080 | 52 | 920 | 820 | 650 |
| 109 | 45 | 5 | 1080 | 52 | 920 | 820 | 650 |
| 110 | 46 | 5 | 1080 | 52 | 920 | 820 | 650 |

TABLE 6-continued

| | | | | | | | |
|---|---|---|---|---|---|---|---|
| 111 | 47 | 5 | 1080 | 52 | 920 | 820 | 650 |
| 112 | 48 | 5 | 1080 | 52 | 920 | 820 | 650 |
| 113 | 49 | 5 | 1080 | 52 | 920 | 820 | 650 |
| 114 | 50 | 5 | 1080 | 52 | 920 | 820 | 650 |
| 115 | 51 | 5 | 1080 | 52 | 920 | 820 | 650 |
| 116 | 52 | 5 | 1080 | 52 | 920 | 820 | 650 |
| 117 | 53 | 5 | 1080 | 52 | 920 | 820 | 650 |
| 118 | 54 | 5 | 1080 | 52 | 920 | 820 | 650 |
| 119 | 55 | 5 | 1080 | 52 | 920 | 820 | 650 |
| 120 | 56 | 5 | 1080 | 52 | 920 | 820 | 650 |

| | HOT ROLLING | COLD ROLLING | | |
|---|---|---|---|---|
| MANUFACTURE No. | THICKNESS OF HOT-ROLLED SHEET (mm) | REDUCTION RATIO (%) | THICKNESS OF COLD-ROLLED SHEET (mm) | NOTE |
| 81 | 2.4 | 59 | 1.0 | FOR INVENTION EXAMPLE |
| 82 | 3.4 | 59 | 1.4 | FOR COMPARATIVE EXAMPLE |
| 83 | 2.9 | 59 | 1.2 | FOR INVENTION EXAMPLE |
| 84 | 2.4 | 59 | 1.0 | FOR INVENTION EXAMPLE |
| 85 | 2.4 | 59 | 1.0 | FOR COMPARATIVE EXAMPLE |
| 86 | 3.4 | 59 | 1.4 | FOR INVENTION EXAMPLE |
| 87 | 2.9 | 59 | 1.2 | FOR COMPARATIVE EXAMPLE |
| 88 | 2.9 | 59 | 1.2 | FOR INVENTION EXAMPLE |
| 89 | 2.4 | 59 | 1.0 | FOR INVENTION EXAMPLE |
| 90 | 3.4 | 59 | 1.4 | FOR COMPARATIVE EXAMPLE |
| 91 | 2.9 | 59 | 1.2 | FOR INVENTION EXAMPLE |
| 92 | 3.4 | 59 | 1.4 | FOR INVENTION EXAMPLE |
| 93 | 2.9 | 59 | 1.2 | FOR INVENTION EXAMPLE |
| 94 | 2.4 | 59 | 1.0 | FOR INVENTION EXAMPLE |
| 95 | 3.4 | 59 | 1.4 | FOR INVENTION EXAMPLE |
| 96 | 2.9 | 59 | 1.2 | FOR INVENTION EXAMPLE |
| 97 | 2.4 | 59 | 1.0 | FOR COMPARATIVE EXAMPLE |
| 98 | 2.4 | 59 | 1.0 | FOR INVENTION EXAMPLE |
| 99 | 3.4 | 59 | 1.4 | FOR INVENTION EXAMPLE |
| 100 | 2.9 | 59 | 1.2 | FOR INVENTION EXAMPLE |
| 101 | 2.9 | 59 | 1.2 | FOR COMPARATIVE EXAMPLE |
| 102 | 2.4 | 59 | 1.0 | FOR INVENTION EXAMPLE |
| 103 | 3.4 | 59 | 1.4 | FOR INVENTION EXAMPLE |
| 104 | 2.9 | 59 | 1.2 | FOR INVENTION EXAMPLE |
| 105 | 3.4 | 59 | 1.4 | FOR COMPARATIVE EXAMPLE |
| 106 | 2.9 | 59 | 1.2 | FOR INVENTION EXAMPLE |
| 107 | 2.4 | 59 | 1.0 | FOR INVENTION EXAMPLE |
| 108 | 3.4 | 59 | 1.4 | FOR INVENTION EXAMPLE |
| 109 | 2.9 | 59 | 1.2 | FOR COMPARATIVE EXAMPLE |
| 110 | 2.4 | 59 | 1.0 | FOR INVENTION EXAMPLE |
| 111 | 2.4 | 59 | 1.0 | FOR INVENTION EXAMPLE |
| 112 | 3.4 | 59 | 1.4 | FOR INVENTION EXAMPLE |
| 113 | 2.9 | 59 | 1.2 | FOR COMPARATIVE EXAMPLE |
| 114 | 2.9 | 59 | 1.2 | FOR INVENTION EXAMPLE |
| 115 | 2.4 | 59 | 1.0 | FOR INVENTION EXAMPLE |
| 116 | 3.4 | 59 | 1.4 | FOR INVENTION EXAMPLE |
| 117 | 2.9 | 59 | 1.2 | FOR COMPARATIVE EXAMPLE |
| 118 | 3.4 | 59 | 1.4 | FOR INVENTION EXAMPLE |
| 119 | 2.9 | 59 | 1.2 | FOR INVENTION EXAMPLE |
| 120 | 2.4 | 59 | 1.0 | FOR INVENTION EXAMPLE |

TABLE 7

| | | HOT ROLLING | | | | | |
|---|---|---|---|---|---|---|---|
| | | ROUGH ROLLING | | | FINISH ROLLING | | |
| MANUFACTURE No. | STEEL No. | NUMBER OF TIMES | TEMPERATURE OF FINAL PASS (° C.) | REDUCTION RATIO OF FINAL PASS (%) | FINISHING TEMPERATURE (° C.) | Ar3 (° C.) | COILING TEMPERATURE (° C.) |
| 121 | 57 | 5 | 1080 | 52 | 920 | 820 | 650 |
| 122 | 58 | 5 | 1080 | 52 | 920 | 820 | 650 |
| 123 | 59 | 5 | 1080 | 52 | 920 | 820 | 650 |
| 124 | 60 | 5 | 1080 | 52 | 920 | 820 | 650 |
| 125 | 61 | 5 | 1080 | 52 | 920 | 820 | 650 |
| 126 | 62 | 5 | 1080 | 52 | 920 | 820 | 650 |
| 127 | 63 | 5 | 1080 | 52 | 920 | 820 | 650 |
| 128 | 64 | 5 | 1080 | 52 | 920 | 820 | 650 |
| 129 | 65 | 5 | 1080 | 52 | 920 | 820 | 650 |

TABLE 7-continued

| | | | | | | | |
|---|---|---|---|---|---|---|---|
| 130 | 66 | 5 | 1080 | 52 | 920 | 820 | 650 |
| 131 | 67 | 5 | 1080 | 52 | 920 | 820 | 650 |
| 132 | 68 | 5 | 1080 | 52 | 920 | 820 | 650 |
| 133 | 69 | 5 | 1080 | 52 | 920 | 820 | 650 |
| 134 | 70 | 5 | 1080 | 52 | 920 | 820 | 650 |
| 135 | 71 | 5 | 1080 | 52 | 920 | 820 | 650 |
| 136 | 72 | 5 | 1080 | 52 | 920 | 820 | 650 |
| 137 | 73 | 5 | 1080 | 52 | 920 | 820 | 650 |
| 138 | 74 | 5 | 1080 | 52 | 920 | 820 | 650 |
| 139 | 75 | 5 | 1080 | 52 | 920 | 820 | 650 |
| 140 | 76 | 5 | 1080 | 52 | 920 | 820 | 650 |
| 141 | 77 | 5 | 1080 | 52 | 920 | 820 | 650 |
| 142 | 78 | 5 | 1080 | 52 | 920 | 820 | 650 |
| 143 | 79 | 5 | 1080 | 52 | 920 | 820 | 650 |
| 144 | 80 | 5 | 1080 | 52 | 920 | 820 | 650 |
| 145 | 81 | 5 | 1080 | 52 | 920 | 820 | 650 |
| 146 | 82 | 5 | 1080 | 52 | 920 | 820 | 650 |
| 147 | 83 | 5 | 1080 | 52 | 920 | 820 | 650 |
| 148 | 84 | 5 | 1080 | 52 | 920 | 820 | 650 |
| 149 | 85 | 5 | 1080 | 52 | 920 | 820 | 650 |
| 150 | 86 | 5 | 1080 | 52 | 920 | 820 | 650 |
| 151 | 87 | 5 | 1080 | 52 | 920 | 820 | 650 |
| 152 | 1 | 5 | 1080 | 52 | 920 | 638 | 650 |

| | HOT ROLLING | COLD ROLLING | | |
|---|---|---|---|---|
| MANUFACTURE No. | THICKNESS OF HOT-ROLLED SHEET(mm) | REDUCTION RATIO (%) | THICKNESS OF COLD-ROLLED SHEET (mm) | NOTE |
| 121 | 3.4 | 59 | 1.4 | FOR COMPARATIVE EXAMPLE |
| 122 | 2.9 | 59 | 1.2 | FOR INVENTION EXAMPLE |
| 123 | 2.4 | 59 | 1.0 | FOR INVENTION EXAMPLE |
| 124 | 2.4 | 59 | 1.0 | FOR INVENTION EXAMPLE |
| 125 | 3.4 | 59 | 1.4 | FOR COMPARATIVE EXAMPLE |
| 126 | 2.9 | 59 | 1.2 | FOR INVENTION EXAMPLE |
| 127 | 2.9 | 59 | 1.2 | FOR INVENTION EXAMPLE |
| 128 | 2.4 | 59 | 1.0 | FOR INVENTION EXAMPLE |
| 129 | 3.4 | 59 | 1.4 | FOR COMPARATIVE EXAMPLE |
| 130 | 2.9 | 59 | 1.2 | FOR INVENTION EXAMPLE |
| 131 | 2.9 | 59 | 1.2 | FOR INVENTION EXAMPLE |
| 132 | 2.9 | 59 | 1.2 | FOR INVENTION EXAMPLE |
| 133 | 2.9 | 59 | 1.2 | FOR INVENTION EXAMPLE |
| 134 | 2.9 | 59 | 1.2 | FOR INVENTION EXAMPLE |
| 135 | 2.9 | 59 | 1.2 | FOR INVENTION EXAMPLE |
| 136 | 2.9 | 59 | 1.2 | FOR INVENTION EXAMPLE |
| 137 | 2.9 | 59 | 1.2 | FOR INVENTION EXAMPLE |
| 138 | 2.9 | 59 | 1.2 | FOR INVENTION EXAMPLE |
| 139 | 2.9 | 59 | 1.2 | FOR INVENTION EXAMPLE |
| 140 | 2.9 | 59 | 1.2 | FOR INVENTION EXAMPLE |
| 141 | 2.9 | 59 | 1.2 | FOR INVENTION EXAMPLE |
| 142 | 2.9 | 59 | 1.2 | FOR INVENTION EXAMPLE |
| 143 | 2.9 | 59 | 1.2 | FOR INVENTION EXAMPLE |
| 144 | 2.9 | 59 | 1.2 | FOR INVENTION EXAMPLE |
| 145 | 2.9 | 59 | 1.2 | FOR INVENTION EXAMPLE |
| 146 | 2.9 | 59 | 1.2 | FOR INVENTION EXAMPLE |
| 147 | 2.9 | 59 | 1.2 | FOR INVENTION EXAMPLE |
| 148 | 2.9 | 59 | 1.2 | FOR INVENTION EXAMPLE |
| 149 | 2.9 | 59 | 1.2 | FOR INVENTION EXAMPLE |
| 150 | 2.9 | 59 | 1.2 | FOR INVENTION EXAMPLE |
| 151 | 2.9 | 59 | 1.2 | FOR INVENTION EXAMPLE |
| 152 | 2.9 | 59 | 1.2 | FOR COMPARATIVE EXAMPLE |

Then, under the conditions illustrated in Table 8 to Table 11, first annealing of the cold-rolled steel sheets was performed to obtain intermediate steel sheets. Each underline in Table 8 to Table 11 indicates that a corresponding numerical value is out of the range suitable for manufacturing the steel sheet according to the present invention.

TABLE 8

| | FIRST ANNEALING | | | | | |
|---|---|---|---|---|---|---|
| | | FIRST COOLING | | SECOND COOLING | | |
| MANUFACTURE No. | ANNEALING TEMPERATURE (° C.) | STOPPING TEMPERATURE (° C.) | COOLING RATE (° C./SECOND) | STOPPING TEMPERATURE T1 (° C.) | COOLING RATE (° C./SECOND) | REHEATING |
| 1 | 840 | 680 | 3 | 250 | 40 | NOT PERFORMED |
| 2 | 840 | 680 | 3 | 250 | 40 | NOT PERFORMED |
| 3 | 840 | 680 | 3 | 250 | 40 | NOT PERFORMED |
| 4 | 840 | 680 | 3 | 250 | 40 | NOT PERFORMED |
| 5 | 840 | 680 | 3 | 250 | 40 | NOT PERFORMED |
| 6 | 840 | 680 | 3 | 250 | 40 | NOT PERFORMED |
| 7 | 840 | 680 | 3 | 250 | 40 | NOT PERFORMED |
| 8 | 840 | 680 | 3 | 250 | 40 | NOT PERFORMED |
| 9 | 840 | 680 | 3 | 250 | 40 | NOT PERFORMED |
| 10 | 840 | 680 | 3 | 250 | 40 | NOT PERFORMED |
| 11 | 840 | 680 | 3 | 250 | 40 | NOT PERFORMED |
| 12 | 840 | 680 | 3 | 250 | 40 | NOT PERFORMED |
| 13 | 840 | 680 | 3 | 250 | 40 | NOT PERFORMED |
| 14 | 840 | 680 | 3 | 250 | 40 | NOT PERFORMED |
| 15 | 840 | 680 | 3 | 250 | 40 | NOT PERFORMED |
| 16 | 840 | 680 | 3 | 250 | 40 | NOT PERFORMED |
| 17 | 840 | 680 | 3 | 250 | 40 | NOT PERFORMED |
| 18 | 670 | 680 | 3 | 250 | 40 | NOT PERFORMED |
| 19 | 760 | 680 | 3 | 250 | 40 | NOT PERFORMED |
| 20 | 800 | 680 | 3 | 250 | 40 | NOT PERFORMED |
| 21 | 840 | 680 | 3 | 250 | 40 | NOT PERFORMED |
| 22 | 880 | 680 | 3 | 250 | 40 | NOT PERFORMED |
| 23 | 920 | 680 | 3 | 250 | 40 | NOT PERFORMED |
| 24 | 840 | 550 | 3 | 250 | 40 | NOT PERFORMED |
| 25 | 840 | 680 | 3 | 250 | 40 | NOT PERFORMED |
| 26 | 840 | 760 | 3 | 250 | 40 | NOT PERFORMED |
| 27 | 840 | 680 | 0.5 | 250 | 40 | NOT PERFORMED |
| 28 | 840 | 680 | 3 | 250 | 40 | NOT PERFORMED |
| 29 | 840 | 680 | 15 | 250 | 40 | NOT PERFORMED |
| 30 | 840 | 680 | 3 | 110 | 40 | PERFORMED |
| 31 | 840 | 680 | 3 | 250 | 40 | NOT PERFORMED |
| 32 | 840 | 680 | 3 | 400 | 40 | NOT PERFORMED |
| 33 | 840 | 680 | 3 | 555 | 40 | NOT PERFORMED |
| 34 | 840 | 680 | 3 | 250 | 4 | NOT PERFORMED |
| 35 | 840 | 680 | 3 | 250 | 40 | NOT PERFORMED |
| 36 | 840 | 680 | 3 | 250 | 77 | NOT PERFORMED |
| 37 | 840 | 680 | 3 | 250 | 40 | NOT PERFORMED |
| 38 | 840 | 680 | 3 | 250 | 40 | NOT PERFORMED |
| 39 | 840 | 680 | 3 | 250 | 40 | PERFORMED |
| 40 | 840 | 680 | 3 | 250 | 40 | PERFORMED |

| | FIRST ANNEALING | | | |
|---|---|---|---|---|
| | REHEATING | FIRST RETENTION | | |
| MANUFACTURE No. | TEMPERATURE T2 (° C.) | TIME (SECOND) | t1 (SECOND) | NOTE |
| 1 | 250 | 375 | 206 | FOR INVENTION EXAMPLE |
| 2 | 250 | 375 | 206 | FOR COMPARATIVE EXAMPLE |
| 3 | 250 | 375 | 206 | FOR COMPARATIVE EXAMPLE |
| 4 | 250 | 375 | 206 | FOR INVENTION EXAMPLE |
| 5 | 250 | 375 | 206 | FOR COMPARATIVE EXAMPLE |
| 6 | 250 | 375 | 206 | FOR COMPARATIVE EXAMPLE |
| 7 | 250 | 375 | 206 | FOR INVENTION EXAMPLE |
| 8 | 250 | 375 | 206 | FOR COMPARATIVE EXAMPLE |
| 9 | 250 | 375 | 206 | FOR INVENTION EXAMPLE |
| 10 | 250 | 375 | 206 | FOR INVENTION EXAMPLE |
| 11 | 250 | 375 | 206 | FOR INVENTION EXAMPLE |
| 12 | 250 | 375 | 206 | FOR COMPARATIVE EXAMPLE |
| 13 | 250 | 375 | 206 | FOR COMPARATIVE EXAMPLE |
| 14 | 250 | 375 | 206 | FOR INVENTION EXAMPLE |
| 15 | 250 | 375 | 206 | FOR INVENTION EXAMPLE |
| 16 | 250 | 375 | 206 | FOR INVENTION EXAMPLE |
| 17 | 250 | 375 | 206 | FOR COMPARATIVE EXAMPLE |
| 18 | 250 | 375 | 223 | FOR COMPARATIVE EXAMPLE |
| 19 | 250 | 375 | 214 | FOR INVENTION EXAMPLE |
| 20 | 250 | 375 | 210 | FOR INVENTION EXAMPLE |
| 21 | 250 | 375 | 206 | FOR INVENTION EXAMPLE |
| 22 | 250 | 375 | 202 | FOR INVENTION EXAMPLE |
| 23 | 250 | 375 | 198 | FOR COMPARATIVE EXAMPLE |
| 24 | 250 | 375 | 219 | FOR COMPARATIVE EXAMPLE |

TABLE 8-continued

| | | | | |
|---|---|---|---|---|
| 25 | 250 | 375 | 206 | FOR INVENTION EXAMPLE |
| 26 | 250 | 375 | 198 | FOR COMPARATIVE EXAMPLE |
| 27 | 250 | 375 | 206 | FOR COMPARATIVE EXAMPLE |
| 28 | 250 | 375 | 206 | FOR INVENTION EXAMPLE |
| 29 | 250 | 375 | 206 | FOR COMPARATIVE EXAMPLE |
| 30 | 250 | 375 | 66 | FOR COMPARATIVE EXAMPLE |
| 31 | 250 | 375 | 206 | FOR INVENTION EXAMPLE |
| 32 | 400 | 375 | 356 | FOR INVENTION EXAMPLE |
| 33 | 250 | 375 | 511 | FOR COMPARATIVE EXAMPLE |
| 34 | 250 | 375 | 206 | FOR COMPARATIVE EXAMPLE |
| 35 | 250 | 375 | 206 | FOR INVENTION EXAMPLE |
| 36 | 250 | 375 | 206 | FOR COMPARATIVE EXAMPLE |
| 37 | 115 | 375 | 206 | FOR COMPARATIVE EXAMPLE |
| 38 | 250 | 375 | 206 | FOR INVENTION EXAMPLE |
| 39 | 400 | 375 | 206 | FOR INVENTION EXAMPLE |
| 40 | 555 | 375 | 206 | FOR COMPARATIVE EXAMPLE |

TABLE 9

| | FIRST ANNEALING | | | | | |
|---|---|---|---|---|---|---|
| | | FIRST COOLING | | SECOND COOLING | | |
| MANUFACTURE No. | ANNEALING TEMPERATURE (° C.) | STOPPING TEMPERATURE (° C.) | COOLING RATE (° C./SECOND) | STOPPING TEMPERATURE T1 (° C.) | COOLING RATE (° C./SECOND) | REHEATING |
| 41 | 840 | 680 | 3 | 250 | 40 | NOT PERFORMED |
| 42 | 840 | 680 | 3 | 250 | 40 | NOT PERFORMED |
| 43 | 840 | 680 | 3 | 250 | 40 | NOT PERFORMED |
| 44 | 840 | 680 | 3 | 250 | 40 | NOT PERFORMED |
| 45 | 840 | 680 | 3 | 250 | 40 | NOT PERFORMED |
| 46 | 840 | 680 | 3 | 250 | 40 | NOT PERFORMED |
| 47 | 840 | 680 | 3 | 250 | 40 | NOT PERFORMED |
| 48 | 840 | 680 | 3 | 250 | 40 | NOT PERFORMED |
| 49 | 840 | 680 | 3 | 250 | 40 | NOT PERFORMED |
| 50 | 840 | 680 | 3 | 250 | 40 | NOT PERFORMED |
| 51 | 840 | 680 | 3 | 250 | 40 | NOT PERFORMED |
| 52 | 840 | 680 | 3 | 250 | 40 | NOT PERFORMED |
| 53 | 840 | 680 | 3 | 250 | 40 | NOT PERFORMED |
| 54 | 840 | 680 | 3 | 250 | 40 | NOT PERFORMED |
| 55 | 840 | 680 | 3 | 250 | 40 | NOT PERFORMED |
| 56 | 840 | 680 | 3 | 250 | 40 | NOT PERFORMED |
| 57 | 840 | 680 | 3 | 250 | 40 | NOT PERFORMED |
| 58 | 840 | 680 | 3 | 250 | 40 | NOT PERFORMED |
| 59 | 840 | 680 | 3 | 250 | 40 | NOT PERFORMED |
| 60 | 840 | 680 | 3 | 250 | 40 | NOT PERFORMED |
| 61 | 840 | 680 | 3 | 250 | 40 | NOT PERFORMED |
| 62 | 840 | 680 | 3 | 250 | 40 | NOT PERFORMED |
| 63 | 840 | 680 | 3 | 250 | 40 | PERFORMED |
| 64 | 840 | 680 | 3 | 250 | 40 | NOT PERFORMED |
| 65 | 840 | 680 | 3 | 250 | 40 | PERFORMED |
| 66 | 840 | 680 | 3 | 250 | 40 | NOT PERFORMED |
| 67 | 840 | 680 | 3 | 250 | 40 | NOT PERFORMED |
| 68 | 840 | 680 | 3 | 250 | 40 | NOT PERFORMED |
| 69 | 840 | 680 | 3 | 250 | 40 | NOT PERFORMED |
| 70 | 840 | 680 | 3 | 250 | 40 | NOT PERFORMED |
| 71 | 840 | 680 | 3 | 250 | 40 | NOT PERFORMED |
| 72 | 840 | 680 | 3 | 250 | 40 | NOT PERFORMED |
| 73 | 840 | 680 | 3 | 250 | 40 | NOT PERFORMED |
| 74 | 840 | 680 | 3 | 250 | 40 | NOT PERFORMED |
| 75 | 840 | 680 | 3 | 250 | 40 | NOT PERFORMED |
| 76 | 840 | 680 | 3 | 250 | 40 | NOT PERFORMED |
| 77 | 840 | 680 | 3 | 250 | 40 | NOT PERFORMED |
| 78 | 840 | 680 | 3 | 250 | 40 | NOT PERFORMED |
| 79 | 840 | 680 | 3 | 250 | 40 | NOT PERFORMED |
| 80 | 840 | 680 | 3 | 250 | 40 | NOT PERFORMED |

| | FIRST ANNEALING | | | |
|---|---|---|---|---|
| | REHEATING | FIRST RETENTION | | |
| MANUFACTURE No. | TEMPERATURE T2 (° C.) | TIME (SECOND) | t1 (SECOND) | NOTE |
| 41 | 250 | 21 | 206 | FOR COMPARATIVE EXAMPLE |
| 42 | 250 | 375 | 206 | FOR INVENTION EXAMPLE |

TABLE 9-continued

| | | | | |
|---|---|---|---|---|
| 43 | 250 | 1600 | 206 | FOR COMPARATIVE EXAMPLE |
| 44 | 250 | 375 | 206 | FOR COMPARATIVE EXAMPLE |
| 45 | 250 | 375 | 206 | FOR INVENTION EXAMPLE |
| 46 | 250 | 375 | 206 | FOR INVENTION EXAMPLE |
| 47 | 250 | 375 | 206 | FOR INVENTION EXAMPLE |
| 48 | 250 | 375 | 206 | FOR COMPARATIVE EXAMPLE |
| 49 | 250 | 375 | 206 | FOR COMPARATIVE EXAMPLE |
| 50 | 250 | 375 | 206 | FOR INVENTION EXAMPLE |
| 51 | 250 | 375 | 206 | FOR COMPARATIVE EXAMPLE |
| 52 | 250 | 375 | 206 | FOR COMPARATIVE EXAMPLE |
| 53 | 250 | 375 | 206 | FOR INVENTION EXAMPLE |
| 54 | 250 | 375 | 206 | FOR COMPARATIVE EXAMPLE |
| 55 | 250 | 375 | 206 | FOR COMPARATIVE EXAMPLE |
| 56 | 250 | 375 | 206 | FOR INVENTION EXAMPLE |
| 57 | 250 | 375 | 206 | FOR INVENTION EXAMPLE |
| 58 | 250 | 375 | 206 | FOR INVENTION EXAMPLE |
| 59 | 250 | 375 | 206 | FOR COMPARATIVE EXAMPLE |
| 60 | 250 | 375 | 206 | FOR COMPARATIVE EXAMPLE |
| 61 | 250 | 375 | 206 | FOR INVENTION EXAMPLE |
| 62 | 250 | 375 | 206 | FOR INVENTION EXAMPLE |
| 63 | 350 | 375 | 206 | FOR INVENTION EXAMPLE |
| 64 | 250 | 375 | 206 | FOR INVENTION EXAMPLE |
| 65 | 350 | 375 | 206 | FOR INVENTION EXAMPLE |
| 66 | 250 | 375 | 203 | FOR COMPARATIVE EXAMPLE |
| 67 | 250 | 375 | 205 | FOR INVENTION EXAMPLE |
| 68 | 250 | 375 | 206 | FOR INVENTION EXAMPLE |
| 69 | 250 | 375 | 207 | FOR INVENTION EXAMPLE |
| 70 | 250 | 375 | 215 | FOR COMPARATIVE EXAMPLE |
| 71 | 250 | 375 | 206 | FOR COMPARATIVE EXAMPLE |
| 72 | 250 | 375 | 206 | FOR INVENTION EXAMPLE |
| 73 | 250 | 375 | 206 | FOR INVENTION EXAMPLE |
| 74 | 250 | 375 | 206 | FOR INVENTION EXAMPLE |
| 75 | 250 | 375 | 206 | FOR COMPARATIVE EXAMPLE |
| 76 | 250 | 375 | 114 | FOR COMPARATIVE EXAMPLE |
| 77 | 250 | 375 | 162 | FOR INVENTION EXAMPLE |
| 78 | 250 | 375 | 206 | FOR INVENTION EXAMPLE |
| 79 | 250 | 375 | 234 | FOR INVENTION EXAMPLE |
| 80 | 250 | 375 | 294 | FOR COMPARATIVE EXAMPLE |

TABLE 10

| | FIRST ANNEALING | | | | | |
|---|---|---|---|---|---|---|
| | | FIRST COOLING | | SECOND COOLING | | |
| MANUFACTURE No. | ANNEALING TEMPERATURE (° C.) | STOPPING TEMPERATURE (° C.) | COOLING RATE (° C./SECOND) | STOPPING TEMPERATURE T1 (° C.) | COOLING RATE (° C./SECOND) | REHEATING |
| 81 | 840 | 680 | 3 | 250 | 40 | NOT PERFORMED |
| 82 | 840 | 680 | 3 | 250 | 40 | NOT PERFORMED |
| 83 | 840 | 680 | 3 | 250 | 40 | NOT PERFORMED |
| 84 | 840 | 680 | 3 | 250 | 40 | NOT PERFORMED |
| 85 | 840 | 680 | 3 | 250 | 40 | NOT PERFORMED |
| 86 | 840 | 680 | 3 | 250 | 40 | NOT PERFORMED |
| 87 | 840 | 680 | 3 | 250 | 40 | NOT PERFORMED |
| 88 | 840 | 680 | 3 | 250 | 40 | NOT PERFORMED |
| 89 | 840 | 680 | 3 | 250 | 40 | NOT PERFORMED |
| 90 | 840 | 680 | 3 | 250 | 40 | NOT PERFORMED |
| 91 | 840 | 680 | 3 | 250 | 40 | NOT PERFORMED |
| 92 | 840 | 680 | 3 | 250 | 40 | NOT PERFORMED |
| 93 | 840 | 680 | 3 | 250 | 40 | NOT PERFORMED |
| 94 | 840 | 680 | 3 | 250 | 40 | NOT PERFORMED |
| 95 | 840 | 680 | 3 | 250 | 40 | NOT PERFORMED |
| 96 | 840 | 680 | 3 | 250 | 40 | NOT PERFORMED |
| 97 | 840 | 680 | 3 | 250 | 40 | NOT PERFORMED |
| 98 | 840 | 680 | 3 | 250 | 40 | NOT PERFORMED |
| 99 | 840 | 680 | 3 | 250 | 40 | NOT PERFORMED |
| 100 | 840 | 680 | 3 | 250 | 40 | NOT PERFORMED |
| 101 | 840 | 680 | 3 | 250 | 40 | NOT PERFORMED |
| 102 | 840 | 680 | 3 | 250 | 40 | NOT PERFORMED |
| 103 | 840 | 680 | 3 | 250 | 40 | NOT PERFORMED |
| 104 | 840 | 680 | 3 | 250 | 40 | NOT PERFORMED |
| 105 | 840 | 680 | 3 | 250 | 40 | NOT PERFORMED |
| 106 | 840 | 680 | 3 | 250 | 40 | NOT PERFORMED |
| 107 | 840 | 680 | 3 | 250 | 40 | NOT PERFORMED |

TABLE 10-continued

| | | | | | | |
|---|---|---|---|---|---|---|
| 108 | 840 | 680 | 3 | 250 | 40 | NOT PERFORMED |
| 109 | 840 | 680 | 3 | 250 | 40 | NOT PERFORMED |
| 110 | 840 | 680 | 3 | 250 | 40 | NOT PERFORMED |
| 111 | 840 | 680 | 3 | 250 | 40 | NOT PERFORMED |
| 112 | 840 | 680 | 3 | 250 | 40 | NOT PERFORMED |
| 113 | 840 | 680 | 3 | 250 | 40 | NOT PERFORMED |
| 114 | 840 | 680 | 3 | 250 | 40 | NOT PERFORMED |
| 115 | 840 | 680 | 3 | 250 | 40 | NOT PERFORMED |
| 116 | 840 | 680 | 3 | 250 | 40 | NOT PERFORMED |
| 117 | 840 | 680 | 3 | 250 | 40 | NOT PERFORMED |
| 118 | 840 | 680 | 3 | 250 | 40 | NOT PERFORMED |
| 119 | 840 | 680 | 3 | 250 | 40 | NOT PERFORMED |
| 120 | 840 | 680 | 3 | 250 | 40 | NOT PERFORMED |

| | FIRST ANNEALING | | | |
|---|---|---|---|---|
| | REHEATING | FIRST RETENTION | | |
| MANUFACTURE No. | TEMPERATURE T2 (° C.) | TIME (SECOND) | t1 (SECOND) | NOTE |
| 81 | 250 | 375 | 206 | FOR INVENTION EXAMPLE |
| 82 | 250 | 375 | 206 | FOR COMPARATIVE EXAMPLE |
| 83 | 250 | 375 | 206 | FOR INVENTION EXAMPLE |
| 84 | 250 | 375 | 206 | FOR INVENTION EXAMPLE |
| 85 | 250 | 375 | 206 | FOR COMPARATIVE EXAMPLE |
| 86 | 250 | 375 | 206 | FOR INVENTION EXAMPLE |
| 87 | 250 | 375 | 206 | FOR COMPARATIVE EXAMPLE |
| 88 | 250 | 375 | 206 | FOR INVENTION EXAMPLE |
| 89 | 250 | 375 | 206 | FOR INVENTION EXAMPLE |
| 90 | 250 | 375 | 206 | FOR COMPARATIVE EXAMPLE |
| 91 | 250 | 375 | 206 | FOR INVENTION EXAMPLE |
| 92 | 250 | 375 | 206 | FOR INVENTION EXAMPLE |
| 93 | 250 | 375 | 206 | FOR INVENTION EXAMPLE |
| 94 | 250 | 375 | 206 | FOR INVENTION EXAMPLE |
| 95 | 250 | 375 | 206 | FOR INVENTION EXAMPLE |
| 96 | 250 | 375 | 206 | FOR INVENTION EXAMPLE |
| 97 | 250 | 375 | 206 | FOR COMPARATIVE EXAMPLE |
| 98 | 250 | 375 | 206 | FOR INVENTION EXAMPLE |
| 99 | 250 | 375 | 206 | FOR INVENTION EXAMPLE |
| 100 | 250 | 375 | 206 | FOR INVENTION EXAMPLE |
| 101 | 250 | 375 | 206 | FOR COMPARATIVE EXAMPLE |
| 102 | 250 | 375 | 206 | FOR INVENTION EXAMPLE |
| 103 | 250 | 375 | 206 | FOR INVENTION EXAMPLE |
| 104 | 250 | 375 | 206 | FOR INVENTION EXAMPLE |
| 105 | 250 | 375 | 206 | FOR COMPARATIVE EXAMPLE |
| 106 | 250 | 375 | 206 | FOR INVENTION EXAMPLE |
| 107 | 250 | 375 | 206 | FOR INVENTION EXAMPLE |
| 108 | 250 | 375 | 206 | FOR INVENTION EXAMPLE |
| 109 | 250 | 375 | 206 | FOR COMPARATIVE EXAMPLE |
| 110 | 250 | 375 | 206 | FOR INVENTION EXAMPLE |
| 111 | 250 | 375 | 206 | FOR INVENTION EXAMPLE |
| 112 | 250 | 375 | 206 | FOR INVENTION EXAMPLE |
| 113 | 250 | 375 | 206 | FOR COMPARATIVE EXAMPLE |
| 114 | 250 | 375 | 206 | FOR INVENTION EXAMPLE |
| 115 | 250 | 375 | 206 | FOR INVENTION EXAMPLE |
| 116 | 250 | 375 | 206 | FOR INVENTION EXAMPLE |
| 117 | 250 | 375 | 206 | FOR COMPARATIVE EXAMPLE |
| 118 | 250 | 375 | 206 | FOR INVENTION EXAMPLE |
| 119 | 250 | 375 | 206 | FOR INVENTION EXAMPLE |
| 120 | 250 | 375 | 206 | FOR INVENTION EXAMPLE |

TABLE 11

| | FIRST ANNEALING | | | | | |
|---|---|---|---|---|---|---|
| | | FIRST COOLING | | SECOND COOLING | | |
| MANUFACTURE No. | ANNEALING TEMPERATURE (° C.) | STOPPING TEMPERATURE (° C.) | COOLING RATE (° C./SECOND) | STOPPING TEMPERATURE T1 (° C.) | COOLING RATE (° C./SECOND) | REHEATING |
| 121 | 840 | 680 | 3 | 250 | 40 | NOT PERFORMED |
| 122 | 840 | 680 | 3 | 250 | 40 | NOT PERFORMED |
| 123 | 840 | 680 | 3 | 250 | 40 | NOT PERFORMED |
| 124 | 840 | 680 | 3 | 250 | 40 | NOT PERFORMED |
| 125 | 840 | 680 | 3 | 250 | 40 | NOT PERFORMED |

TABLE 11-continued

| | | | | | | |
|---|---|---|---|---|---|---|
| 126 | 840 | 680 | 3 | 250 | 40 | NOT PERFORMED |
| 127 | 840 | 680 | 3 | 250 | 40 | NOT PERFORMED |
| 128 | 840 | 680 | 3 | 250 | 40 | NOT PERFORMED |
| 129 | 840 | 680 | 3 | 250 | 40 | NOT PERFORMED |
| 130 | 840 | 680 | 3 | 250 | 40 | NOT PERFORMED |
| 131 | 840 | 680 | 3 | 250 | 40 | NOT PERFORMED |
| 132 | 840 | 680 | 3 | 250 | 40 | NOT PERFORMED |
| 133 | 840 | 680 | 3 | 250 | 40 | NOT PERFORMED |
| 134 | 840 | 680 | 3 | 250 | 40 | NOT PERFORMED |
| 135 | 840 | 680 | 3 | 250 | 40 | NOT PERFORMED |
| 136 | 840 | 680 | 3 | 250 | 40 | NOT PERFORMED |
| 137 | 840 | 680 | 3 | 250 | 40 | NOT PERFORMED |
| 138 | 840 | 680 | 3 | 250 | 40 | NOT PERFORMED |
| 139 | 840 | 680 | 3 | 250 | 40 | NOT PERFORMED |
| 140 | 840 | 680 | 3 | 250 | 40 | NOT PERFORMED |
| 141 | 840 | 680 | 3 | 250 | 40 | NOT PERFORMED |
| 142 | 840 | 680 | 3 | 250 | 40 | NOT PERFORMED |
| 143 | 840 | 680 | 3 | 250 | 40 | NOT PERFORMED |
| 144 | 840 | 680 | 3 | 250 | 40 | NOT PERFORMED |
| 145 | 840 | 680 | 3 | 250 | 40 | NOT PERFORMED |
| 146 | 840 | 680 | 3 | 250 | 40 | NOT PERFORMED |
| 147 | 840 | 680 | 3 | 250 | 40 | NOT PERFORMED |
| 148 | 840 | 680 | 3 | 250 | 40 | NOT PERFORMED |
| 149 | 840 | 680 | 3 | 250 | 40 | NOT PERFORMED |
| 150 | 840 | 680 | 3 | 250 | 40 | NOT PERFORMED |
| 151 | 840 | 680 | 3 | 250 | 40 | NOT PERFORMED |
| 152 | 840 | 680 | 3 | 250 | 40 | NOT PERFORMED |

| | FIRST ANNEALING | | | |
|---|---|---|---|---|
| | REHEATING | FIRST RETENTION | | |
| MANUFACTURE No. | TEMPERATURE T2 (° C.) | TIME (SECOND) | t1 (SECOND) | NOTE |
| 121 | 250 | 375 | 206 | FOR COMPARATIVE EXAMPLE |
| 122 | 250 | 375 | 206 | FOR INVENTION EXAMPLE |
| 123 | 250 | 375 | 206 | FOR INVENTION EXAMPLE |
| 124 | 250 | 375 | 206 | FOR INVENTION EXAMPLE |
| 125 | 250 | 375 | 206 | FOR COMPARATIVE EXAMPLE |
| 126 | 250 | 375 | 206 | FOR INVENTION EXAMPLE |
| 127 | 250 | 375 | 206 | FOR INVENTION EXAMPLE |
| 128 | 250 | 375 | 206 | FOR INVENTION EXAMPLE |
| 129 | 250 | 375 | 206 | FOR COMPARATIVE EXAMPLE |
| 130 | 250 | 375 | 206 | FOR INVENTION EXAMPLE |
| 131 | 250 | 375 | 206 | FOR INVENTION EXAMPLE |
| 132 | 250 | 375 | 206 | FOR INVENTION EXAMPLE |
| 133 | 250 | 375 | 206 | FOR INVENTION EXAMPLE |
| 134 | 250 | 375 | 206 | FOR INVENTION EXAMPLE |
| 135 | 250 | 375 | 206 | FOR INVENTION EXAMPLE |
| 136 | 250 | 375 | 206 | FOR INVENTION EXAMPLE |
| 137 | 250 | 375 | 206 | FOR INVENTION EXAMPLE |
| 138 | 250 | 375 | 206 | FOR INVENTION EXAMPLE |
| 139 | 250 | 375 | 206 | FOR INVENTION EXAMPLE |
| 140 | 250 | 375 | 206 | FOR INVENTION EXAMPLE |
| 141 | 250 | 375 | 206 | FOR INVENTION EXAMPLE |
| 142 | 250 | 375 | 206 | FOR INVENTION EXAMPLE |
| 143 | 250 | 375 | 206 | FOR INVENTION EXAMPLE |
| 144 | 250 | 375 | 206 | FOR INVENTION EXAMPLE |
| 145 | 250 | 375 | 206 | FOR INVENTION EXAMPLE |
| 146 | 250 | 375 | 206 | FOR INVENTION EXAMPLE |
| 147 | 250 | 375 | 206 | FOR INVENTION EXAMPLE |
| 148 | 250 | 375 | 206 | FOR INVENTION EXAMPLE |
| 149 | 250 | 375 | 206 | FOR INVENTION EXAMPLE |
| 150 | 250 | 375 | 206 | FOR INVENTION EXAMPLE |
| 151 | 250 | 375 | 206 | FOR INVENTION EXAMPLE |
| 152 | 250 | 375 | 206 | FOR COMPARATIVE EXAMPLE |

Then, a metal structure of each of the intermediate steel sheets was observed. In this observation, an area fraction of polygonal ferrite (PF), an area fraction of bainitic ferrite or tempered martensite (BF-tM), and an area fraction of retained austenite (retained γ) were measured, and further, an area fraction of retained austenite grains in a predetermined form was calculated from the shape of retained austenite. These results are illustrated in Table 12 to Table 15. Each underline in Table 12 to Table 15 indicates that a corresponding numerical value is out of the range suitable for manufacturing the steel sheet according to the present invention.

TABLE 12

| MANUFACTURE No. | STEEL No. | PF | BF-tM | RETAINED γ | RETAINED γ GRAIN IN PREDETERMINED FORM | NOTE |
|---|---|---|---|---|---|---|
| | | METAL STRUCTURE OF INTERMEDIATE STEEL SHEET | | | | |
| 1 | 1 | 6 | 79 | 15 | 97 | FOR INVENTION EXAMPLE |
| 2 | 1 | 70 | 29 | 1 | 9 | FOR COMPARATIVE EXAMPLE |
| 3 | 1 | 70 | 29 | 1 | 9 | FOR COMPARATIVE EXAMPLE |
| 4 | 1 | 6 | 79 | 15 | 97 | FOR INVENTION EXAMPLE |
| 5 | 1 | 70 | 29 | 1 | 9 | FOR COMPARATIVE EXAMPLE |
| 6 | 1 | 70 | 29 | 1 | 9 | FOR COMPARATIVE EXAMPLE |
| 7 | 1 | 6 | 79 | 15 | 97 | FOR INVENTION EXAMPLE |
| 8 | 1 | 70 | 29 | 1 | 9 | FOR COMPARATIVE EXAMPLE |
| 9 | 1 | 6 | 79 | 15 | 97 | FOR INVENTION EXAMPLE |
| 10 | 1 | 6 | 79 | 15 | 97 | FOR INVENTION EXAMPLE |
| 11 | 1 | 10 | 80 | 10 | 91 | FOR INVENTION EXAMPLE |
| 12 | 1 | 70 | 29 | 1 | 9 | FOR COMPARATIVE EXAMPLE |
| 13 | 1 | 70 | 29 | 1 | 9 | FOR COMPARATIVE EXAMPLE |
| 14 | 1 | 10 | 80 | 10 | 91 | FOR INVENTION EXAMPLE |
| 15 | 1 | 6 | 79 | 15 | 97 | FOR INVENTION EXAMPLE |
| 16 | 1 | 10 | 80 | 10 | 91 | FOR INVENTION EXAMPLE |
| 17 | 1 | 70 | 29 | 1 | 9 | FOR COMPARATIVE EXAMPLE |
| 18 | 1 | 70 | 29 | 1 | 9 | FOR COMPARATIVE EXAMPLE |
| 19 | 1 | 10 | 80 | 10 | 91 | FOR INVENTION EXAMPLE |
| 20 | 1 | 10 | 80 | 10 | 91 | FOR INVENTION EXAMPLE |
| 21 | 1 | 6 | 79 | 15 | 97 | FOR INVENTION EXAMPLE |
| 22 | 1 | 10 | 80 | 10 | 91 | FOR INVENTION EXAMPLE |
| 23 | 1 | 70 | 29 | 1 | 9 | FOR COMPARATIVE EXAMPLE |
| 24 | 1 | 70 | 29 | 1 | 9 | FOR COMPARATIVE EXAMPLE |
| 25 | 1 | 6 | 79 | 15 | 97 | FOR INVENTION EXAMPLE |
| 26 | 1 | 70 | 29 | 1 | 9 | FOR COMPARATIVE EXAMPLE |
| 27 | 1 | 70 | 29 | 1 | 9 | FOR COMPARATIVE EXAMPLE |
| 28 | 1 | 6 | 79 | 15 | 97 | FOR INVENTION EXAMPLE |
| 29 | 1 | 70 | 29 | 1 | 9 | FOR COMPARATIVE EXAMPLE |
| 30 | 1 | 6 | 79 | 15 | 7 | FOR COMPARATIVE EXAMPLE |
| 31 | 1 | 6 | 79 | 15 | 97 | FOR INVENTION EXAMPLE |
| 32 | 1 | 10 | 80 | 10 | 91 | FOR INVENTION EXAMPLE |
| 33 | 1 | 70 | 29 | 1 | 9 | FOR COMPARATIVE EXAMPLE |
| 34 | 1 | 70 | 29 | 1 | 9 | FOR COMPARATIVE EXAMPLE |
| 35 | 1 | 6 | 79 | 15 | 97 | FOR INVENTION EXAMPLE |
| 36 | 1 | 70 | 29 | 1 | 9 | FOR COMPARATIVE EXAMPLE |
| 37 | 1 | 6 | 79 | 15 | 7 | FOR COMPARATIVE EXAMPLE |
| 38 | 1 | 6 | 79 | 15 | 97 | FOR INVENTION EXAMPLE |
| 39 | 1 | 10 | 80 | 10 | 91 | FOR INVENTION EXAMPLE |
| 40 | 1 | 70 | 29 | 1 | 9 | FOR COMPARATIVE EXAMPLE |

TABLE 13

| MANUFACTURE No. | STEEL No. | PF | BF-tM | RETAINED γ | RETAINED γ GRAIN IN PREDETERMINED FORM | NOTE |
|---|---|---|---|---|---|---|
| | | METAL STRUCTURE OF INTERMEDIATE STEEL SHEET | | | | |
| 41 | 1 | 6 | 79 | 15 | 7 | FOR COMPARATIVE EXAMPLE |
| 42 | 1 | 6 | 79 | 15 | 97 | FOR INVENTION EXAMPLE |
| 43 | 1 | 6 | 79 | 15 | 7 | FOR COMPARATIVE EXAMPLE |
| 44 | 1 | 70 | 29 | 1 | 9 | FOR COMPARATIVE EXAMPLE |
| 45 | 1 | 10 | 80 | 10 | 91 | FOR INVENTION EXAMPLE |
| 46 | 1 | 6 | 79 | 15 | 97 | FOR INVENTION EXAMPLE |
| 47 | 1 | 6 | 84 | 10 | 91 | FOR INVENTION EXAMPLE |
| 48 | 1 | 70 | 29 | 1 | 9 | FOR COMPARATIVE EXAMPLE |
| 49 | 1 | 70 | 29 | 1 | 9 | FOR COMPARATIVE EXAMPLE |
| 50 | 1 | 6 | 79 | 15 | 97 | FOR INVENTION EXAMPLE |
| 51 | 1 | 70 | 29 | 1 | 9 | FOR COMPARATIVE EXAMPLE |
| 52 | 1 | 70 | 29 | 1 | 9 | FOR COMPARATIVE EXAMPLE |
| 53 | 1 | 6 | 79 | 15 | 97 | FOR INVENTION EXAMPLE |
| 54 | 1 | 70 | 29 | 1 | 9 | FOR COMPARATIVE EXAMPLE |
| 55 | 1 | 6 | 79 | 15 | 7 | FOR COMPARATIVE EXAMPLE |
| 56 | 1 | 10 | 80 | 10 | 91 | FOR INVENTION EXAMPLE |
| 57 | 1 | 6 | 79 | 15 | 97 | FOR INVENTION EXAMPLE |
| 58 | 1 | 10 | 80 | 10 | 91 | FOR INVENTION EXAMPLE |
| 59 | 1 | 70 | 29 | 1 | 9 | FOR COMPARATIVE EXAMPLE |
| 60 | 1 | 10 | 88 | 2 | 91 | FOR COMPARATIVE EXAMPLE |
| 61 | 1 | 6 | 79 | 15 | 97 | FOR INVENTION EXAMPLE |

TABLE 13-continued

| MANUFACTURE No. | STEEL No. | PF | BF-tM | RETAINED γ | RETAINED γ GRAIN IN PREDETERMINED FORM | NOTE |
|---|---|---|---|---|---|---|
| | | METAL STRUCTURE OF INTERMEDIATE STEEL SHEET | | | | |
| 62 | 1 | 10 | 80 | 10 | 91 | FOR INVENTION EXAMPLE |
| 63 | 1 | 10 | 77 | 13 | 91 | FOR INVENTION EXAMPLE |
| 64 | 1 | 6 | 80 | 14 | 97 | FOR INVENTION EXAMPLE |
| 65 | 1 | 6 | 79 | 15 | 97 | FOR INVENTION EXAMPLE |
| 66 | 2 | 70 | 29 | 1 | 11 | FOR COMPARATIVE EXAMPLE |
| 67 | 3 | 11 | 79 | 10 | 90 | FOR INVENTION EXAMPLE |
| 68 | 4 | 6 | 79 | 15 | 97 | FOR INVENTION EXAMPLE |
| 69 | 5 | 10 | 80 | 10 | 91 | FOR INVENTION EXAMPLE |
| 70 | 6 | 3 | 83 | 14 | 9 | FOR COMPARATIVE EXAMPLE |
| 71 | 7 | 70 | 29 | 1 | 11 | FOR COMPARATIVE EXAMPLE |
| 72 | 8 | 10 | 80 | 10 | 90 | FOR INVENTION EXAMPLE |
| 73 | 9 | 6 | 79 | 15 | 97 | FOR INVENTION EXAMPLE |
| 74 | 10 | 10 | 80 | 10 | 91 | FOR INVENTION EXAMPLE |
| 75 | 11 | 70 | 29 | 1 | 9 | FOR COMPARATIVE EXAMPLE |
| 76 | 12 | 70 | 29 | 1 | 11 | FOR COMPARATIVE EXAMPLE |
| 77 | 13 | 10 | 80 | 10 | 90 | FOR INVENTION EXAMPLE |
| 78 | 14 | 6 | 79 | 15 | 97 | FOR INVENTION EXAMPLE |
| 79 | 15 | 10 | 80 | 10 | 91 | FOR INVENTION EXAMPLE |
| 80 | 16 | 70 | 29 | 1 | 9 | FOR COMPARATIVE EXAMPLE |

TABLE 14

| MANUFACTURE No. | STEEL No. | PF | BF-tM | RETAINED γ | RETAINED γ GRAIN IN PREDETERMINED FORM | NOTE |
|---|---|---|---|---|---|---|
| | | METAL STRUCTURE OF INTERMEDIATE STEEL SHEET | | | | |
| 81 | 17 | 6 | 79 | 15 | 97 | FOR INVENTION EXAMPLE |
| 82 | 18 | 70 | 29 | 1 | 11 | FOR COMPARATIVE EXAMPLE |
| 83 | 19 | 6 | 79 | 15 | 97 | FOR INVENTION EXAMPLE |
| 84 | 20 | 10 | 80 | 10 | 91 | FOR INVENTION EXAMPLE |
| 85 | 21 | 3 | 83 | 14 | 9 | FOR COMPARATIVE EXAMPLE |
| 86 | 22 | 6 | 79 | 15 | 97 | FOR INVENTION EXAMPLE |
| 87 | 23 | 3 | 83 | 14 | 9 | FOR COMPARATIVE EXAMPLE |
| 88 | 24 | 10 | 80 | 10 | 90 | FOR INVENTION EXAMPLE |
| 89 | 25 | 6 | 79 | 15 | 97 | FOR INVENTION EXAMPLE |
| 90 | 26 | 70 | 29 | 1 | 9 | FOR COMPARATIVE EXAMPLE |
| 91 | 27 | 6 | 79 | 15 | 97 | FOR INVENTION EXAMPLE |
| 92 | 28 | 6 | 79 | 15 | 97 | FOR INVENTION EXAMPLE |
| 93 | 29 | 10 | 80 | 10 | 90 | FOR INVENTION EXAMPLE |
| 94 | 30 | 10 | 80 | 10 | 91 | FOR INVENTION EXAMPLE |
| 95 | 31 | 6 | 79 | 15 | 97 | FOR INVENTION EXAMPLE |
| 96 | 32 | 10 | 80 | 10 | 91 | FOR INVENTION EXAMPLE |
| 97 | 33 | 70 | 29 | 1 | 9 | FOR COMPARATIVE EXAMPLE |
| 98 | 34 | 10 | 80 | 10 | 91 | FOR INVENTION EXAMPLE |
| 99 | 35 | 6 | 79 | 15 | 97 | FOR INVENTION EXAMPLE |
| 100 | 36 | 10 | 80 | 10 | 91 | FOR INVENTION EXAMPLE |
| 101 | 37 | 70 | 29 | 1 | 9 | FOR COMPARATIVE EXAMPLE |
| 102 | 38 | 10 | 80 | 10 | 90 | FOR INVENTION EXAMPLE |
| 103 | 39 | 6 | 79 | 15 | 97 | FOR INVENTION EXAMPLE |
| 104 | 40 | 10 | 80 | 10 | 91 | FOR INVENTION EXAMPLE |
| 105 | 41 | 70 | 29 | 1 | 9 | FOR COMPARATIVE EXAMPLE |
| 106 | 42 | 10 | 80 | 10 | 90 | FOR INVENTION EXAMPLE |
| 107 | 43 | 6 | 79 | 15 | 97 | FOR INVENTION EXAMPLE |
| 108 | 44 | 10 | 80 | 10 | 91 | FOR INVENTION EXAMPLE |
| 109 | 45 | 70 | 29 | 1 | 9 | FOR COMPARATIVE EXAMPLE |
| 110 | 46 | 10 | 80 | 10 | 90 | FOR INVENTION EXAMPLE |
| 111 | 47 | 6 | 79 | 15 | 97 | FOR INVENTION EXAMPLE |
| 112 | 48 | 10 | 80 | 10 | 91 | FOR INVENTION EXAMPLE |
| 113 | 49 | 70 | 29 | 1 | 9 | FOR COMPARATIVE EXAMPLE |
| 114 | 50 | 10 | 80 | 10 | 91 | FOR INVENTION EXAMPLE |
| 115 | 51 | 6 | 79 | 15 | 97 | FOR INVENTION EXAMPLE |
| 116 | 52 | 10 | 80 | 10 | 91 | FOR INVENTION EXAMPLE |
| 117 | 53 | 70 | 29 | 1 | 9 | FOR COMPARATIVE EXAMPLE |
| 118 | 54 | 10 | 80 | 10 | 91 | FOR INVENTION EXAMPLE |
| 119 | 55 | 6 | 79 | 15 | 97 | FOR INVENTION EXAMPLE |
| 120 | 56 | 10 | 80 | 10 | 91 | FOR INVENTION EXAMPLE |

TABLE 15

| MANUFACTURE No. | STEEL No. | PF | BF-tM | RETAINED γ | RETAINED γ GRAIN IN PREDETERMINED FORM | NOTE |
|---|---|---|---|---|---|---|
| | | METAL STRUCTURE OF INTERMEDIATE STEEL SHEET | | | | |
| 121 | 57 | 3 | 83 | 14 | 9 | FOR COMPARATIVE EXAMPLE |
| 122 | 58 | 10 | 80 | 10 | 91 | FOR INVENTION EXAMPLE |
| 123 | 59 | 6 | 79 | 15 | 97 | FOR INVENTION EXAMPLE |
| 124 | 60 | 10 | 80 | 10 | 91 | FOR INVENTION EXAMPLE |
| 125 | 61 | 3 | 83 | 14 | 9 | FOR COMPARATIVE EXAMPLE |
| 126 | 62 | 10 | 80 | 10 | 91 | FOR INVENTION EXAMPLE |
| 127 | 63 | 6 | 79 | 15 | 97 | FOR INVENTION EXAMPLE |
| 128 | 64 | 10 | 80 | 10 | 91 | FOR INVENTION EXAMPLE |
| 129 | 65 | 3 | 83 | 14 | 9 | FOR COMPARATIVE EXAMPLE |
| 130 | 66 | 6 | 79 | 15 | 97 | FOR INVENTION EXAMPLE |
| 131 | 67 | 6 | 79 | 15 | 95 | FOR INVENTION EXAMPLE |
| 132 | 68 | 6 | 79 | 15 | 96 | FOR INVENTION EXAMPLE |
| 133 | 69 | 6 | 79 | 15 | 97 | FOR INVENTION EXAMPLE |
| 134 | 70 | 6 | 79 | 15 | 97 | FOR INVENTION EXAMPLE |
| 135 | 71 | 6 | 79 | 15 | 98 | FOR INVENTION EXAMPLE |
| 136 | 72 | 6 | 79 | 15 | 98 | FOR INVENTION EXAMPLE |
| 137 | 73 | 6 | 79 | 15 | 98 | FOR INVENTION EXAMPLE |
| 138 | 74 | 6 | 79 | 15 | 96 | FOR INVENTION EXAMPLE |
| 139 | 75 | 6 | 79 | 15 | 96 | FOR INVENTION EXAMPLE |
| 140 | 76 | 6 | 79 | 15 | 97 | FOR INVENTION EXAMPLE |
| 141 | 77 | 6 | 79 | 15 | 97 | FOR INVENTION EXAMPLE |
| 142 | 78 | 6 | 79 | 15 | 98 | FOR INVENTION EXAMPLE |
| 143 | 79 | 6 | 79 | 15 | 98 | FOR INVENTION EXAMPLE |
| 144 | 80 | 6 | 79 | 15 | 97 | FOR INVENTION EXAMPLE |
| 145 | 81 | 6 | 79 | 15 | 97 | FOR INVENTION EXAMPLE |
| 146 | 82 | 6 | 79 | 15 | 97 | FOR INVENTION EXAMPLE |
| 147 | 83 | 6 | 79 | 15 | 97 | FOR INVENTION EXAMPLE |
| 148 | 84 | 6 | 79 | 15 | 97 | FOR INVENTION EXAMPLE |
| 149 | 85 | 6 | 79 | 15 | 97 | FOR INVENTION EXAMPLE |
| 150 | 86 | 6 | 79 | 15 | 97 | FOR INVENTION EXAMPLE |
| 151 | 87 | 6 | 79 | 15 | 97 | FOR INVENTION EXAMPLE |
| 152 | 1 | 6 | 79 | 15 | 97 | FOR COMPARATIVE EXAMPLE |

Thereafter, under the conditions illustrated in Table 16 to Table 19, second annealing of the intermediate steel sheets was performed to obtain steel sheet samples. In Manufacture No. 150 and No. 151, after the second annealing, a plating treatment was performed, and in Manufacture No. 151, after the plating treatment, an alloying treatment was performed. As the plating treatment, a hot-dip galvanizing treatment was performed, and the temperature of the alloying treatment was set to 500° C. Each underline in Table 16 to Table 19 indicates that a corresponding numerical value is out of the range suitable for manufacturing the steel sheet according to the present invention.

TABLE 16

| MANUFACTURE No. | SECOND ANNEALING | | | | |
|---|---|---|---|---|---|
| | ANNEALING TEMPERATURE (° C.) | THIRD COOLING | | SECOND RETENTION | |
| | | STOPPING TEMPERATURE (° C.) | COOLING RATE (° C./SECOND) | TEMPERATURE (° C.) | TIME (SECOND) |
| 1 | 780 | 680 | 3 | 400 | 375 |
| 2 | 780 | 680 | 3 | 400 | 375 |
| 3 | 780 | 680 | 3 | 400 | 375 |
| 4 | 780 | 680 | 3 | 400 | 375 |
| 5 | 780 | 680 | 3 | 400 | 375 |
| 6 | 780 | 680 | 3 | 400 | 375 |
| 7 | 780 | 680 | 3 | 400 | 375 |
| 8 | 780 | 680 | 3 | 400 | 375 |
| 9 | 780 | 680 | 3 | 400 | 375 |
| 10 | 780 | 680 | 3 | 400 | 375 |
| 11 | 780 | 680 | 3 | 400 | 375 |
| 12 | 780 | 680 | 3 | 400 | 375 |
| 13 | 780 | 680 | 3 | 400 | 375 |
| 14 | 780 | 680 | 3 | 400 | 375 |
| 15 | 780 | 680 | 3 | 400 | 375 |
| 16 | 780 | 680 | 3 | 400 | 375 |
| 17 | 780 | 680 | 3 | 400 | 375 |

TABLE 16-continued

| | | | | | |
|---|---|---|---|---|---|
| 18 | 780 | 680 | 3 | 400 | 375 |
| 19 | 780 | 680 | 3 | 400 | 375 |
| 20 | 780 | 680 | 3 | 400 | 375 |
| 21 | 780 | 680 | 3 | 400 | 375 |
| 22 | 780 | 680 | 3 | 400 | 375 |
| 23 | 780 | 680 | 3 | 400 | 375 |
| 24 | 780 | 630 | 3 | 400 | 375 |
| 25 | 780 | 680 | 3 | 400 | 375 |
| 26 | 780 | 680 | 3 | 400 | 375 |
| 27 | 780 | 680 | 3 | 400 | 375 |
| 28 | 780 | 680 | 3 | 400 | 375 |
| 29 | 780 | 680 | 3 | 400 | 375 |
| 30 | 780 | 680 | 3 | 400 | 375 |
| 31 | 780 | 680 | 3 | 400 | 375 |
| 32 | 780 | 680 | 3 | 400 | 375 |
| 33 | 780 | 680 | 3 | 400 | 375 |
| 34 | 780 | 680 | 3 | 400 | 375 |
| 35 | 780 | 680 | 3 | 400 | 375 |
| 36 | 780 | 680 | 3 | 400 | 375 |
| 37 | 780 | 680 | 3 | 400 | 375 |
| 38 | 780 | 680 | 3 | 400 | 375 |
| 39 | 780 | 630 | 3 | 400 | 375 |
| 40 | 780 | 680 | 3 | 400 | 375 |

| | PLATING | | |
|---|---|---|---|
| MANUFACTURE No. | PRESENCE/ ABSENCE OF PLATING | PRESENCE/ ABSENCE OF ALLOYING | NOTE |
| 1 | ABSENCE | ABSENCE | FOR INVENTION EXAMPLE |
| 2 | ABSENCE | ABSENCE | FOR COMPARATIVE EXAMPLE |
| 3 | ABSENCE | ABSENCE | FOR COMPARATIVE EXAMPLE |
| 4 | ABSENCE | ABSENCE | FOR INVENTION EXAMPLE |
| 5 | ABSENCE | ABSENCE | FOR COMPARATIVE EXAMPLE |
| 6 | ABSENCE | ABSENCE | FOR COMPARATIVE EXAMPLE |
| 7 | ABSENCE | ABSENCE | FOR INVENTION EXAMPLE |
| 8 | ABSENCE | ABSENCE | FOR COMPARATIVE EXAMPLE |
| 9 | ABSENCE | ABSENCE | FOR INVENTION EXAMPLE |
| 10 | ABSENCE | ABSENCE | FOR INVENTION EXAMPLE |
| 11 | ABSENCE | ABSENCE | FOR INVENTION EXAMPLE |
| 12 | ABSENCE | ABSENCE | FOR COMPARATIVE EXAMPLE |
| 13 | ABSENCE | ABSENCE | FOR COMPARATIVE EXAMPLE |
| 14 | ABSENCE | ABSENCE | FOR INVENTION EXAMPLE |
| 15 | ABSENCE | ABSENCE | FOR INVENTION EXAMPLE |
| 16 | ABSENCE | ABSENCE | FOR INVENTION EXAMPLE |
| 17 | ABSENCE | ABSENCE | FOR COMPARATIVE EXAMPLE |
| 18 | ABSENCE | ABSENCE | FOR COMPARATIVE EXAMPLE |
| 19 | ABSENCE | ABSENCE | FOR INVENTION EXAMPLE |
| 20 | ABSENCE | ABSENCE | FOR INVENTION EXAMPLE |
| 21 | ABSENCE | ABSENCE | FOR INVENTION EXAMPLE |
| 22 | ABSENCE | ABSENCE | FOR INVENTION EXAMPLE |
| 23 | ABSENCE | ABSENCE | FOR COMPARATIVE EXAMPLE |
| 24 | ABSENCE | ABSENCE | FOR COMPARATIVE EXAMPLE |
| 25 | ABSENCE | ABSENCE | FOR INVENTION EXAMPLE |
| 26 | ABSENCE | ABSENCE | FOR COMPARATIVE EXAMPLE |
| 27 | ABSENCE | ABSENCE | FOR COMPARATIVE EXAMPLE |
| 28 | ABSENCE | ABSENCE | FOR INVENTION EXAMPLE |
| 29 | ABSENCE | ABSENCE | FOR COMPARATIVE EXAMPLE |
| 30 | ABSENCE | ABSENCE | FOR COMPARATIVE EXAMPLE |
| 31 | ABSENCE | ABSENCE | FOR INVENTION EXAMPLE |
| 32 | ABSENCE | ABSENCE | FOR INVENTION EXAMPLE |
| 33 | ABSENCE | ABSENCE | FOR COMPARATIVE EXAMPLE |
| 34 | ABSENCE | ABSENCE | FOR COMPARATIVE EXAMPLE |
| 35 | ABSENCE | ABSENCE | FOR INVENTION EXAMPLE |
| 36 | ABSENCE | ABSENCE | FOR COMPARATIVE EXAMPLE |
| 37 | ABSENCE | ABSENCE | FOR COMPARATIVE EXAMPLE |
| 38 | ABSENCE | ABSENCE | FOR INVENTION EXAMPLE |
| 39 | ABSENCE | ABSENCE | FOR INVENTION EXAMPLE |
| 40 | ABSENCE | ABSENCE | FOR COMPARATIVE EXAMPLE |

TABLE 17

| | SECOND ANNEALING | | | | |
|---|---|---|---|---|---|
| | | THIRD COOLING | | | |
| | ANNEALING | STOPPING | COOLING RATE | SECOND RETENTION | |
| MANUFACTURE No. | TEMPERATURE (° C.) | TEMPERATURE (° C.) | (° C./SECOND) | TEMPERATURE (° C.) | TIME (SECOND) |
| 41 | 780 | 680 | 3 | 400 | 375 |
| 42 | 780 | 680 | 3 | 400 | 375 |
| 43 | 780 | 680 | 3 | 400 | 375 |
| 44 | 740 | 680 | 3 | 400 | 375 |
| 45 | 770 | 680 | 3 | 400 | 375 |
| 46 | 780 | 680 | 3 | 400 | 375 |
| 47 | 800 | 680 | 3 | 400 | 375 |
| 48 | 840 | 680 | 3 | 400 | 375 |
| 49 | 780 | 550 | 3 | 400 | 375 |
| 50 | 780 | 680 | 3 | 400 | 375 |
| 51 | 780 | 760 | 3 | 400 | 375 |
| 52 | 780 | 680 | 0.5 | 400 | 375 |
| 53 | 780 | 680 | 3 | 400 | 375 |
| 54 | 780 | 680 | 45 | 400 | 375 |
| 55 | 780 | 680 | 3 | 110 | 375 |
| 56 | 780 | 680 | 3 | 375 | 375 |
| 57 | 780 | 680 | 3 | 400 | 375 |
| 58 | 780 | 680 | 3 | 425 | 375 |
| 5S | 780 | 680 | 3 | 570 | 375 |
| 60 | 780 | 680 | 3 | 400 | 0.2 |
| 61 | 780 | 680 | 3 | 400 | 375 |
| 62 | 780 | 680 | 3 | 400 | 375 |
| 63 | 780 | 680 | 3 | 400 | 375 |
| 64 | 780 | 680 | 3 | 400 | 375 |
| 65 | 780 | 680 | 3 | 400 | 375 |
| 66 | 780 | 680 | 3 | 400 | 375 |
| 67 | 780 | 680 | 3 | 400 | 375 |
| 68 | 780 | 680 | 3 | 400 | 375 |
| 69 | 780 | 680 | 3 | 400 | 375 |
| 70 | 780 | 680 | 3 | 400 | 375 |
| 71 | 780 | 680 | 3 | 400 | 375 |
| 72 | 780 | 680 | 3 | 400 | 375 |
| 73 | 780 | 680 | 3 | 400 | 375 |
| 74 | 780 | 680 | 3 | 400 | 375 |
| 75 | 780 | 680 | 3 | 400 | 375 |
| 76 | 780 | 680 | 3 | 400 | 375 |
| 77 | 780 | 680 | 3 | 400 | 375 |
| 78 | 780 | 680 | 3 | 400 | 375 |
| 79 | 780 | 680 | 3 | 400 | 375 |
| 80 | 780 | 680 | 3 | 400 | 375 |

| | PLATING | | |
|---|---|---|---|
| MANUFACTURE No. | PRESENCE/ABSENCE OF PLATING | PRESENCE/ABSENCE OF ALLOYING | NOTE |
| 41 | ABSENCE | ABSENCE | FOR COMPARATIVE EXAMPLE |
| 42 | ABSENCE | ABSENCE | FOR INVENTION EXAMPLE |
| 43 | ABSENCE | ABSENCE | FOR COMPARATIVE EXAMPLE |
| 44 | ABSENCE | ABSENCE | FOR COMPARATIVE EXAMPLE |
| 45 | ABSENCE | ABSENCE | FOR INVENTION EXAMPLE |
| 46 | ABSENCE | ABSENCE | FOR INVENTION EXAMPLE |
| 47 | ABSENCE | ABSENCE | FOR INVENTION EXAMPLE |
| 48 | ABSENCE | ABSENCE | FOR COMPARATIVE EXAMPLE |
| 49 | ABSENCE | ABSENCE | FOR COMPARATIVE EXAMPLE |
| 50 | ABSENCE | ABSENCE | FOR INVENTION EXAMPLE |
| 51 | ABSENCE | ABSENCE | FOR COMPARATIVE EXAMPLE |
| 52 | ABSENCE | ABSENCE | FOR COMPARATIVE EXAMPLE |
| 53 | ABSENCE | ABSENCE | FOR INVENTION EXAMPLE |
| 54 | ABSENCE | ABSENCE | FOR COMPARATIVE EXAMPLE |
| 55 | ABSENCE | ABSENCE | FOR COMPARATIVE EXAMPLE |
| 56 | ABSENCE | ABSENCE | FOR INVENTION EXAMPLE |
| 57 | ABSENCE | ABSENCE | FOR INVENTION EXAMPLE |
| 58 | ABSENCE | ABSENCE | FOR INVENTION EXAMPLE |
| 5S | ABSENCE | ABSENCE | FOR COMPARATIVE EXAMPLE |
| 60 | ABSENCE | ABSENCE | FOR COMPARATIVE EXAMPLE |
| 61 | ABSENCE | ABSENCE | FOR INVENTION EXAMPLE |
| 62 | ABSENCE | ABSENCE | FOR INVENTION EXAMPLE |

TABLE 17-continued

| | | | |
|---|---|---|---|
| 63 | ABSENCE | ABSENCE | FOR INVENTION EXAMPLE |
| 64 | ABSENCE | ABSENCE | FOR INVENTION EXAMPLE |
| 65 | ABSENCE | ABSENCE | FOR INVENTION EXAMPLE |
| 66 | ABSENCE | ABSENCE | FOR COMPARATIVE EXAMPLE |
| 67 | ABSENCE | ABSENCE | FOR INVENTION EXAMPLE |
| 68 | ABSENCE | ABSENCE | FOR INVENTION EXAMPLE |
| 69 | ABSENCE | ABSENCE | FOR INVENTION EXAMPLE |
| 70 | ABSENCE | ABSENCE | FOR COMPARATIVE EXAMPLE |
| 71 | ABSENCE | ABSENCE | FOR COMPARATIVE EXAMPLE |
| 72 | ABSENCE | ABSENCE | FOR INVENTION EXAMPLE |
| 73 | ABSENCE | ABSENCE | FOR INVENTION EXAMPLE |
| 74 | ABSENCE | ABSENCE | FOR INVENTION EXAMPLE |
| 75 | ABSENCE | ABSENCE | FOR COMPARATIVE EXAMPLE |
| 76 | ABSENCE | ABSENCE | FOR COMPARATIVE EXAMPLE |
| 77 | ABSENCE | ABSENCE | FOR INVENTION EXAMPLE |
| 78 | ABSENCE | ABSENCE | FOR INVENTION EXAMPLE |
| 79 | ABSENCE | ABSENCE | FOR INVENTION EXAMPLE |
| 80 | ABSENCE | ABSENCE | FOR COMPARATIVE EXAMPLE |

TABLE 18

| | SECOND ANNEALING | | | | |
|---|---|---|---|---|---|
| | | THIRD COOLING | | | |
| | ANNEALING | STOPPING | COOLING RATE | SECOND RETENTION | |
| MANUFACTURE No. | TEMPERATURE (° C.) | TEMPERATURE (° C.) | (° C./SECOND) | TEMPERATURE (° C.) | TIME (SECOND) |
| 81 | 780 | 680 | 3 | 400 | 375 |
| 82 | 780 | 680 | 3 | 400 | 375 |
| 83 | 780 | 680 | 3 | 400 | 375 |
| 84 | 780 | 680 | 3 | 400 | 375 |
| 85 | 780 | 680 | 3 | 400 | 375 |
| 86 | 780 | 680 | 3 | 400 | 375 |
| 87 | 780 | 680 | 3 | 400 | 375 |
| 88 | 780 | 680 | 3 | 400 | 375 |
| 89 | 780 | 680 | 3 | 400 | 375 |
| 90 | 780 | 680 | 3 | 400 | 375 |
| 91 | 800 | 680 | 3 | 400 | 375 |
| 92 | 800 | 680 | 3 | 400 | 375 |
| 93 | 800 | 680 | 3 | 400 | 375 |
| 94 | 800 | 680 | 3 | 400 | 375 |
| 95 | 800 | 680 | 3 | 400 | 375 |
| 96 | 800 | 680 | 3 | 400 | 375 |
| 97 | 800 | 680 | 3 | 400 | 375 |
| 98 | 800 | 680 | 3 | 400 | 375 |
| 99 | 800 | 680 | 3 | 400 | 375 |
| 100 | 800 | 680 | 3 | 400 | 375 |
| 101 | 800 | 680 | 3 | 400 | 375 |
| 102 | 800 | 680 | 3 | 400 | 375 |
| 103 | 800 | 680 | 3 | 400 | 375 |
| 104 | 800 | 680 | 3 | 400 | 375 |
| 105 | 800 | 680 | 3 | 400 | 375 |
| 106 | 800 | 680 | 3 | 400 | 375 |
| 107 | 800 | 680 | 3 | 400 | 375 |
| 108 | 800 | 680 | 3 | 400 | 375 |
| 109 | 800 | 680 | 3 | 400 | 375 |
| 110 | 800 | 680 | 3 | 400 | 375 |
| 111 | 800 | 680 | 3 | 400 | 375 |
| 112 | 800 | 680 | 3 | 400 | 375 |
| 113 | 800 | 680 | 3 | 400 | 375 |
| 114 | 800 | 680 | 3 | 400 | 375 |
| 115 | 800 | 680 | 3 | 400 | 375 |
| 116 | 800 | 680 | 3 | 400 | 375 |
| 117 | 800 | 680 | 3 | 400 | 375 |

TABLE 18-continued

| | | | | | |
|---|---|---|---|---|---|
| 118 | 800 | 680 | 3 | 400 | 375 |
| 119 | 800 | 680 | 3 | 400 | 375 |
| 120 | 800 | 680 | 3 | 400 | 375 |

| | PLATING | | |
|---|---|---|---|
| MANUFACTURE No. | PRESENCE/ ABSENCE OF PLATING | PRESENCE/ ABSENCE OF ALLOYING | NOTE |
| 81 | ABSENCE | ABSENCE | FOR INVENTION EXAMPLE |
| 82 | ABSENCE | ABSENCE | FOR COMPARATIVE EXAMPLE |
| 83 | ABSENCE | ABSENCE | FOR INVENTION EXAMPLE |
| 84 | ABSENCE | ABSENCE | FOR INVENTION EXAMPLE |
| 85 | ABSENCE | ABSENCE | FOR COMPARATIVE EXAMPLE |
| 86 | ABSENCE | ABSENCE | FOR INVENTION EXAMPLE |
| 87 | ABSENCE | ABSENCE | FOR COMPARATIVE EXAMPLE |
| 88 | ABSENCE | ABSENCE | FOR INVENTION EXAMPLE |
| 89 | ABSENCE | ABSENCE | FOR INVENTION EXAMPLE |
| 90 | ABSENCE | ABSENCE | FOR COMPARATIVE EXAMPLE |
| 91 | ABSENCE | ABSENCE | FOR INVENTION EXAMPLE |
| 92 | ABSENCE | ABSENCE | FOR INVENTION EXAMPLE |
| 93 | ABSENCE | ABSENCE | FOR INVENTION EXAMPLE |
| 94 | ABSENCE | ABSENCE | FOR INVENTION EXAMPLE |
| 95 | ABSENCE | ABSENCE | FOR INVENTION EXAMPLE |
| 96 | ABSENCE | ABSENCE | FOR INVENTION EXAMPLE |
| 97 | ABSENCE | ABSENCE | FOR COMPARATIVE EXAMPLE |
| 98 | ABSENCE | ABSENCE | FOR INVENTION EXAMPLE |
| 99 | ABSENCE | ABSENCE | FOR INVENTION EXAMPLE |
| 100 | ABSENCE | ABSENCE | FOR INVENTION EXAMPLE |
| 101 | ABSENCE | ABSENCE | FOR COMPARATIVE EXAMPLE |
| 102 | ABSENCE | ABSENCE | FOR INVENTION EXAMPLE |
| 103 | ABSENCE | ABSENCE | FOR INVENTION EXAMPLE |
| 104 | ABSENCE | ABSENCE | FOR INVENTION EXAMPLE |
| 105 | ABSENCE | ABSENCE | FOR COMPARATIVE EXAMPLE |
| 106 | ABSENCE | ABSENCE | FOR INVENTION EXAMPLE |
| 107 | ABSENCE | ABSENCE | FOR INVENTION EXAMPLE |
| 108 | ABSENCE | ABSENCE | FOR INVENTION EXAMPLE |
| 109 | ABSENCE | ABSENCE | FOR COMPARATIVE EXAMPLE |
| 110 | ABSENCE | ABSENCE | FOR INVENTION EXAMPLE |
| 111 | ABSENCE | ABSENCE | FOR INVENTION EXAMPLE |
| 112 | ABSENCE | ABSENCE | FOR INVENTION EXAMPLE |
| 113 | ABSENCE | ABSENCE | FOR COMPARATIVE EXAMPLE |
| 114 | ABSENCE | ABSENCE | FOR INVENTION EXAMPLE |
| 115 | ABSENCE | ABSENCE | FOR INVENTION EXAMPLE |
| 116 | ABSENCE | ABSENCE | FOR INVENTION EXAMPLE |
| 117 | ABSENCE | ABSENCE | FOR COMPARATIVE EXAMPLE |
| 118 | ABSENCE | ABSENCE | FOR INVENTION EIXAMPLE |
| 119 | ABSENCE | ABSENCE | FOR INVENTION EXAMPLE |
| 120 | ABSENCE | ABSENCE | FOR INVENTION EXAMPLE |

TABLE 19

| | SECOND ANNEALING | | | | |
|---|---|---|---|---|---|
| | | THIRD COOLING | | | |
| | ANNEALING | STOPPING | COOLING RATE | SECOND RETENTION | |
| MANUFACTURE No. | TEMPERATURE (° C.) | TEMPERATURE (° C.) | (° C./ SECOND) | TEMPERATURE (° C.) | TIME (SECOND) |
| 121 | 800 | 680 | 3 | 400 | 375 |
| 122 | 800 | 680 | 3 | 400 | 375 |
| 123 | 800 | 680 | 3 | 400 | 375 |
| 124 | 800 | 680 | 3 | 400 | 375 |
| 125 | 800 | 680 | 3 | 400 | 375 |
| 126 | 800 | 680 | 3 | 400 | 375 |
| 127 | 800 | 680 | 3 | 400 | 375 |
| 128 | 800 | 680 | 3 | 400 | 375 |
| 129 | 800 | 680 | 3 | 400 | 375 |
| 130 | 780 | 680 | 3 | 400 | 375 |
| 131 | 780 | 680 | 3 | 400 | 375 |
| 132 | 780 | 680 | 3 | 400 | 375 |
| 133 | 780 | 680 | 3 | 400 | 375 |

TABLE 19-continued

| | | | | | |
|---|---|---|---|---|---|
| 134 | 780 | 680 | 3 | 400 | 375 |
| 135 | 780 | 680 | 3 | 400 | 375 |
| 136 | 760 | 680 | 3 | 400 | 375 |
| 137 | 780 | 680 | 3 | 400 | 375 |
| 138 | 780 | 680 | 3 | 400 | 375 |
| 139 | 780 | 680 | 3 | 400 | 375 |
| 140 | 780 | 680 | 3 | 400 | 375 |
| 141 | 780 | 680 | 3 | 400 | 375 |
| 142 | 780 | 680 | 3 | 400 | 375 |
| 143 | 780 | 680 | 3 | 400 | 375 |
| 144 | 780 | 680 | 3 | 400 | 375 |
| 145 | 780 | 680 | 3 | 400 | 375 |
| 146 | 780 | 680 | 3 | 400 | 375 |
| 147 | 780 | 680 | 3 | 400 | 375 |
| 148 | 780 | 680 | 3 | 400 | 375 |
| 149 | 780 | 680 | 3 | 400 | 375 |
| 150 | 780 | 680 | 3 | 400 | 375 |
| 151 | 780 | 680 | 3 | 400 | 375 |
| 152 | NOT PERFORMED | | | | |

| | PLATING | | |
|---|---|---|---|
| MANUFACTURE No. | PRESENCE/ ABSENCE OF PLATING | PRESENCE/ ABSENCE OF ALLOYING | NOTE |
| 121 | ABSENCE | ABSENCE | FOR COMPARATIVE EXAMPLE |
| 122 | ABSENCE | ABSENCE | FOR INVENTION EXAMPLE |
| 123 | ABSENCE | ABSENCE | FOR INVENTION EXAMPLE |
| 124 | ABSENCE | ABSENCE | FOR INVENTION EXAMPLE |
| 125 | ABSENCE | ABSENCE | FOR COMPARATIVE EXAMPLE |
| 126 | ABSENCE | ABSENCE | FOR INVENTION EXAMPLE |
| 127 | ABSENCE | ABSENCE | FOR INVENTION EXAMPLE |
| 128 | ABSENCE | ABSENCE | FOR INVENTION EXAMPLE |
| 129 | ABSENCE | ABSENCE | FOR COMPARATIVE EXAMPLE |
| 130 | ABSENCE | ABSENCE | FOR INVENTION EXAMPLE |
| 131 | ABSENCE | ABSENCE | FOR INVENTION EXAMPLE |
| 132 | ABSENCE | ABSENCE | FOR INVENTION EXAMPLE |
| 133 | ABSENCE | ABSENCE | FOR INVENTION EXAMPLE |
| 134 | ABSENCE | ABSENCE | FOR INVENTION EXAMPLE |
| 135 | ABSENCE | ABSENCE | FOR INVENTION EXAMPLE |
| 136 | ABSENCE | ABSENCE | FOR INVENTION EXAMPLE |
| 137 | ABSENCE | ABSENCE | FOR INVENTION EXAMPLE |
| 138 | ABSENCE | ABSENCE | FOR INVENTION EXAMPLE |
| 139 | ABSENCE | ABSENCE | FOR INVENTION EXAMPLE |
| 140 | ABSENCE | ABSENCE | FOR INVENTION EXAMPLE |
| 141 | ABSENCE | ABSENCE | FOR INVENTION EXAMPLE |
| 142 | ABSENCE | ABSENCE | FOR INVENTION EXAMPLE |
| 143 | ABSENCE | ABSENCE | FOR INVENTION EXAMPLE |
| 144 | ABSENCE | ABSENCE | FOR INVENTION EXAMPLE |
| 145 | ABSENCE | ABSENCE | FOR INVENTION EXAMPLE |
| 146 | ABSENCE | ABSENCE | FOR INVENTION EXAMPLE |
| 147 | ABSENCE | ABSENCE | FOR INVENTION EXAMPLE |
| 148 | ABSENCE | ABSENCE | FOR INVENTION EXAMPLE |
| 149 | ABSENCE | ABSENCE | FOR INVENTION EXAMPLE |
| 150 | PRESENCE | ABSENCE | FOR INVENTION EXAMPLE |
| 151 | PRESENCE | PRESENCE | FOR INVENTION EXAMPLE |
| 152 | ABSENCE | ABSENCE | FOR COMPARATIVE EXAMPLE |

Then, a metal structure of each of the steel sheet samples was observed. In this observation, an area fraction of polygonal ferrite (PF), an area fraction of bainitic ferrite (BF), an area fraction of retained austenite (retained γ), and an area fraction of martensite (M) were measured, and further, an area fraction of retained austenite grains in a predetermined form and an area fraction of bainitic ferrite grains in a predetermined form were calculated from the shapes of retained austenite and bainitic ferrite. These results are illustrated in Table 20 to Table 23. Each underline in Table 20 to Table 23 indicates that a corresponding numerical value is out of the range of the present invention.

TABLE 20

| MANUFACTURE No. | METAL STRUCTURE (%) PF | BF | RETAINED γ | M | RETAINED γ GRAIN IN PREDETERMINED FORM | BF GRAIN IN PREDETERMINED FORM | NOTE |
|---|---|---|---|---|---|---|---|
| 1 | 25 | 57 | 14 | 4 | 88 | 90 | INVENTION EXAMPLE |
| 2 | 80 | 14 | 1 | 5 | 8 | 69 | COMPARATIVE EXAMPLE |
| 3 | 80 | 14 | 1 | 5 | 8 | 69 | COMPARATIVE EXAMPLE |
| 4 | 25 | 57 | 14 | 4 | 88 | 90 | INVENTION EXAMPLE |
| 5 | 7 | 40 | 13 | 40 | 8 | 69 | COMPARATIVE EXAMPLE |
| 6 | 7 | 40 | 13 | 40 | 8 | 69 | COMPARATIVE EXAMPLE |
| 7 | 25 | 57 | 14 | 4 | 88 | 90 | INVENTION EXAMPLE |
| 8 | 80 | 14 | 1 | 5 | 8 | 69 | COMPARATIVE EXAMPLE |
| 9 | 25 | 57 | 14 | 4 | 88 | 90 | INVENTION EXAMPLE |
| 10 | 25 | 57 | 14 | 4 | 88 | 90 | INVENTION EXAMPLE |
| 11 | 18 | 67 | 9 | 6 | 83 | 83 | INVENTION EXAMPLE |
| 12 | 80 | 14 | 1 | 5 | 8 | 69 | COMPARATIVE EXAMPLE |
| 13 | 80 | 14 | 1 | 5 | 8 | 69 | COMPARATIVE EXAMPLE |
| 14 | 18 | 67 | 9 | 6 | 83 | 83 | INVENTION EXAMPLE |
| 15 | 25 | 57 | 14 | 4 | 88 | 90 | INVENTION EXAMPLE |
| 16 | 18 | 67 | 9 | 6 | 83 | 83 | INVENTION EXAMPLE |
| 17 | 80 | 14 | 1 | 5 | 8 | 69 | COMPARATIVE EXAMPLE |
| 18 | 80 | 14 | 1 | 5 | 8 | 69 | COMPARATIVE EXAMPLE |
| 19 | 18 | 67 | 9 | 6 | 83 | 83 | INVENTION EXAMPLE |
| 20 | 25 | 60 | 9 | 6 | 83 | 83 | INVENTION EXAMPLE |
| 21 | 25 | 57 | 14 | 4 | 88 | 90 | INVENTION EXAMPLE |
| 22 | 18 | 67 | 9 | 6 | 83 | 83 | INVENTION EXAMPLE |
| 23 | 80 | 14 | 1 | 5 | 8 | 69 | COMPARATIVE EXAMPLE |
| 24 | 80 | 14 | 1 | 5 | 8 | 69 | COMPARATIVE EXAMPLE |
| 25 | 25 | 57 | 14 | 4 | 88 | 90 | INVENTION EXAMPLE |
| 26 | 80 | 14 | 1 | 5 | 8 | 69 | COMPARATIVE EXAMPLE |
| 27 | 80 | 14 | 1 | 5 | 8 | 69 | COMPARATIVE EXAMPLE |
| 28 | 25 | 57 | 14 | 4 | 88 | 90 | INVENTION EXAMPLE |
| 29 | 80 | 14 | 1 | 5 | 8 | 69 | COMPARATIVE EXAMPLE |
| 30 | 25 | 57 | 14 | 4 | 9 | 90 | COMPARATIVE EXAMPLE |
| 31 | 25 | 57 | 14 | 4 | 88 | 90 | INVENTION EXAMPLE |
| 32 | 18 | 67 | 9 | 6 | 83 | 83 | INVENTION EXAMPLE |
| 33 | 80 | 14 | 1 | 5 | 8 | 69 | COMPARATIVE EXAMPLE |
| 34 | 80 | 14 | 1 | 5 | 8 | 69 | COMPARATIVE EXAMPLE |
| 35 | 25 | 57 | 14 | 4 | 88 | 90 | INVENTION EXAMPLE |
| 36 | 80 | 14 | 1 | 5 | 8 | 69 | COMPARATIVE EXAMPLE |
| 37 | 25 | 57 | 14 | 4 | 9 | 90 | COMPARATIVE EXAMPLE |
| 38 | 25 | 57 | 14 | 4 | 88 | 90 | INVENTION EXAMPLE |
| 39 | 18 | 67 | 9 | 6 | 83 | 83 | INVENTION EXAMPLE |
| 40 | 80 | 14 | 1 | 5 | 8 | 69 | COMPARATIVE EXAMPLE |

TABLE 21

| MANUFACTURE No. | METAL STRUCTURE (%) PF | BF | RETAINED γ | M | RETAINED γ GRAIN IN PREDETERMINED FORM | BF GRAIN IN PREDETERMINED FORM | NOTE |
|---|---|---|---|---|---|---|---|
| 41 | 25 | 57 | 14 | 4 | 9 | 90 | COMPARATIVE EXAMPLE |
| 42 | 25 | 57 | 14 | 4 | 88 | 90 | INVENTION EXAMPLE |
| 43 | 25 | 57 | 14 | 4 | 9 | 90 | COMPARATIVE EXAMPLE |
| 44 | 80 | 14 | 1 | 5 | 8 | 69 | COMPARATIVE EXAMPLE |
| 45 | 18 | 67 | 9 | 6 | 83 | 83 | INVENTION EXAMPLE |
| 46 | 25 | 57 | 14 | 4 | 88 | 90 | INVENTION EXAMPLE |
| 47 | 25 | 60 | 9 | 6 | 83 | 83 | INVENTION EXAMPLE |
| 48 | 80 | 14 | 1 | 5 | 8 | 69 | COMPARATIVE EXAMPLE |
| 49 | 80 | 14 | 1 | 5 | 8 | 69 | COMPARATIVE EXAMPLE |
| 50 | 25 | 57 | 14 | 4 | 88 | 90 | INVENTION EXAMPLE |
| 51 | 80 | 14 | 1 | 5 | 8 | 69 | COMPARATIVE EXAMPLE |
| 52 | 80 | 14 | 1 | 5 | 8 | 69 | COMPARATIVE EXAMPLE |
| 53 | 25 | 57 | 14 | 4 | 88 | 90 | INVENTION EXAMPLE |
| 54 | 80 | 14 | 1 | 5 | 8 | 69 | COMPARATIVE EXAMPLE |
| 55 | 25 | 57 | 14 | 4 | 9 | 90 | COMPARATIVE EXAMPLE |
| 56 | 18 | 67 | 9 | 6 | 83 | 83 | INVENTION EXAMPLE |
| 57 | 25 | 57 | 14 | 4 | 88 | 90 | INVENTION EXAMPLE |
| 58 | 18 | 67 | 9 | 6 | 83 | 83 | INVENTION EXAMPLE |
| 59 | 80 | 14 | 1 | 5 | 8 | 69 | COMPARATIVE EXAMPLE |

TABLE 21-continued

| MANUFACTURE No. | METAL STRUCTURE (%) PF | BF | RETAINED γ | M | RETAINED γ GRAIN IN PREDETERMINED FORM | BF GRAIN IN PREDETERMINED FORM | NOTE |
|---|---|---|---|---|---|---|---|
| 60 | 25 | 57 | 14 | 4 | 9 | 90 | COMPARATIVE EXAMPLE |
| 61 | 25 | 57 | 14 | 4 | 88 | 90 | INVENTION EXAMPLE |
| 62 | 18 | 67 | 9 | 6 | 83 | 83 | INVENTION EXAMPLE |
| 63 | 18 | 64 | 12 | 6 | 83 | 83 | INVENTION EXAMPLE |
| 64 | 25 | 58 | 13 | 4 | 88 | 90 | INVENTION EXAMPLE |
| 65 | 25 | 57 | 14 | 4 | 88 | 90 | INVENTION EXAMPLE |
| 66 | 80 | 14 | 1 | 5 | 10 | 50 | COMPARATIVE EXAMPLE |
| 67 | 18 | 67 | 9 | 6 | 82 | 84 | INVENTION EXAMPLE |
| 68 | 25 | 57 | 14 | 4 | 88 | 90 | INVENTION EXAMPLE |
| 69 | 18 | 67 | 9 | 6 | 83 | 83 | INVENTION EXAMPLE |
| 70 | 7 | 40 | 13 | 40 | 8 | 69 | COMPARATIVE EXAMPLE |
| 71 | 80 | 14 | 1 | 5 | 10 | 50 | COMPARATIVE EXAMPLE |
| 72 | 18 | 67 | 9 | 6 | 82 | 84 | INVENTION EXAMPLE |
| 73 | 25 | 57 | 14 | 4 | 88 | 90 | INVENTION EXAMPLE |
| 74 | 18 | 67 | 9 | 6 | 83 | 83 | INVENTION EXAMPLE |
| 75 | 80 | 14 | 1 | 5 | 8 | 69 | COMPARATIVE EXAMPLE |
| 76 | 80 | 14 | 1 | 5 | 10 | 50 | COMPARATIVE EXAMPLE |
| 77 | 18 | 67 | 9 | 6 | 82 | 84 | INVENTION EXAMPLE |
| 78 | 25 | 57 | 14 | 4 | 88 | 90 | INVENTION EXAMPLE |
| 79 | 18 | 67 | 9 | 6 | 83 | 83 | INVENTION EXAMPLE |
| 80 | 80 | 14 | 1 | 5 | 8 | 69 | COMPARATIVE EXAMPLE |

TABLE 22

| MANUFACTURE No. | METAL STRUCTURE (%) PF | BF | RETAINED γ | M | RETAINED γ GRAIN IN PREDETERMINED FORM | BF GRAIN IN PREDETERMINED FORM | NOTE |
|---|---|---|---|---|---|---|---|
| 81 | 25 | 57 | 14 | 4 | 88 | 90 | INVENTION EXAMPLE |
| 82 | 80 | 14 | 1 | 5 | 10 | 50 | COMPARATIVE EXAMPLE |
| 83 | 25 | 57 | 14 | 4 | 88 | 90 | INVENTION EXAMPLE |
| 84 | 18 | 67 | 9 | 6 | 83 | 83 | INVENTION EXAMPLE |
| 85 | 7 | 40 | 13 | 40 | 8 | 69 | COMPARATIVE EXAMPLE |
| 86 | 25 | 57 | 14 | 4 | 88 | 90 | INVENTION EXAMPLE |
| 87 | 7 | 40 | 13 | 40 | 8 | 69 | COMPARATIVE EXAMPLE |
| 88 | 25 | 60 | 9 | 6 | 82 | 84 | INVENTION EXAMPLE |
| 89 | 18 | 64 | 14 | 4 | 88 | 90 | INVENTION EXAMPLE |
| 90 | 80 | 14 | 1 | 5 | 8 | 69 | COMPARATIVE EXAMPLE |
| 91 | 25 | 57 | 14 | 4 | 88 | 90 | INVENTION EXAMPLE |
| 92 | 25 | 57 | 14 | 4 | 88 | 90 | INVENTION EXAMPLE |
| 93 | 25 | 60 | 9 | 6 | 82 | 84 | INVENTION EXAMPLE |
| 94 | 18 | 67 | 9 | 6 | 83 | 83 | INVENTION EXAMPLE |
| 95 | 25 | 57 | 14 | 4 | 88 | 90 | INVENTION EXAMPLE |
| 96 | 18 | 67 | 9 | 6 | 83 | 83 | INVENTION EXAMPLE |
| 97 | 80 | 14 | 1 | 5 | 8 | 69 | COMPARATIVE EXAMPLE |
| 98 | 18 | 67 | 9 | 6 | 83 | 83 | INVENTION EXAMPLE |
| 99 | 25 | 57 | 14 | 4 | 88 | 90 | INVENTION EXAMPLE |
| 100 | 18 | 67 | 9 | 6 | 83 | 83 | INVENTION EXAMPLE |
| 101 | 80 | 14 | 1 | 5 | 8 | 69 | COMPARATIVE EXAMPLE |
| 102 | 18 | 67 | 9 | 6 | 82 | 84 | INVENTION EXAMPLE |
| 103 | 25 | 57 | 14 | 4 | 88 | 90 | INVENTION EXAMPLE |
| 104 | 18 | 67 | 9 | 6 | 83 | 83 | INVENTION EXAMPLE |
| 105 | 80 | 14 | 1 | 5 | 8 | 69 | COMPARATIVE EXAMPLE |
| 106 | 18 | 67 | 9 | 6 | 82 | 84 | INVENTION EXAMPLE |
| 107 | 25 | 57 | 14 | 4 | 88 | 90 | INVENTION EXAMPLE |
| 108 | 18 | 67 | 9 | 6 | 83 | 83 | INVENTION EXAMPLE |
| 109 | 80 | 14 | 1 | 5 | 8 | 69 | COMPARATIVE EXAMPLE |
| 110 | 18 | 67 | 9 | 6 | 82 | 84 | INVENTION EXAMPLE |
| 111 | 25 | 57 | 14 | 4 | 88 | 90 | INVENTION EXAMPLE |
| 112 | 18 | 67 | 9 | 6 | 83 | 83 | INVENTION EXAMPLE |
| 113 | 80 | 14 | 1 | 5 | 8 | 69 | COMPARATIVE EXAMPLE |
| 114 | 18 | 67 | 9 | 6 | 83 | 83 | INVENTION EXAMPLE |
| 115 | 25 | 57 | 14 | 4 | 88 | 90 | INVENTION EXAMPLE |
| 116 | 18 | 67 | 9 | 6 | 83 | 83 | INVENTION EXAMPLE |
| 117 | 80 | 14 | 1 | 5 | 8 | 69 | COMPARATIVE EXAMPLE |
| 118 | 18 | 67 | 9 | 6 | 83 | 83 | INVENTION EXAMPLE |

TABLE 22-continued

| MANUFACTURE No. | METAL STRUCTURE (%) PF | BF | RETAINED γ | M | RETAINED γ GRAIN IN PREDETERMINED FORM | BF GRAIN IN PREDETERMINED FORM | NOTE |
|---|---|---|---|---|---|---|---|
| 119 | 25 | 57 | 14 | 4 | 88 | 90 | INVENTION EXAMPLE |
| 120 | 18 | 67 | 9 | 6 | 83 | 83 | INVENTION EXAMPLE |

TABLE 23

| MANUFACTURE No. | METAL STRUCTURE (%) PF | BF | RETAINED γ | M | RETAINED γ GRAIN IN PREDETERMINED FORM | BF GRAIN IN PREDETERMINED FORM | NOTE |
|---|---|---|---|---|---|---|---|
| 121 | 7 | 40 | 13 | 40 | 8 | 69 | COMPARATIVE EXAMPLE |
| 122 | 18 | 67 | 9 | 6 | 83 | 83 | INVENTION EXAMPLE |
| 123 | 25 | 57 | 14 | 4 | 88 | 90 | INVENTION EXAMPLE |
| 124 | 18 | 67 | 9 | 6 | 83 | 83 | INVENTION EXAMPLE |
| 125 | 7 | 40 | 13 | 40 | 8 | 69 | COMPARATIVE EXAMPLE |
| 126 | 18 | 67 | 9 | 6 | 83 | 83 | INVENTION EXAMPLE |
| 127 | 25 | 57 | 14 | 4 | 88 | 90 | INVENTION EXAMPLE |
| 128 | 18 | 67 | 9 | 6 | 83 | 83 | INVENTION EXAMPLE |
| 129 | 7 | 40 | 13 | 40 | 8 | 69 | COMPARATIVE EXAMPLE |
| 130 | 25 | 57 | 14 | 4 | 88 | 90 | INVENTION EXAMPLE |
| 131 | 25 | 57 | 14 | 4 | 86 | 90 | INVENTION EXAMPLE |
| 132 | 25 | 57 | 14 | 4 | 87 | 90 | INVENTION EXAMPLE |
| 133 | 25 | 57 | 14 | 4 | 88 | 90 | INVENTION EXAMPLE |
| 134 | 25 | 57 | 14 | 4 | 90 | 90 | INVENTION EXAMPLE |
| 135 | 25 | 57 | 14 | 4 | 90 | 90 | INVENTION EXAMPLE |
| 136 | 25 | 57 | 14 | 4 | 91 | 90 | INVENTION EXAMPLE |
| 137 | 25 | 57 | 14 | 4 | 91 | 90 | INVENTION EXAMPLE |
| 138 | 25 | 57 | 14 | 4 | 86 | 90 | INVENTION EXAMPLE |
| 139 | 25 | 57 | 14 | 4 | 86 | 90 | INVENTION EXAMPLE |
| 140 | 25 | 57 | 14 | 4 | 88 | 90 | INVENTION EXAMPLE |
| 141 | 25 | 57 | 14 | 4 | 88 | 90 | INVENTION EXAMPLE |
| 142 | 25 | 57 | 14 | 4 | 89 | 90 | INVENTION EXAMPLE |
| 143 | 25 | 57 | 14 | 4 | 89 | 90 | INVENTION EXAMPLE |
| 144 | 25 | 57 | 14 | 4 | 88 | 90 | INVENTION EXAMPLE |
| 145 | 25 | 57 | 14 | 4 | 88 | 90 | INVENTION EXAMPLE |
| 146 | 25 | 57 | 14 | 4 | 88 | 90 | INVENTION EXAMPLE |
| 147 | 25 | 57 | 14 | 4 | 88 | 90 | INVENTION EXAMPLE |
| 148 | 25 | 57 | 14 | 4 | 88 | 90 | INVENTION EXAMPLE |
| 149 | 25 | 57 | 14 | 4 | 88 | 90 | INVENTION EXAMPLE |
| 150 | 25 | 57 | 14 | 4 | 88 | 90 | INVENTION EXAMPLE |
| 151 | 25 | 57 | 14 | 4 | 88 | 90 | INVENTION EXAMPLE |
| 152 | 35 | 2 | 3 | 5 | 55 | 41 | COMPARATIVE EXAMPLE |

Then, mechanical properties (total elongation, a 0.2% proof stress, a tensile strength (maximum tensile strength), a hole expansion value, a ratio of a bend radius to a sheet thickness R/t, and a ductile-brittle transition temperature) of the steel sheet samples were measured. When measuring the total elongation, the 0.2% proof stress, and the tensile strength, a JIS No. 5 test piece with the direction vertical to the rolling direction (sheet width direction) set as the longitudinal direction was collected from each of the steel sheet samples to be subjected to a tensile test in conformity with JIS Z 2242. When measuring the hole expansion value, a hole expanding test of JIS Z 2256 was performed. When measuring the ratio R/t, a test of JIS Z 2248 was performed. When measuring the ductile-brittle transition temperature, a test of JIS Z 2242 was performed. These test results are illustrated in Table 24 to Table 27. Each underline in Table 24 to Table 27 indicates that a corresponding numerical value is out of a desirable range.

TABLE 24

| MANUFACTURE No. | MECHANICAL PROPERTIES ELONGATION (%) | 0.2% PROOF STRESS (MPa) | TENSILE STRENGTH (MPa) | HOLE EXPANSION VALUE (%) | RATIO (R/t) | DUCTILE-BRITTLE TRANSITION TEMPERATURE (° C.) | NOTE |
|---|---|---|---|---|---|---|---|
| 1 | 28 | 714 | 1020 | 37 | 0.3 | −70 | INVENTION EXAMPLE |
| 2 | 11 | 938 | 1340 | 12 | 0.9 | −65 | COMPARATIVE EXAMPLE |
| 3 | 11 | 938 | 1340 | 12 | 0.9 | −65 | COMPARATIVE EXAMPLE |
| 4 | 28 | 714 | 1020 | 37 | 0.3 | −70 | INVENTION EXAMPLE |
| 5 | 11 | 938 | 1340 | 12 | 0.9 | −65 | COMPARATIVE EXAMPLE |
| 6 | 11 | 938 | 1340 | 12 | 0.9 | −65 | COMPARATIVE EXAMPLE |
| 7 | 28 | 714 | 1020 | 37 | 0.3 | −70 | INVENTION EXAMPLE |
| 8 | 11 | 938 | 1340 | 12 | 0.9 | −65 | COMPARATIVE EXAMPLE |
| 9 | 28 | 714 | 1020 | 37 | 0.3 | −70 | INVENTION EXAMPLE |
| 10 | 28 | 714 | 1020 | 37 | 0.3 | −70 | INVENTION EXAMPLE |
| 11 | 27 | 756 | 1680 | 32 | 0.5 | −65 | INVENTION EXAMPLE |
| 12 | 11 | 938 | 1340 | 12 | 0.9 | −65 | COMPARATIVE EXAMPLE |
| 13 | 11 | 938 | 1340 | 12 | 0.9 | −65 | COMPARATIVE EXAMPLE |
| 14 | 27 | 756 | 1680 | 32 | 0.5 | −65 | INVENTION EXAMPLE |
| 15 | 28 | 714 | 1020 | 37 | 0.3 | −70 | INVENTION EXAMPLE |
| 16 | 27 | 756 | 1680 | 32 | 0.5 | −65 | INVENTION EXAMPLE |
| 17 | 11 | 938 | 1340 | 12 | 0.9 | −65 | COMPARATIVE EXAMPLE |
| 18 | 11 | 938 | 1340 | 12 | 0.9 | −65 | COMPARATIVE EXAMPLE |
| 19 | 27 | 756 | 1680 | 32 | 0.5 | −65 | INVENTION EXAMPLE |
| 20 | 27 | 756 | 1680 | 32 | 0.5 | −65 | INVENTION EXAMPLE |
| 21 | 28 | 714 | 1020 | 37 | 0.3 | −70 | INVENTION EXAMPLE |
| 22 | 27 | 756 | 1680 | 32 | 0.5 | −65 | INVENTION EXAMPLE |
| 23 | 11 | 938 | 1340 | 12 | 0.9 | −65 | COMPARATIVE EXAMPLE |
| 24 | 11 | 938 | 1340 | 12 | 0.9 | −65 | COMPARATIVE EXAMPLE |
| 25 | 28 | 714 | 1020 | 37 | 0.3 | −70 | INVENTION EXAMPLE |
| 26 | 11 | 938 | 1340 | 12 | 0.9 | −65 | COMPARATIVE EXAMPLE |
| 27 | 11 | 938 | 1340 | 12 | 0.9 | −65 | COMPARATIVE EXAMPLE |
| 28 | 28 | 714 | 1020 | 37 | 0.3 | −70 | INVENTION EXAMPLE |
| 29 | 11 | 938 | 1340 | 12 | 0.9 | −65 | COMPARATIVE EXAMPLE |
| 30 | 15 | 714 | 1020 | 55 | 0.3 | −70 | COMPARATIVE EXAMPLE |
| 31 | 25 | 714 | 1020 | 55 | 0.3 | −70 | INVENTION EXAMPLE |
| 32 | 22 | 756 | 1680 | 51 | 0.5 | −65 | INVENTION EXAMPLE |
| 33 | 9 | 938 | 1340 | 15 | 0.9 | −65 | COMPARATIVE EXAMPLE |
| 34 | 9 | 938 | 1340 | 15 | 0.9 | −65 | COMPARATIVE EXAMPLE |
| 35 | 25 | 714 | 1020 | 55 | 0.3 | −70 | INVENTION EXAMPLE |
| 36 | 9 | 938 | 1340 | 15 | 0.9 | −65 | COMPARATIVE EXAMPLE |
| 37 | 15 | 714 | 1020 | 55 | 0.3 | −70 | COMPARATIVE EXAMPLE |
| 38 | 25 | 714 | 1020 | 55 | 0.3 | −70 | INVENTION EXAMPLE |
| 39 | 22 | 756 | 1680 | 51 | 0.5 | −65 | INVENTION EXAMPLE |
| 40 | 9 | 938 | 1340 | 15 | 0.9 | −65 | COMPARATIVE EXAMPLE |

TABLE 25

| MANUFACTURE No. | MECHANICAL PROPERTIES ELONGATION (%) | 0.2% PROOF STRESS (MPa) | TENSILE STRENGTH (MPa) | HOLE EXPANSION VALUE (%) | RATIO (R/t) | DUCTILE-BRITTLE TRANSITION TEMPERATURE (° C.) | NOTE |
|---|---|---|---|---|---|---|---|
| 41 | 15 | 714 | 1020 | 55 | 0.3 | −70 | COMPARATIVE EXAMPLE |
| 42 | 25 | 714 | 1020 | 55 | 0.3 | −70 | INVENTION EXAMPLE |
| 43 | 15 | 714 | 1020 | 55 | 0.3 | −70 | COMPARATIVE EXAMPLE |
| 44 | 9 | 938 | 1340 | 15 | 0.9 | −65 | COMPARATIVE EXAMPLE |
| 45 | 22 | 756 | 1680 | 51 | 0.5 | −65 | INVENTION EXAMPLE |
| 46 | 25 | 714 | 1020 | 55 | 0.3 | −70 | INVENTION EXAMPLE |
| 47 | 22 | 756 | 1680 | 51 | 0.5 | −65 | INVENTION EXAMPLE |
| 48 | 9 | 938 | 1340 | 15 | 0.9 | −65 | COMPARATIVE EXAMPLE |
| 49 | 9 | 938 | 1340 | 15 | 0.9 | −65 | COMPARATIVE EXAMPLE |
| 50 | 25 | 714 | 1020 | 55 | 0.3 | −70 | INVENTION EXAMPLE |
| 51 | 9 | 938 | 1340 | 15 | 0.9 | −65 | COMPARATIVE EXAMPLE |
| 52 | 9 | 938 | 1340 | 15 | 0.9 | −65 | COMPARATIVE EXAMPLE |
| 53 | 25 | 714 | 1020 | 55 | 0.3 | −70 | INVENTION EXAMPLE |
| 54 | 9 | 938 | 1340 | 15 | 0.9 | −65 | COMPARATIVE EXAMPLE |
| 55 | 15 | 714 | 1020 | 55 | 0.3 | −70 | COMPARATIVE EXAMPLE |
| 56 | 22 | 756 | 1680 | 51 | 0.5 | −65 | INVENTION EXAMPLE |
| 57 | 25 | 714 | 1020 | 55 | 0.3 | −70 | INVENTION EXAMPLE |
| 58 | 22 | 756 | 1680 | 51 | 0.5 | −65 | INVENTION EXAMPLE |
| 59 | 9 | 938 | 1340 | 15 | 0.9 | −65 | COMPARATIVE EXAMPLE |

TABLE 25-continued

| MANUFACTURE No. | MECHANICAL PROPERTIES ELONGATION (%) | 0.2% PROOF STRESS (MPa) | TENSILE STRENGTH (MPa) | HOLE EXPANSION VALUE (%) | RATIO (R/t) | DUCTILE-BRITTLE TRANSITION TEMPERATURE (° C.) | NOTE |
|---|---|---|---|---|---|---|---|
| 60 | 12 | 756 | 1680 | 51 | 0.5 | −65 | COMPARATIVE EXAMPLE |
| 61 | 25 | 714 | 1020 | 55 | 0.3 | −70 | INVENTION EXAMPLE |
| 62 | 22 | 756 | 1680 | 51 | 0.5 | −65 | INVENTION EXAMPLE |
| 63 | 23 | 756 | 1680 | 51 | 0.5 | −65 | INVENTION EXAMPLE |
| 64 | 24 | 714 | 1020 | 55 | 0.3 | −70 | INVENTION EXAMPLE |
| 65 | 25 | 714 | 1020 | 55 | 0.3 | −70 | INVENTION EXAMPLE |
| 66 | 20 | 552 | 788 | 45 | 0.4 | 20 | COMPARATIVE EXAMPLE |
| 67 | 27 | 693 | 990 | 32 | 0.5 | −65 | INVENTION EXAMPLE |
| 68 | 28 | 714 | 1020 | 37 | 0.3 | −70 | INVENTION EXAMPLE |
| 69 | 27 | 756 | 1680 | 32 | 0.5 | −65 | INVENTION EXAMPLE |
| 70 | 11 | 938 | 1340 | 12 | 0.9 | −65 | COMPARATIVE EXAMPLE |
| 71 | 20 | 552 | 788 | 45 | 0.4 | 20 | COMPARATIVE EXAMPLE |
| 72 | 27 | 693 | 990 | 32 | 0.5 | −65 | INVENTION EXAMPLE |
| 73 | 28 | 714 | 1020 | 37 | 0.3 | −70 | INVENTION EXAMPLE |
| 74 | 27 | 756 | 1680 | 32 | 0.5 | −65 | INVENTION EXAMPLE |
| 75 | 11 | 938 | 1340 | 12 | 0.9 | −65 | COMPARATIVE EXAMPLE |
| 76 | 20 | 552 | 788 | 45 | 0.4 | 20 | COMPARATIVE EXAMPLE |
| 77 | 27 | 693 | 990 | 32 | 0.5 | −65 | INVENTION EXAMPLE |
| 78 | 28 | 714 | 1020 | 37 | 0.3 | −70 | INVENTION EXAMPLE |
| 79 | 27 | 756 | 1680 | 32 | 0.5 | −65 | INVENTION EXAMPLE |
| 80 | 11 | 938 | 1340 | 12 | 0.9 | −65 | COMPARATIVE EXAMPLE |

TABLE 26

| MANUFACTURE No. | MECHANICAL PROPERTIES ELONGATION (%) | 0.2% PROOF STRESS (MPa) | TENSILE STRENGTH (MPa) | HOLE EXPANSION VALUE (%) | RATIO (R/t) | DUCTILE-BRITTLE TRANSITION TEMPERATURE (° C.) | NOTE |
|---|---|---|---|---|---|---|---|
| 81 | 28 | 714 | 1020 | 37 | 0.3 | −70 | INVENTION EXAMPLE |
| 82 | 20 | 552 | 788 | 45 | 0.4 | 20 | COMPARATIVE EXAMPLE |
| 83 | 28 | 714 | 1020 | 37 | 0.3 | −70 | INVENTION EXAMPLE |
| 84 | 27 | 756 | 1680 | 32 | 0.5 | −65 | INVENTION EXAMPLE |
| 85 | 11 | 938 | 1340 | 12 | 0.9 | −65 | COMPARATIVE EXAMPLE |
| 86 | 28 | 714 | 1020 | 37 | 0.3 | −70 | INVENTION EXAMPLE |
| 87 | 11 | 938 | 1340 | 12 | 0.9 | −65 | COMPARATIVE EXAMPLE |
| 88 | 27 | 693 | 990 | 32 | 0.5 | −65 | INVENTION EXAMPLE |
| 89 | 28 | 714 | 1020 | 37 | 0.3 | −70 | INVENTION EXAMPLE |
| 90 | 11 | 938 | 1340 | 12 | 0.9 | −65 | COMPARATIVE EXAMPLE |
| 91 | 28 | 714 | 1020 | 37 | 0.3 | −70 | INVENTION EXAMPLE |
| 92 | 28 | 714 | 1020 | 37 | 0.3 | −70 | INVENTION EXAMPLE |
| 93 | 27 | 693 | 990 | 32 | 0.5 | −65 | INVENTION EXAMPLE |
| 94 | 27 | 721 | 1030 | 32 | 0.5 | −65 | INVENTION EXAMPLE |
| 95 | 28 | 732 | 1045 | 37 | 0.3 | −70 | INVENTION EXAMPLE |
| 96 | 27 | 756 | 1680 | 32 | 0.5 | −65 | INVENTION EXAMPLE |
| 97 | 11 | 938 | 1340 | 12 | 0.9 | −65 | COMPARATIVE EXAMPLE |
| 98 | 27 | 721 | 1030 | 32 | 0.5 | −65 | INVENTION EXAMPLE |
| 99 | 28 | 732 | 1045 | 37 | 0.3 | −70 | INVENTION EXAMPLE |
| 100 | 27 | 756 | 1680 | 32 | 0.5 | −65 | INVENTION EXAMPLE |
| 101 | 11 | 938 | 1340 | 12 | 0.9 | −65 | COMPARATIVE EXAMPLE |
| 102 | 27 | 693 | 990 | 32 | 0.5 | −65 | INVENTION EXAMPLE |
| 103 | 28 | 714 | 1020 | 37 | 0.3 | −70 | INVENTION EXAMPLE |
| 104 | 27 | 756 | 1680 | 32 | 0.5 | −65 | INVENTION EXAMPLE |
| 105 | 11 | 938 | 1340 | 12 | 0.9 | −65 | COMPARATIVE EXAMPLE |
| 106 | 27 | 693 | 990 | 32 | 0.5 | −65 | INVENTION EXAMPLE |
| 107 | 28 | 714 | 1020 | 37 | 0.3 | −70 | INVENTION EXAMPLE |
| 108 | 27 | 756 | 1680 | 32 | 0.5 | −65 | INVENTION EXAMPLE |
| 109 | 11 | 938 | 1340 | 12 | 0.9 | −65 | COMPARATIVE EXAMPLE |
| 110 | 27 | 693 | 990 | 32 | 0.5 | −65 | INVENTION EXAMPLE |
| 111 | 28 | 714 | 1020 | 37 | 0.3 | −70 | INVENTION EXAMPLE |
| 112 | 27 | 756 | 1680 | 32 | 0.5 | −65 | INVENTION EXAMPLE |
| 113 | 11 | 938 | 1340 | 12 | 0.9 | −65 | COMPARATIVE EXAMPLE |
| 114 | 27 | 721 | 1030 | 32 | 0.5 | −65 | INVENTION EXAMPLE |
| 115 | 28 | 732 | 1045 | 37 | 0.3 | −70 | INVENTION EXAMPLE |
| 116 | 27 | 756 | 1680 | 32 | 0.5 | −65 | INVENTION EXAMPLE |
| 117 | 11 | 938 | 1340 | 12 | 0.9 | −65 | COMPARATIVE EXAMPLE |
| 118 | 27 | 756 | 1680 | 32 | 0.5 | −65 | INVENTION EXAMPLE |

TABLE 26-continued

| MANUFACTURE No. | MECHANICAL PROPERTIES ELONGATION (%) | 0.2% PROOF STRESS (MPa) | TENSILE STRENGTH (MPa) | HOLE EXPANSION VALUE (%) | RATIO (R/t) | DUCTILE-BRITTLE TRANSITION TEMPERATURE (° C.) | NOTE |
|---|---|---|---|---|---|---|---|
| 119 | 28 | 714 | 1020 | 37 | 0.3 | −70 | INVENTION EXAMPLE |
| 120 | 27 | 756 | 1680 | 32 | 0.5 | −65 | INVENTION EXAMPLE |

TABLE 27

| MANUFACTURE No. | MECHANICAL PROPERTIES ELONGATION (%) | 0.2% PROOF STRESS (MPa) | TENSILE STRENGTH (MPa) | HOLE EXPANSION VALUE (%) | RATIO (R/t) | DUCTILE-BRITTLE TRANSITION TEMPERATURE (° C.) | NOTE |
|---|---|---|---|---|---|---|---|
| 121 | 11 | 938 | 1340 | 12 | 0.9 | −65 | COMPARATIVE EXAMPLE |
| 122 | 27 | 756 | 1680 | 32 | 0.5 | −65 | INVENTION EXAMPLE |
| 123 | 28 | 714 | 1020 | 37 | 0.3 | −70 | INVENTION EXAMPLE |
| 124 | 27 | 756 | 1680 | 32 | 0.5 | −65 | INVENTION EXAMPLE |
| 125 | 11 | 938 | 1340 | 12 | 0.9 | −65 | COMPARATIVE EXAMPLE |
| 126 | 27 | 756 | 1680 | 32 | 0.5 | −65 | INVENTION EXAMPLE |
| 127 | 28 | 714 | 1020 | 37 | 0.3 | −70 | INVENTION EXAMPLE |
| 128 | 27 | 756 | 1680 | 32 | 0.5 | −65 | INVENTION EXAMPLE |
| 129 | 11 | 938 | 1340 | 12 | 0.9 | −65 | COMPARATIVE EXAMPLE |
| 130 | 28 | 714 | 1020 | 37 | 0.3 | −70 | INVENTION EXAMPLE |
| 131 | 28 | 714 | 990 | 37 | 0.3 | −70 | INVENTION EXAMPLE |
| 132 | 28 | 714 | 1020 | 37 | 0.3 | −70 | INVENTION EXAMPLE |
| 133 | 28 | 714 | 1020 | 37 | 0.3 | −70 | INVENTION EXAMPLE |
| 134 | 28 | 714 | 1020 | 37 | 0.3 | −70 | INVENTION EXAMPLE |
| 135 | 28 | 714 | 1020 | 37 | 0.3 | −70 | INVENTION EXAMPLE |
| 136 | 28 | 714 | 1191 | 37 | 0.3 | −70 | INVENTION EXAMPLE |
| 137 | 28 | 714 | 1482 | 37 | 0.3 | −70 | INVENTION EXAMPLE |
| 138 | 28 | 714 | 990 | 37 | 0.3 | −70 | INVENTION EXAMPLE |
| 139 | 28 | 714 | 1020 | 37 | 0.3 | −70 | INVENTION EXAMPLE |
| 140 | 28 | 714 | 1020 | 37 | 0.3 | −70 | INVENTION EXAMPLE |
| 141 | 28 | 714 | 1020 | 37 | 0.3 | −70 | INVENTION EXAMPLE |
| 142 | 28 | 714 | 1184 | 37 | 0.3 | −70 | INVENTION EXAMPLE |
| 143 | 28 | 714 | 1199 | 37 | 0.3 | −70 | INVENTION EXAMPLE |
| 144 | 28 | 714 | 984 | 37 | 0.3 | −70 | INVENTION EXAMPLE |
| 145 | 28 | 714 | 1020 | 37 | 0.3 | −70 | INVENTION EXAMPLE |
| 146 | 28 | 714 | 1020 | 37 | 0.3 | −70 | INVENTION EXAMPLE |
| 147 | 28 | 714 | 1187 | 37 | 0.3 | −70 | INVENTION EXAMPLE |
| 148 | 28 | 714 | 1290 | 37 | 0.3 | −70 | INVENTION EXAMPLE |
| 149 | 28 | 714 | 1476 | 37 | 0.3 | −70 | INVENTION EXAMPLE |
| 150 | 28 | 714 | 1476 | 37 | 0.3 | −70 | INVENTION EXAMPLE |
| 151 | 28 | 714 | 1476 | 37 | 0.3 | −70 | INVENTION EXAMPLE |
| 152 | 9 | 652 | 1420 | 12 | 0.9 | −65 | COMPARATIVE EXAMPLE |

As illustrated in Table 24 to Table 27, in invention examples such as Test No. 1 and No. 4 falling within the range of the present invention, excellent elongation, 0.2% proof stress, tensile strength, hole expansion value, ratio R/t, and ductile-brittle transition temperature were obtained.

On the other hand, in comparative examples such as Manufacture No. 2 and No. 3, in which the area fraction of the polygonal ferrite became large excessively, the area fraction of the bainitic ferrite became short, the area fraction of the retained austenite became short, the ratio of the retained austenite grains in a predetermined form became short, and the ratio of the bainitic ferrite grains in a predetermined form became short, the elongation, the hole expansion value, and the ratio R/t were low. In comparative examples such as Manufacture No. 5 and No. 6, in which the area fraction of the bainitic ferrite became short, the area fraction of the martensite became large excessively, the ratio of the retained austenite grains in a predetermined form became short, and the ratio of the bainitic ferrite grains in a predetermined form became short, the elongation, the hole expansion value, and the ratio R/t were low. In comparative examples such as Manufacture No. 30 and No. 37, in which the ratio of the retained austenite grains in a predetermined form became short, the elongation was low. In comparative examples such as Manufacture No. 70 and No. 85, in which the area fraction of the bainitic ferrite became short, the area fraction of the martensite became large excessively, the ratio of the retained austenite grains in a predetermined form became short, and the ratio of the bainitic ferrite grains in a predetermined form became short, the elongation, the hole expansion value, and the ratio R/t were low.

INDUSTRIAL APPLICABILITY

The present invention can be utilized in, for example, industries relating to a steel sheet suitable for automotive parts.

The invention claimed is:

1. A steel sheet, comprising:
a chemical composition represented by,
in mass %,
C: 0.10% to 0.5%,
Si: 0.5% to 4.0%,
Mn: 1.0% to 4.0%,
P: 0.015% or less,
S: 0.050% or less,
N: 0.01% or less,
Al: 2.0% or less,
Si and Al: 0.5% to 6.0% in total,
Ti: 0.00% to 0.20%,
Nb: 0.00% to 0.20%,
B: 0.0000% to 0.0030%,
Mo: 0.00% to 0.50%,
Cr: 0.0% to 2.0%,
V: 0.00% to 0.50%,
Mg: 0.000% to 0.040%,
REM: 0.000% to 0.040%,
Ca: 0.000% to 0.040%, and
the balance: Fe and impurities; and
a metal structure represented by,
in area fraction,
polygonal ferrite: 40% or less,
martensite: 20% or less,
bainitic ferrite: 50% to 95%, and
retained austenite: 5% to 50%, wherein
in area fraction, 80% or more of the bainitic ferrite comprises bainitic ferrite grains that have an aspect ratio of 0.1 to 1.0 and have a dislocation density of $8\times10^2$ (cm/cm$^3$) or less in a region surrounded by a grain boundary with a misorientation angle of 15° or more, and
in area fraction, 80% or more of the retained austenite comprises retained austenite grains that have an aspect ratio of 0.1 to 1.0, have a major axis length of 1.0 μm to 28.0 μm, and have a minor axis length of 0.1 μm to 2.8 μm.

2. The steel sheet according to claim 1, wherein
the metal structure is represented by, in area fraction,
polygonal ferrite: 5% to 20%,
martensite: 15% or less,
bainitic ferrite: 75% to 90%, and
retained austenite: 5% to 20%.

3. The steel sheet according to claim 1, wherein
the metal structure is represented by, in area fraction,
polygonal ferrite: greater than 20% and 40% or less,
martensite: 20% or less,
bainitic ferrite: 50% to 75%, and
retained austenite: 5% to 30%.

4. The steel sheet according to claim 1, wherein
in the chemical composition, in mass %,
Ti: 0.01% to 0.20%,
Nb: 0.005% to 0.20%,
B: 0.0001% to 0.0030%,
Mo: 0.01% to 0.50%,
Cr: 0.01% to 2.0%,
V: 0.01% to 0.50%,
Mg: 0.0005% to 0.040%,
REM: 0.0005% to 0.040%, or
Ca: 0.0005% to 0.040%,
or an arbitrary combination of the above is established.

5. The steel sheet according to claim 1, further comprising:
a plating layer formed on a surface thereof.

6. The steel sheet according to claim 2, wherein
in the chemical composition, in mass %,
Ti: 0.01% to 0.20%,
Nb: 0.005% to 0.20%,
B: 0.0001% to 0.0030%,
Mo: 0.01% to 0.50%,
Cr: 0.01% to 2.0%,
V: 0.01% to 0.50%,
Mg: 0.0005% to 0.040%,
REM: 0.0005% to 0.040%, or
Ca: 0.0005% to 0.040%,
or an arbitrary combination of the above is established.

7. The steel sheet according to claim 3, wherein
in the chemical composition, in mass %,
Ti: 0.01% to 0.20%,
Nb: 0.005% to 0.20%,
B: 0.0001% to 0.0030%,
Mo: 0.01% to 0.50%,
Cr: 0.01% to 2.0%,
V: 0.01% to 0.50%,
Mg: 0.0005% to 0.040%,
REM: 0.0005% to 0.040%, or
Ca: 0.0005% to 0.040%,
or an arbitrary combination of the above is established.

8. The steel sheet according to claim 2, further comprising:
a plating layer formed on a surface thereof.

9. The steel sheet according to claim 3, further comprising:
a plating layer formed on a surface thereof.

10. The steel sheet according to claim 4, further comprising:
a plating layer formed on a surface thereof.

11. The steel sheet according to claim 6, further comprising:
a plating layer formed on a surface thereof.

12. The steel sheet according to claim 7, further comprising:
a plating layer formed on a surface thereof.

* * * * *